US005878306A

United States Patent [19]

Michlin

[11] Patent Number: 5,878,306

[45] Date of Patent: Mar. 2, 1999

[54] DISPOSABLE STRIP HOLDER INSTALLATION DEVICE AND METHOD USED IN THE IMAGING AND OTHER INDUSTRIES

[76] Inventor: Steven Bruce Michlin, 5310 Bentley, Suite 105, West Bloomfield, Mich. 48322

[21] Appl. No.: 896,491

[22] Filed: Jul. 18, 1997

[51] Int. Cl.[6] ..... G03G 15/00

[52] U.S. Cl. ..... 399/106; 399/107; 399/272; 399/273; 399/274

[58] Field of Search ..... 399/102–106, 399/260, 264, 272–274, 281, 283, 284, 347, 350–351, 107, 109; 428/40.1, 41.7, 42.1; 118/261; 606/213–216; 604/20; 602/54, 57; 424/443–449; 427/208; 156/94, 98, 247, 257, 268, 344; 277/312, 316, 592, 598, 620, 627, 650, 653, 654

[56] References Cited

U.S. PATENT DOCUMENTS

| | | | |
|---|---|---|---|
| 2,673,007 | 3/1954 | Debrie . | |
| 2,805,183 | 9/1957 | Higgins | 154/53.5 |
| 2,904,000 | 9/1959 | Fisher et al. . | |
| 3,076,588 | 2/1963 | Conway et al. . | |
| 3,339,807 | 9/1967 | Eichorn . | |
| 3,385,500 | 5/1968 | Lavander . | |
| 3,454,210 | 7/1969 | Spiegel et al. . | |
| 3,618,826 | 11/1971 | Kangas . | |
| 3,717,533 | 2/1973 | Maywork et al. . | |
| 3,854,653 | 12/1974 | Engelsberger . | |
| 3,923,391 | 12/1975 | Washio et al. | 399/385 |
| 3,999,654 | 12/1976 | Pollack . | |
| 4,062,385 | 12/1977 | Katucha et al. . | |
| 4,089,601 | 5/1978 | Nayone | 399/13 |
| 4,226,525 | 10/1980 | Sakamoto et al. | 399/29 |
| 4,321,101 | 3/1982 | Preiser et al. | 156/239 |
| 4,325,572 | 4/1982 | Amtyr et al. . | |
| 4,406,535 | 9/1983 | Sakamoto et al. | 399/274 |
| 4,441,636 | 4/1984 | Yamashita et al. . | |
| 4,456,154 | 6/1984 | Herriman . | |
| 4,478,512 | 10/1984 | Zoltner | 399/106 |
| 4,491,161 | 1/1985 | Tamura et al. | 141/364 |
| 4,523,834 | 6/1985 | Pelda et al. | 399/106 |
| 4,538,651 | 9/1985 | Lykins . | |
| 4,573,614 | 3/1986 | Ozawa . | |
| 4,614,286 | 9/1986 | Yamaguchi . | |
| 4,615,608 | 10/1986 | Mizutani | 399/103 |
| 4,638,043 | 1/1987 | Szycher et al. | 604/304 X |
| 4,641,643 | 2/1987 | Greer | 128/156 |

(List continued on next page.)

FOREIGN PATENT DOCUMENTS

| | | |
|---|---|---|
| 59-197070 | 11/1984 | Japan . |
| 61-041167 | 2/1987 | Japan . |
| 5-216338 | 8/1993 | Japan . |
| 5-273897 | 10/1993 | Japan . |
| 06-035386 | 2/1994 | Japan . |
| 06-308824 | 11/1994 | Japan . |
| 09-034253 | 2/1997 | Japan . |

*Primary Examiner*—Matthew S. Smith

[57] ABSTRACT

A toner cartridge of a laser printer, copier or facsimile machine has various strips in it for various functions. Among the strips are recovery blades, spreader blades, wiper blades, certain shipping seals, doctor blades and other miscleaneous strips. A device and method is shown that enables any strip or modular shipping seal to be ergonomically installed in a userfriendly way by leaving a strip of protective liner protruding from the strip for easy removal. Also, a device and method for attachment of strips is shown that utilizes a positioning tab stiffener device for userfriendly easy insertion of said strip into a toner cartridge, laser printer, copy cartridge or facsimile machine. After the positioning tab is used to install the strip, the positioning tab stiffener device is removed from the strip assembly. By using preferential 2-sided tapes or transfer tapes that are removable on one surface, the positioning device tab may be removed easier. The positioning device tab device may even stick out on one edge with no adhesive on sticking out portion where this portion that sticks out is easier to remove. Furthermore., a pickup magnetic strip as is used adjacent recovery blades may be made in blocks or groupings for userfriendly removal of protective liner for easier installation.

40 Claims, 33 Drawing Sheets

U.S. PATENT DOCUMENTS

| | | | |
|---|---|---|---|
| 4,641,945 | 2/1987 | Ikesue et al. | 399/262 |
| 4,650,070 | 3/1987 | Oka et al. . | |
| 4,688,926 | 8/1987 | Manno | 399/260 |
| 4,732,277 | 3/1988 | Smith | 229/123.1 |
| 4,778,086 | 10/1988 | Shibata et al. . | |
| 4,781,294 | 11/1988 | Croce . | |
| 4,816,877 | 3/1989 | Keen | 355/133 |
| 4,827,307 | 5/1989 | Zoltner | 399/106 |
| 4,862,210 | 8/1989 | Woolley | 399/106 |
| 4,915,102 | 4/1990 | Kwiatek et al. | 128/156 |
| 4,930,684 | 6/1990 | Patterson | 222/325 |
| 4,931,838 | 6/1990 | Ban et al. | 399/106 |
| 4,942,432 | 7/1990 | Mort et al. | 399/106 |
| 4,981,218 | 1/1991 | Ban et al. | 229/123.1 |
| 5,110,646 | 5/1992 | Prestel et al. | 428/43 |
| 5,142,335 | 8/1992 | Sakata et al. | 399/106 |
| 5,150,807 | 9/1992 | Seyfried et al. | 220/359 |
| 5,177,540 | 1/1993 | Honda et al. | 399/106 |
| 5,184,182 | 2/1993 | Michlin | 399/262 |
| 5,204,110 | 4/1993 | Cartmell et al. | 424/443 |
| 5,229,824 | 7/1993 | Tsusaka et al. | 399/262 |
| 5,258,814 | 11/1993 | Davies | 399/105 |
| 5,296,902 | 3/1994 | Michlin | 399/109 |
| 5,306,374 | 4/1994 | Hambright | 156/247 |
| 5,389,180 | 2/1995 | MacCollum | 156/257 |
| 5,401,346 | 3/1995 | Yin et al. | 156/233 |
| 5,446,525 | 8/1995 | Kobayashi | 399/111 |
| 5,479,250 | 12/1995 | Michlin | 399/351 |
| 5,501,661 | 3/1996 | Cartmell et al. | 602/58 |
| 5,523,828 | 6/1996 | Kesel | 399/103 |
| 5,546,162 | 8/1996 | Michlin et al. | 399/107 |
| 5,621,508 | 4/1997 | McNamara . | |

Figure 3C
PRIOR ART
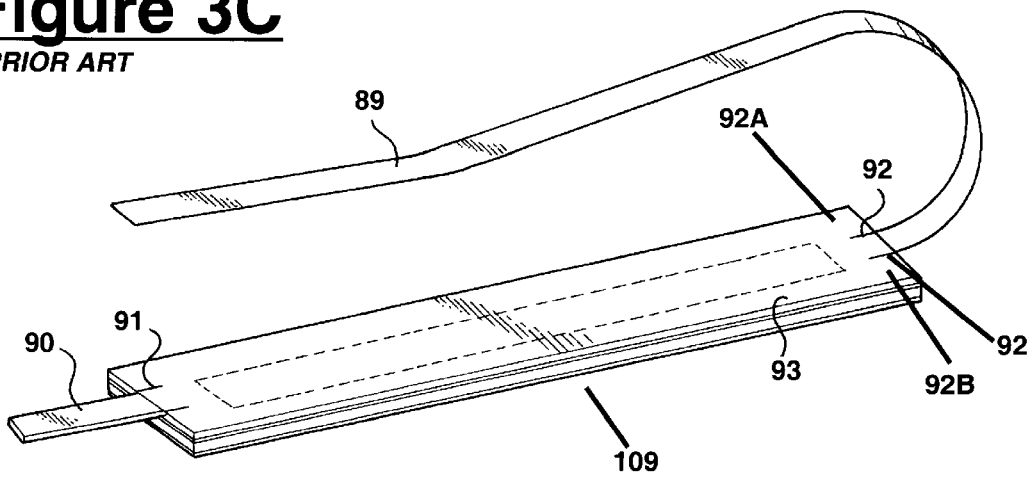
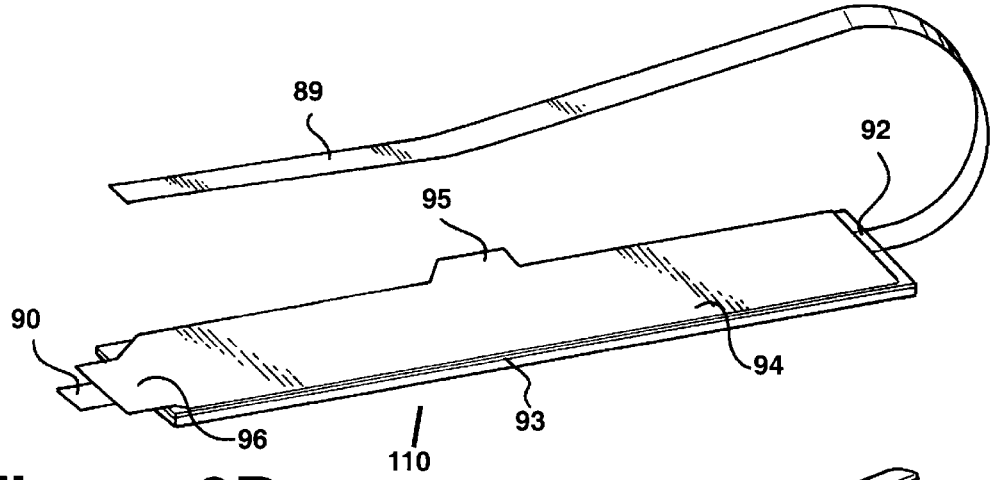
Figure 3D
PRIOR ART
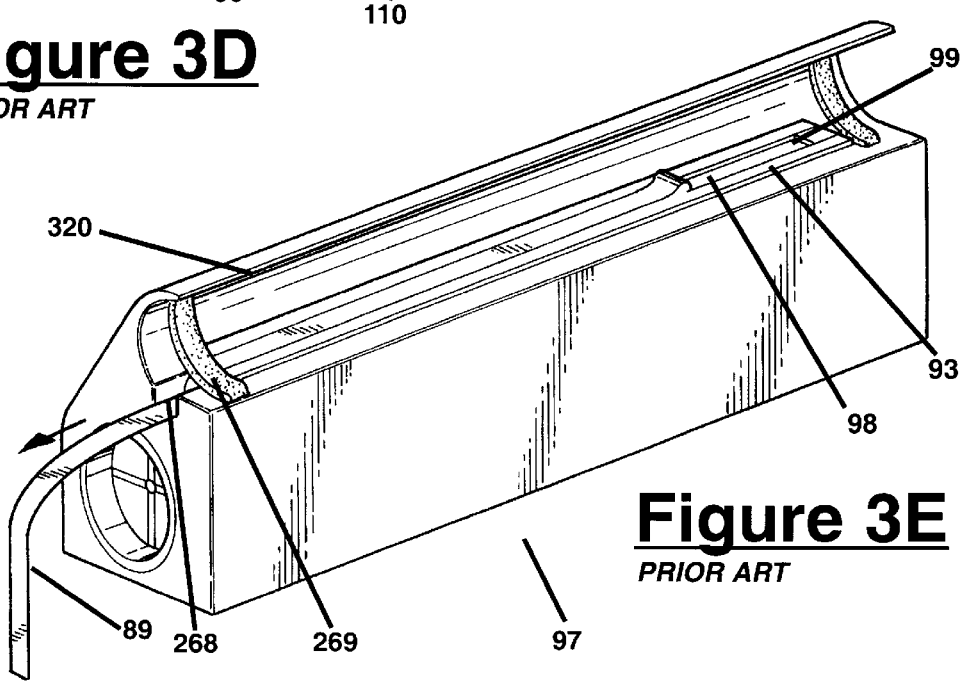
Figure 3E
PRIOR ART

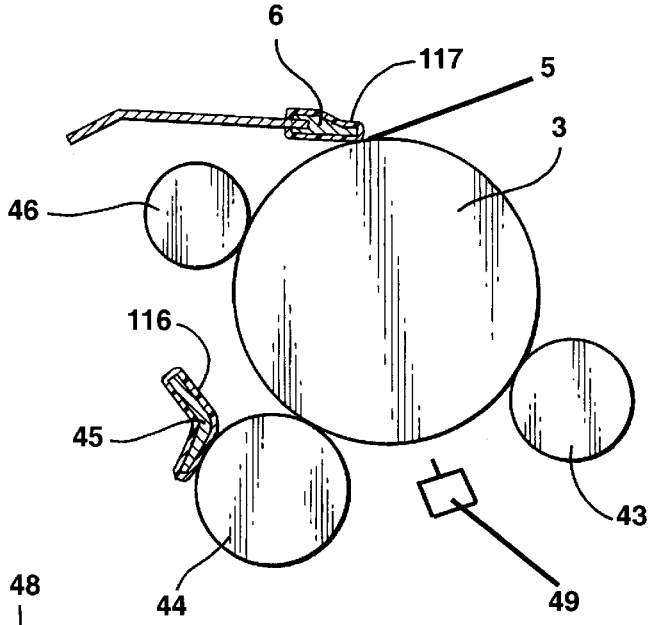
Figure 4
PRIOR ART
Figure 5
PRIOR ART
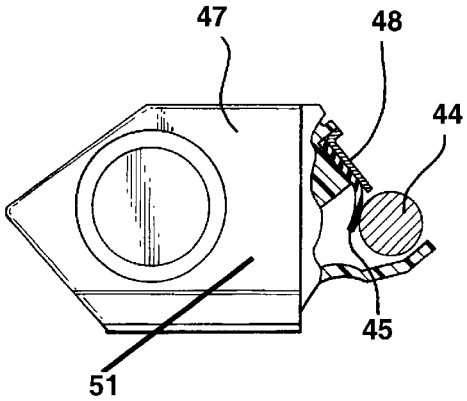
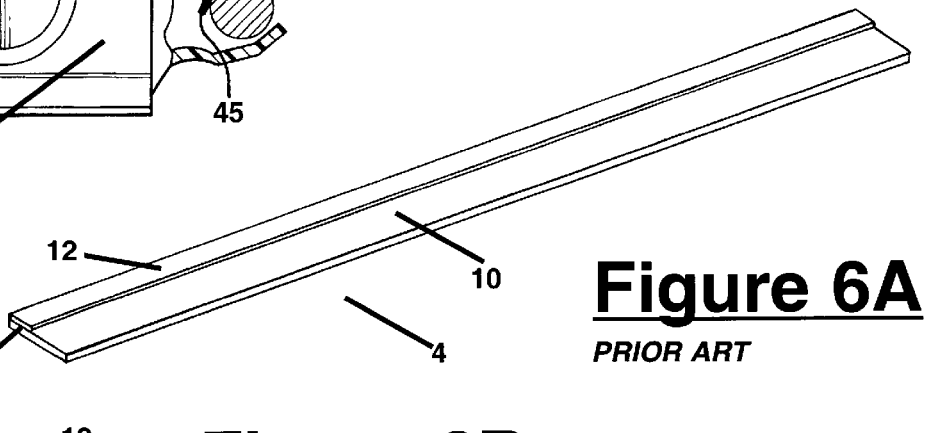
Figure 6A
PRIOR ART
Figure 6B
PRIOR ART
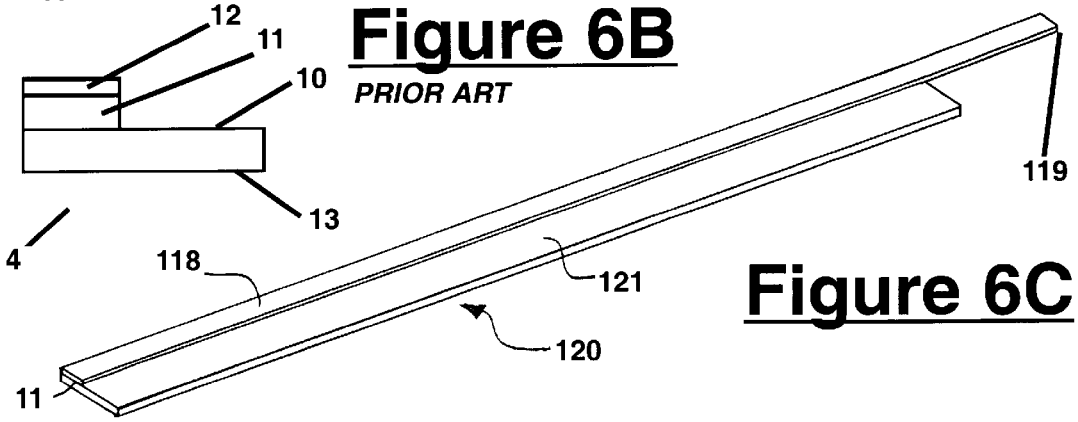
Figure 6C

Figure 8
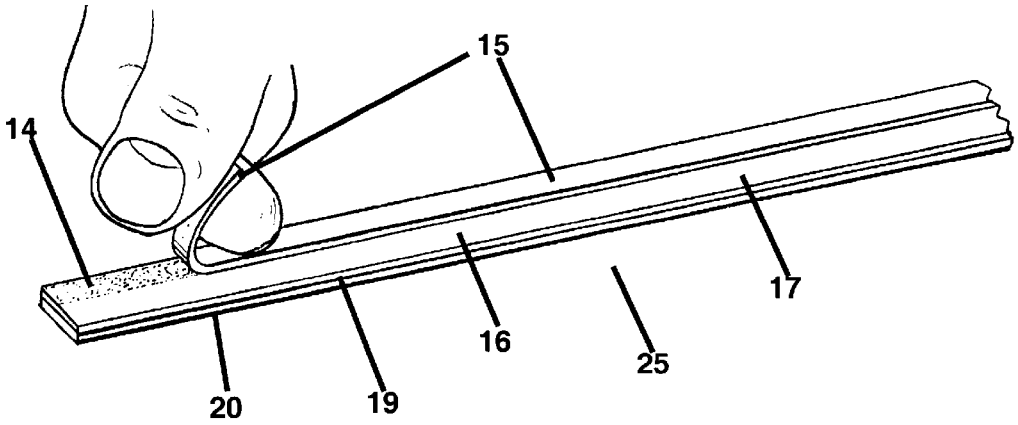
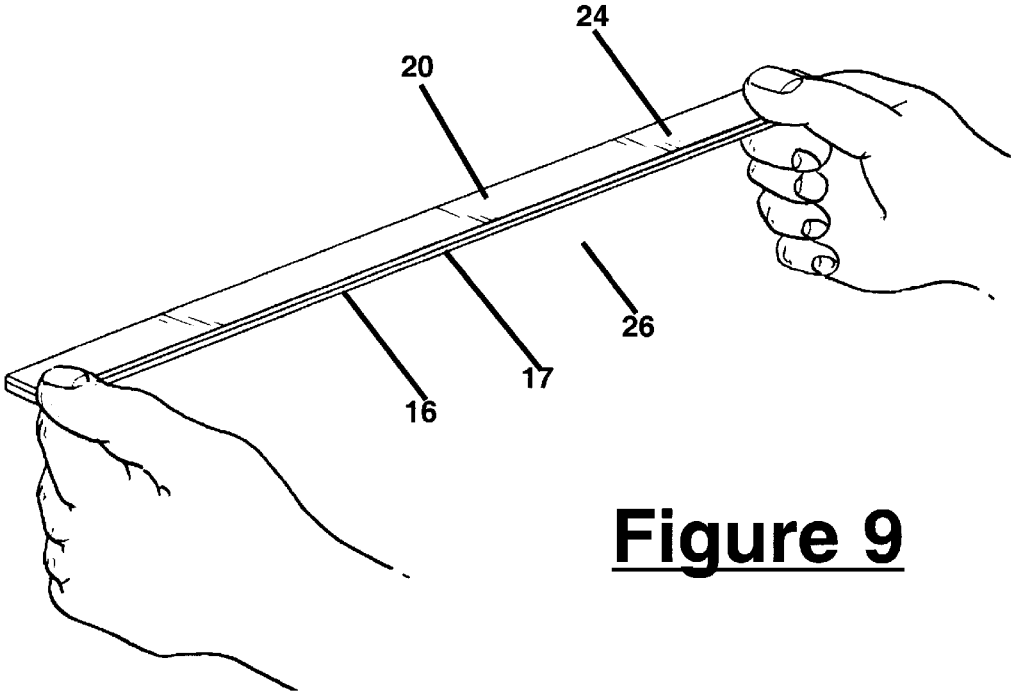
Figure 9

Figure 11B
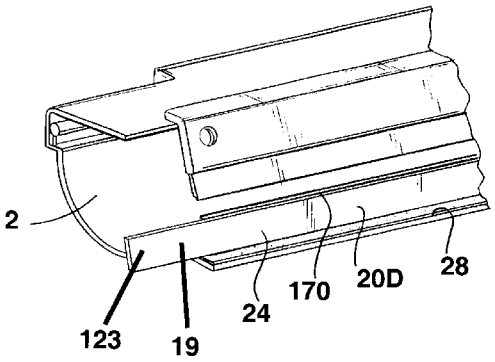
Figure 12
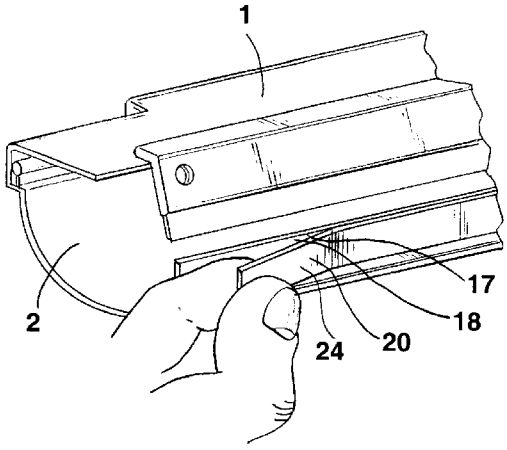
Figure 13
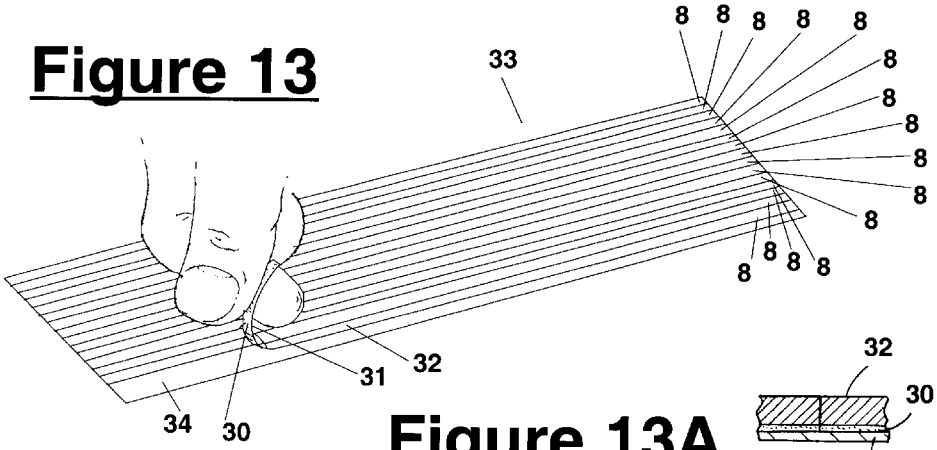
Figure 13A
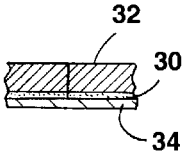
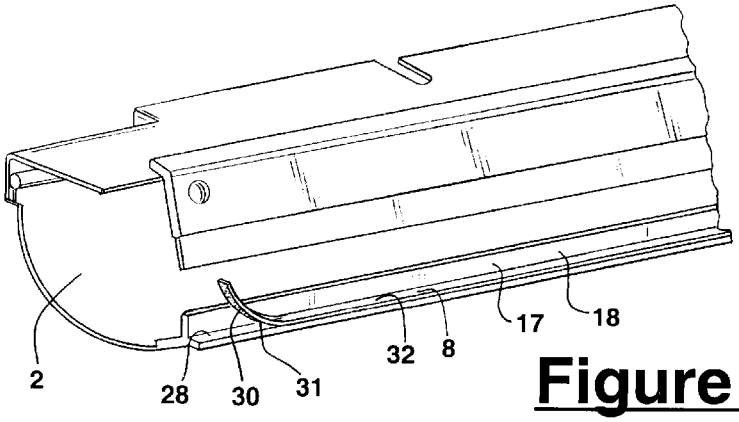
Figure 14

Figure 18
*PRIOR ART*
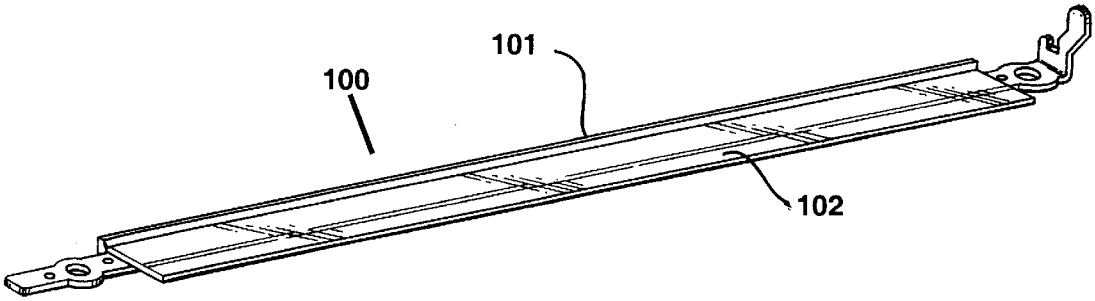
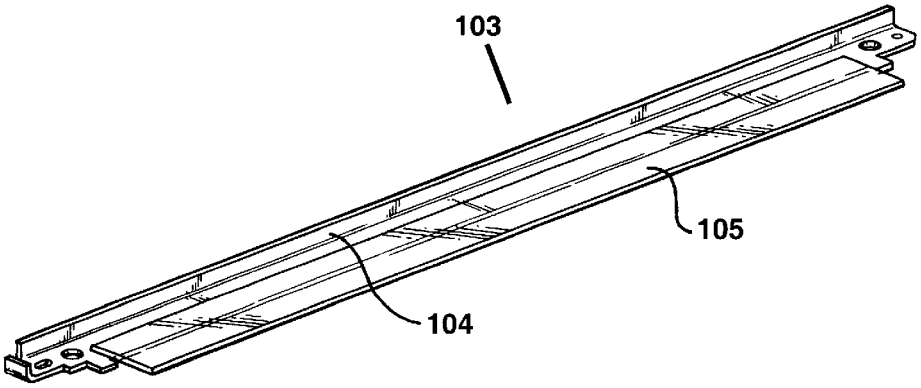
Figure 19
*PRIOR ART*

Figure 20
*PRIOR ART*
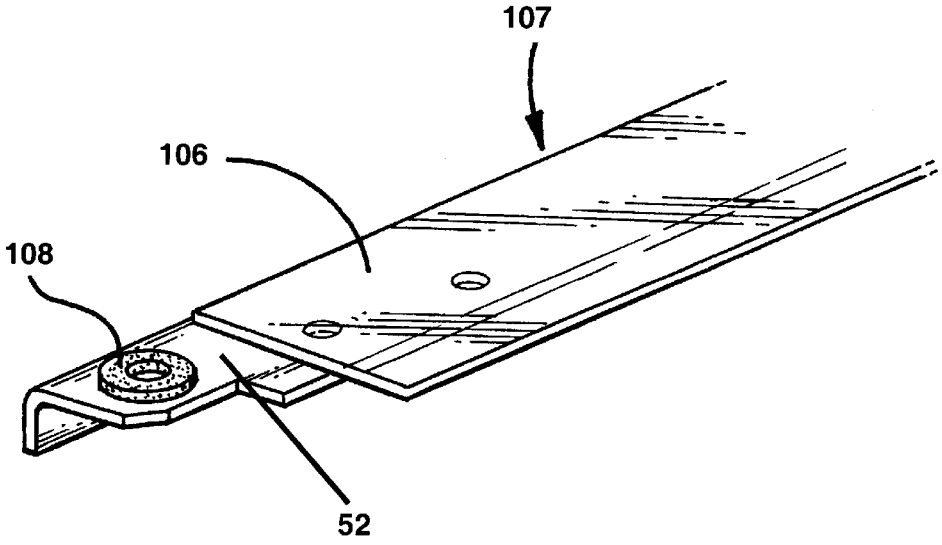
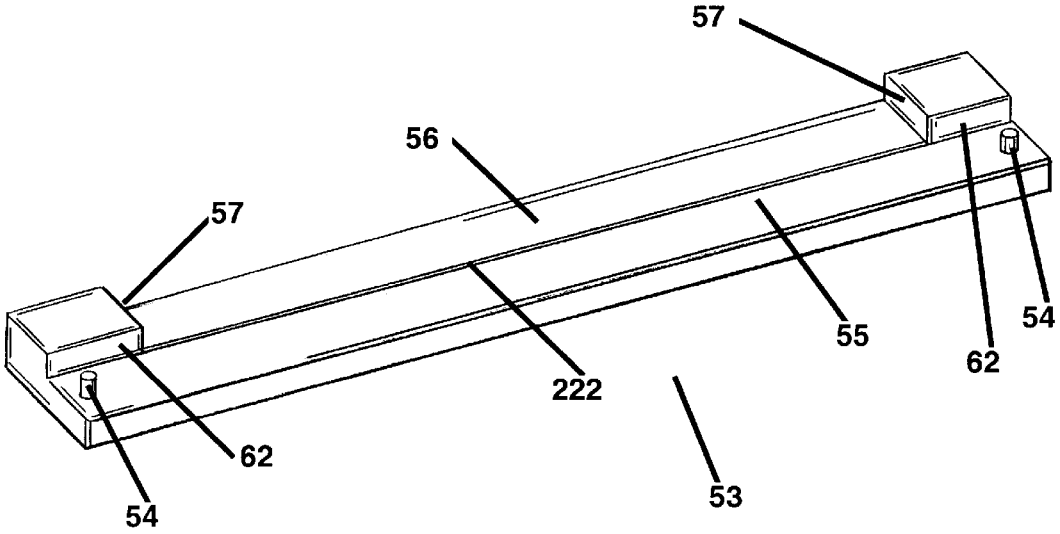
Figure 21A

Figure 24
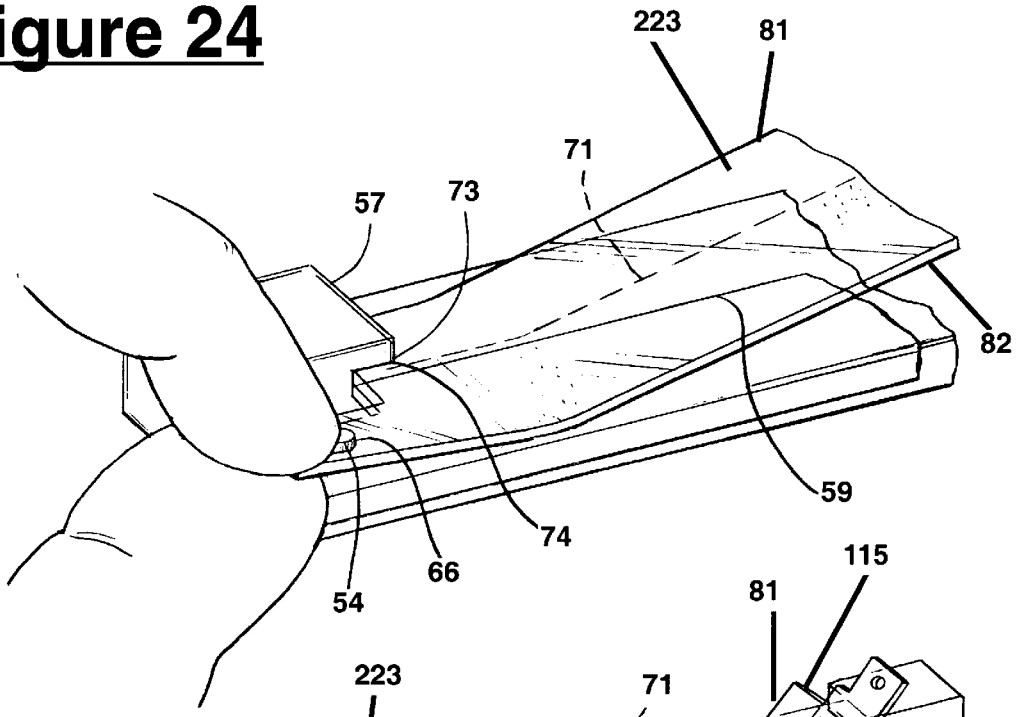
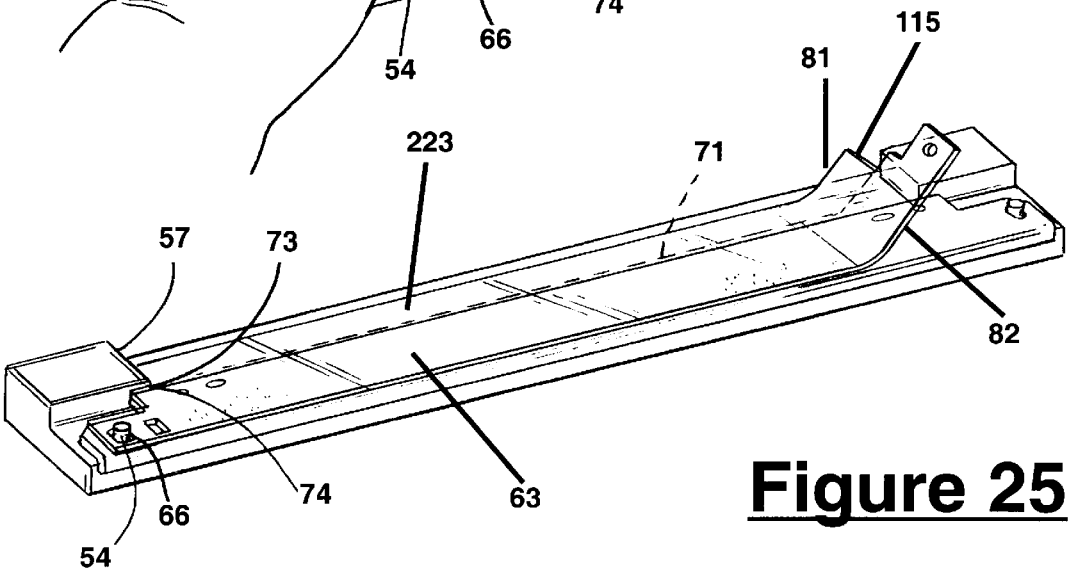
Figure 25
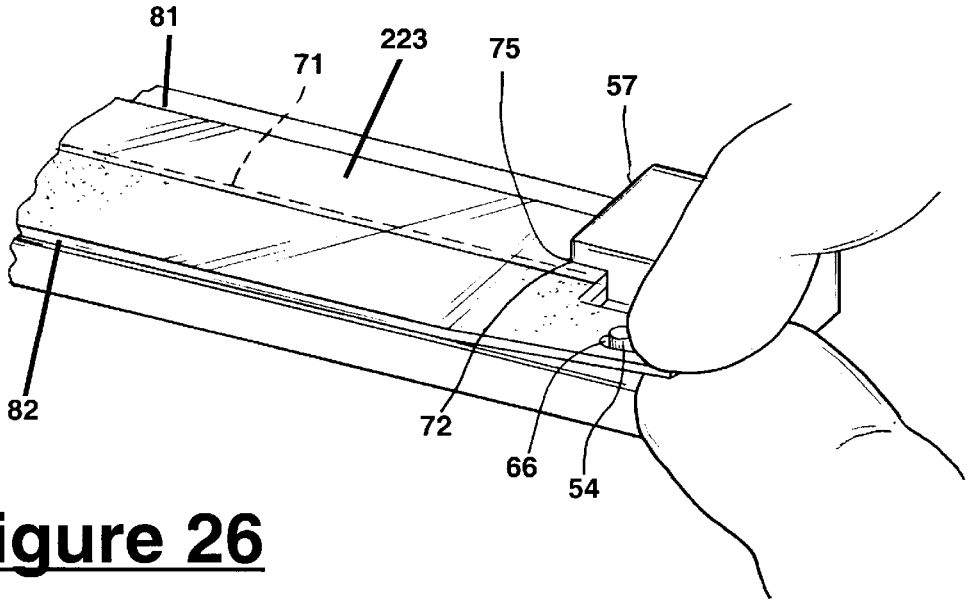
Figure 26

Figure 27
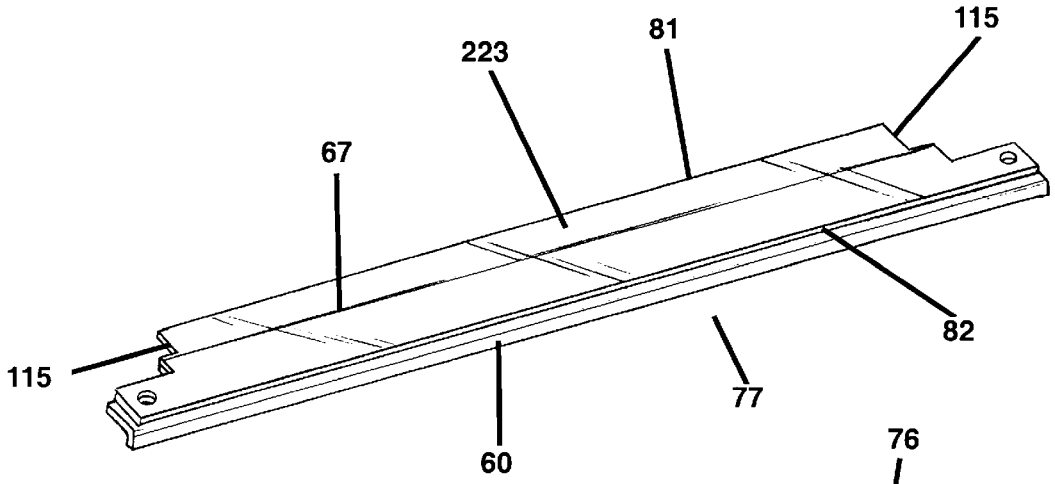
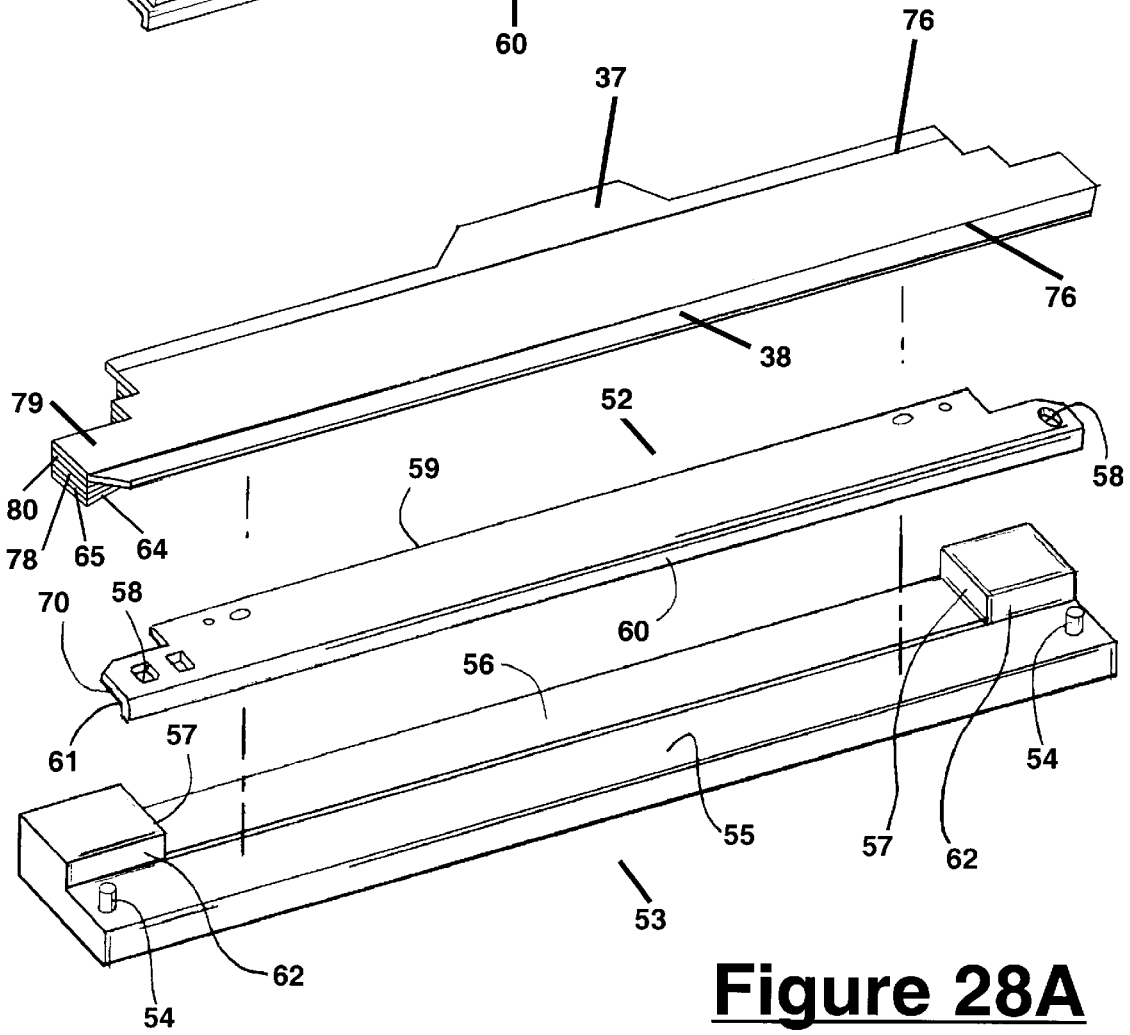
Figure 28A

Figure 29A
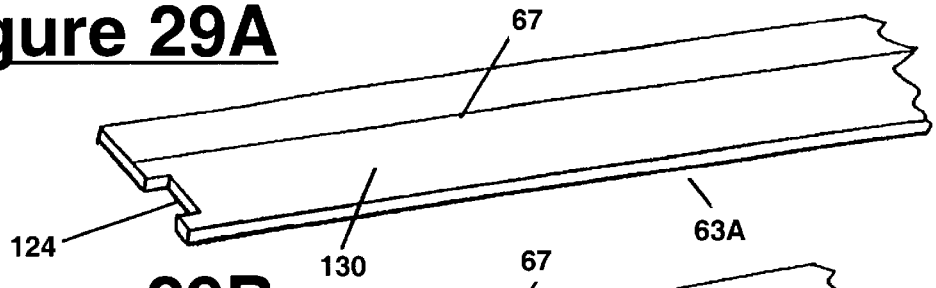
Figure 29B
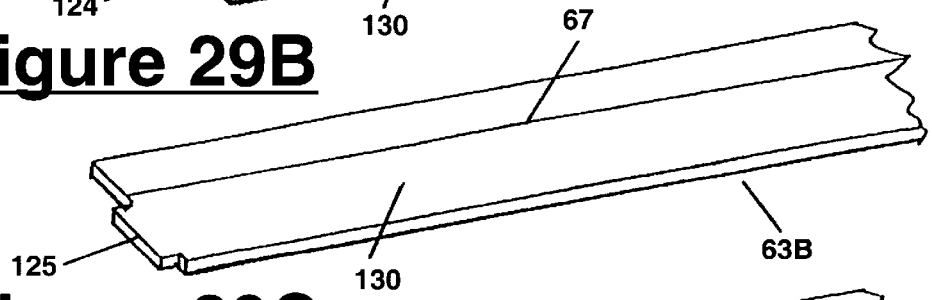
Figure 29C
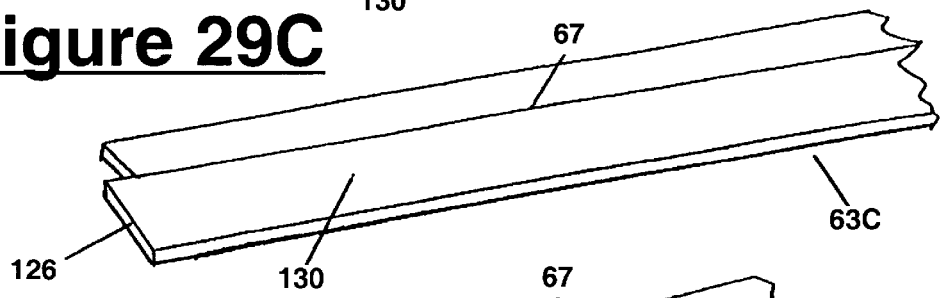
Figure 30
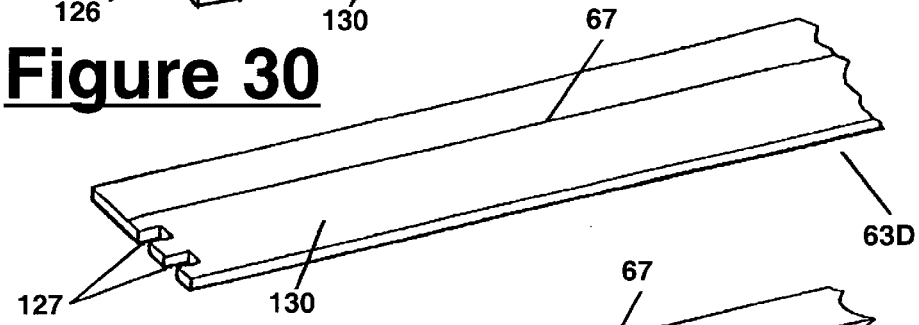
Figure 31
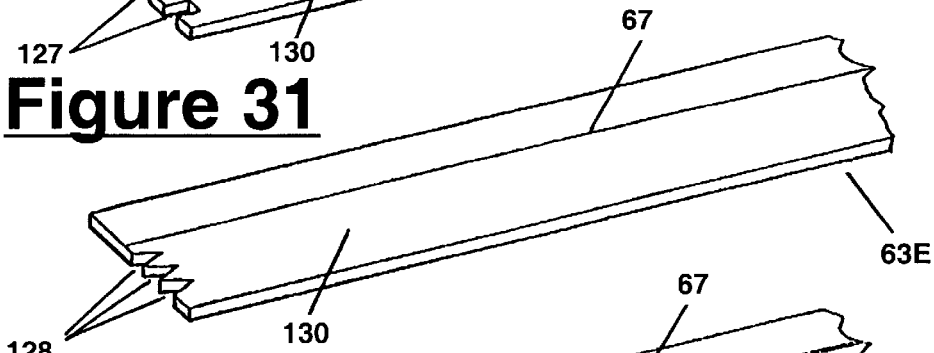
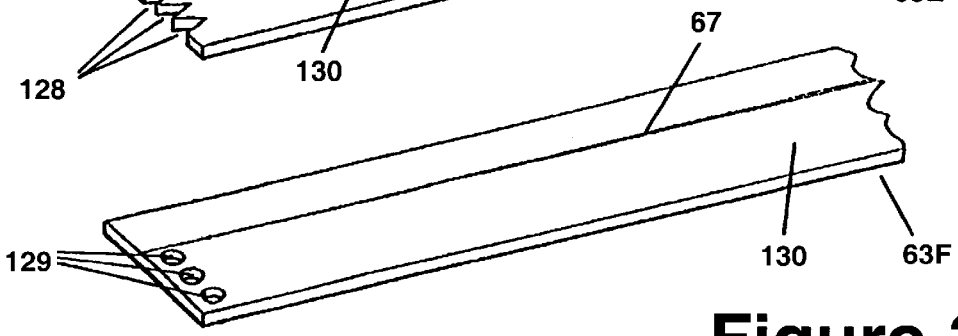
Figure 32

Figure 39
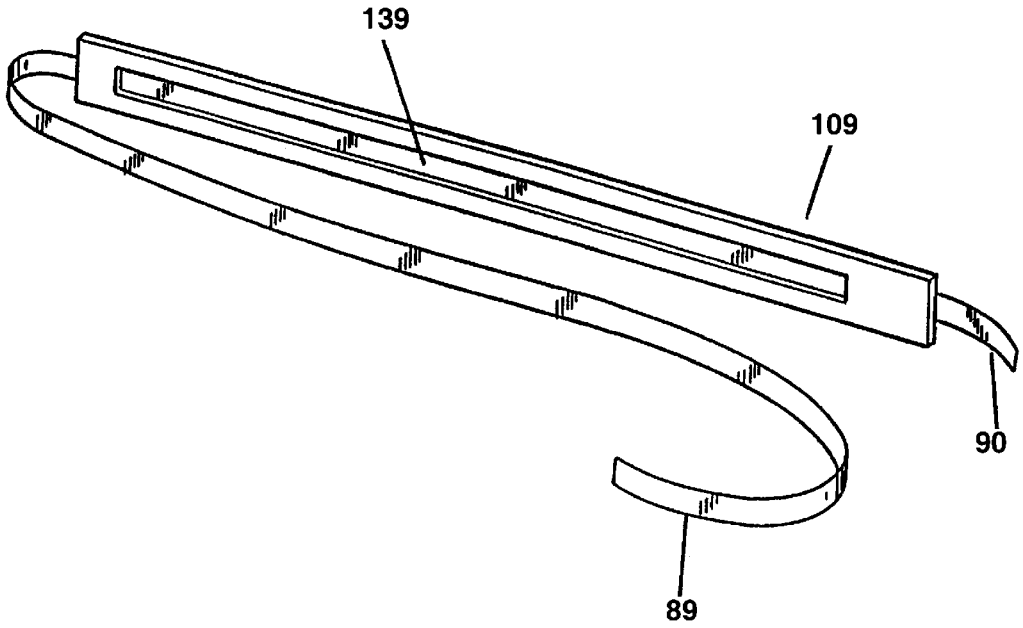
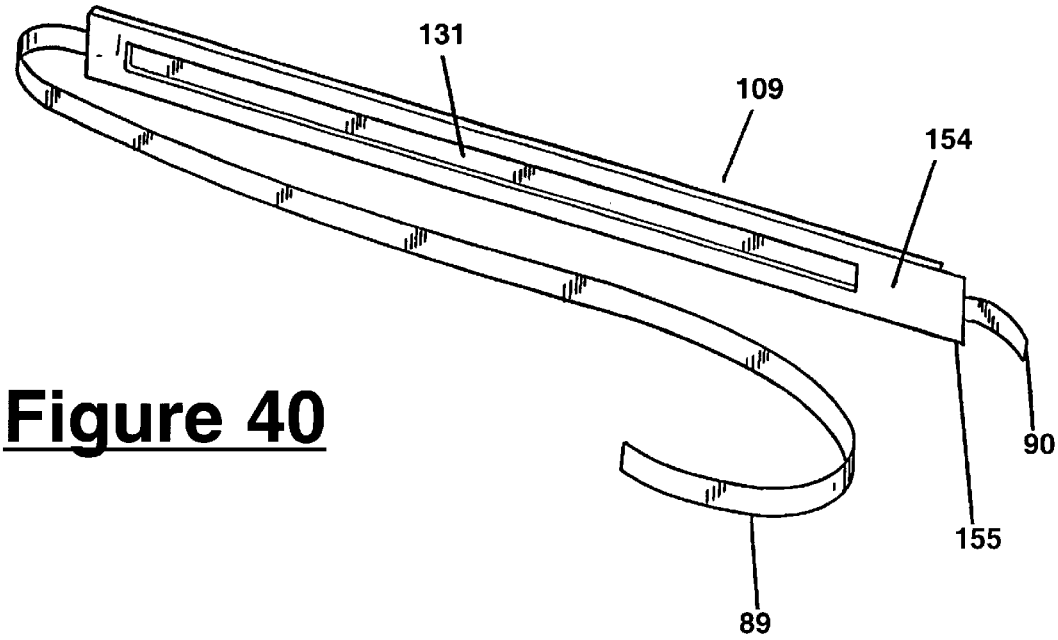
Figure 40

Figure 41
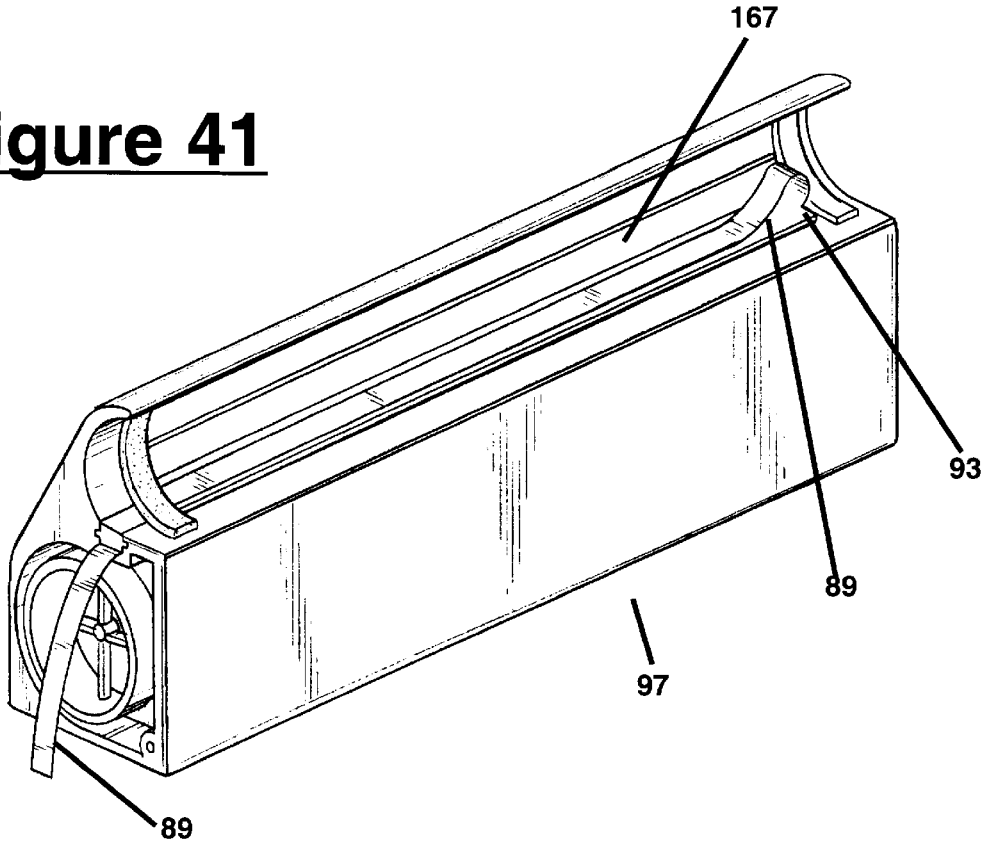
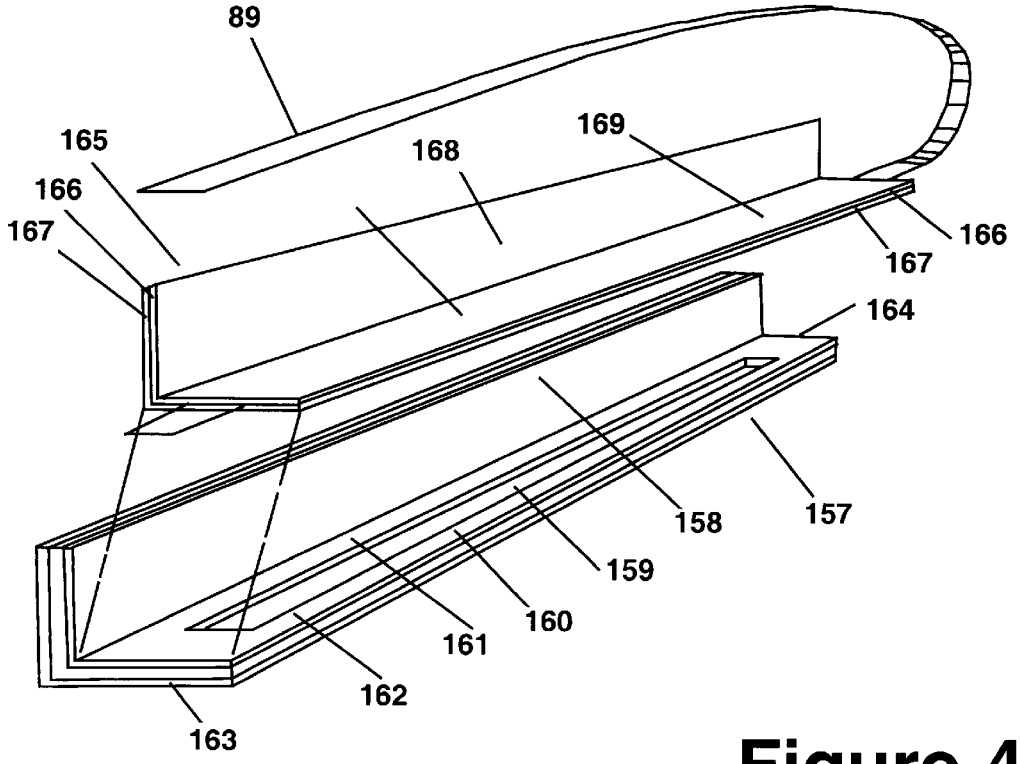
Figure 42

Figure 43
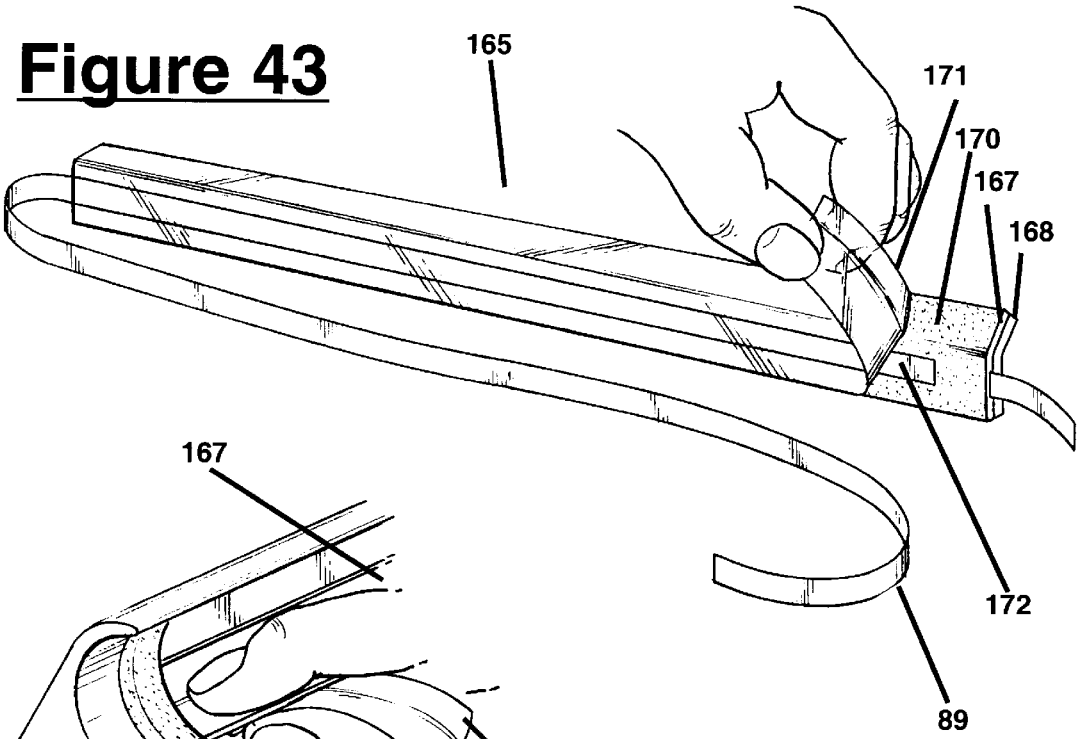
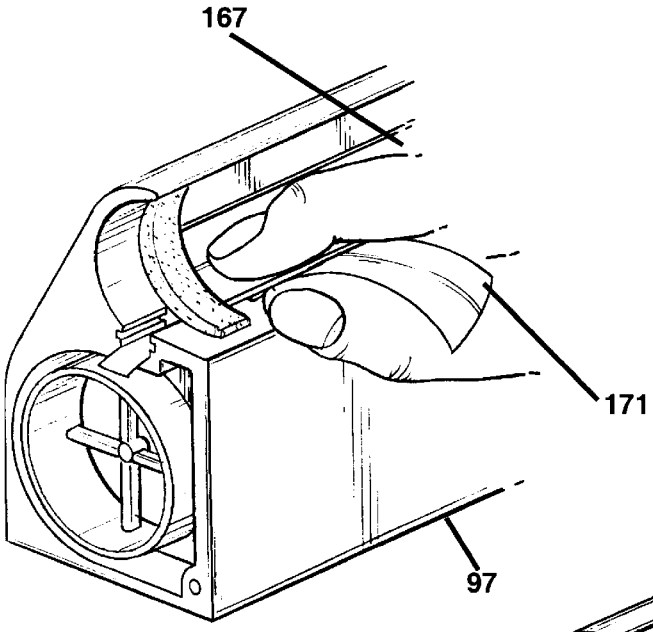
Figure 44
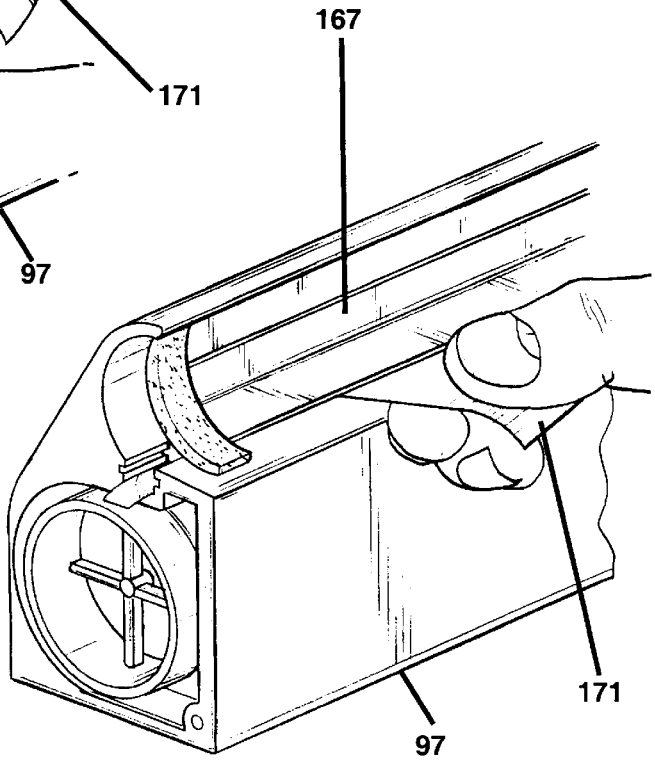
Figure 45

Figure 46
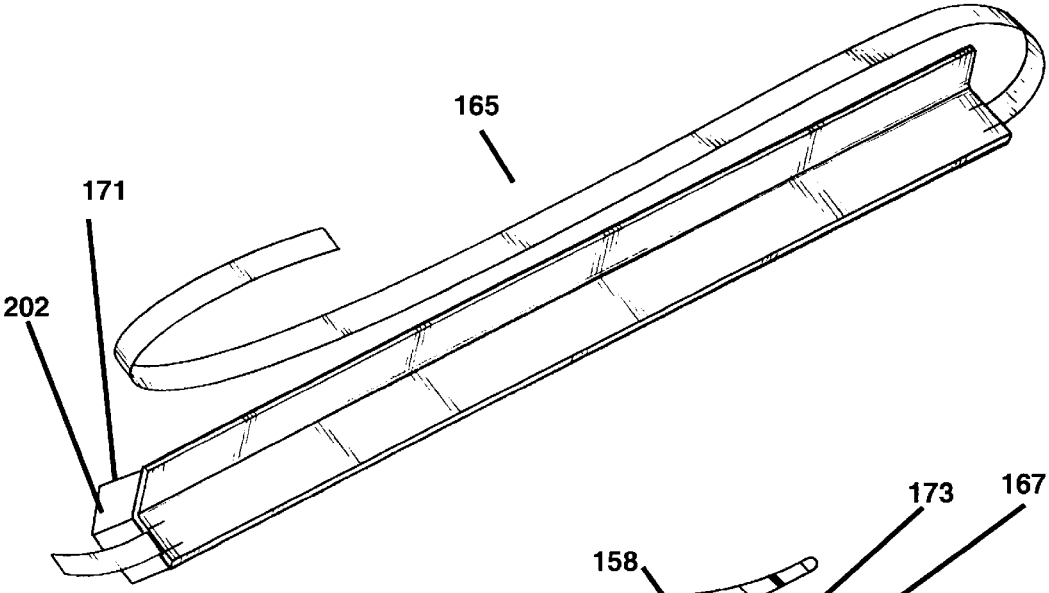
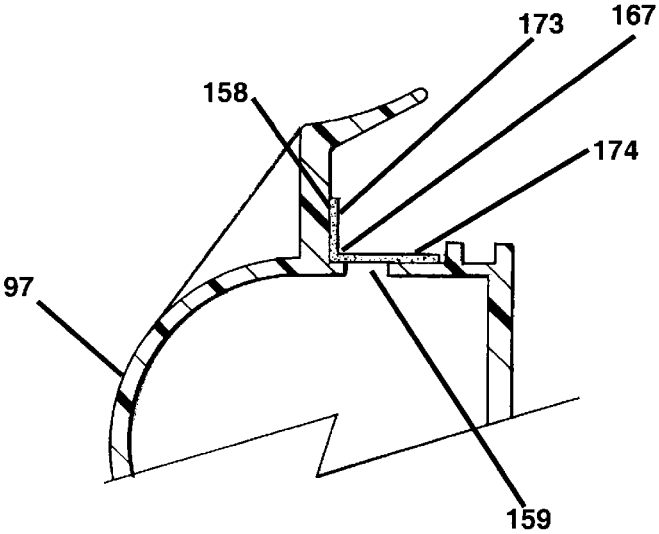
Figure 47

Figure 51
*PRIOR ART*
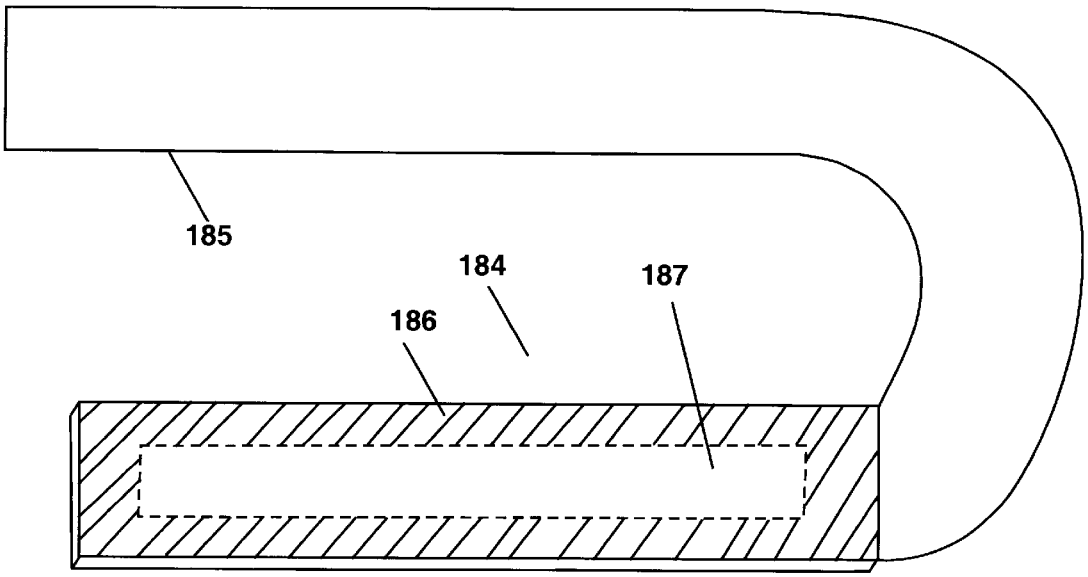
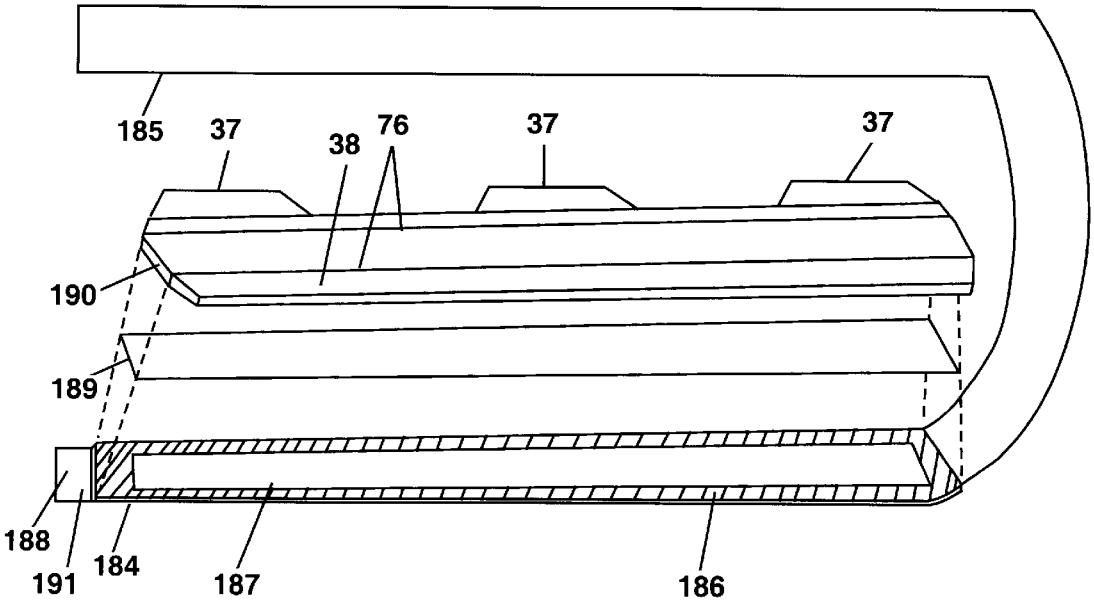
Figure 52

Figure 53
PRIOR ART
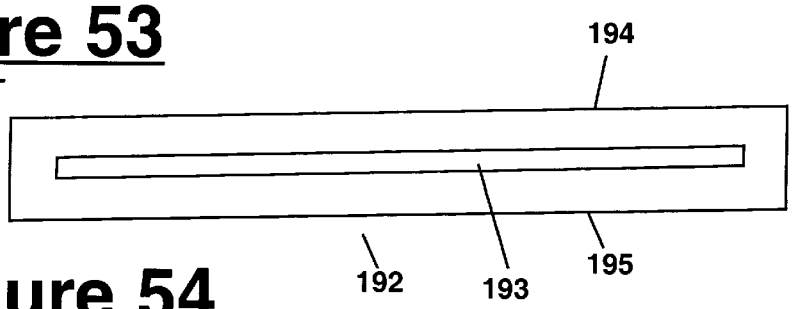
Figure 54
PRIOR ART
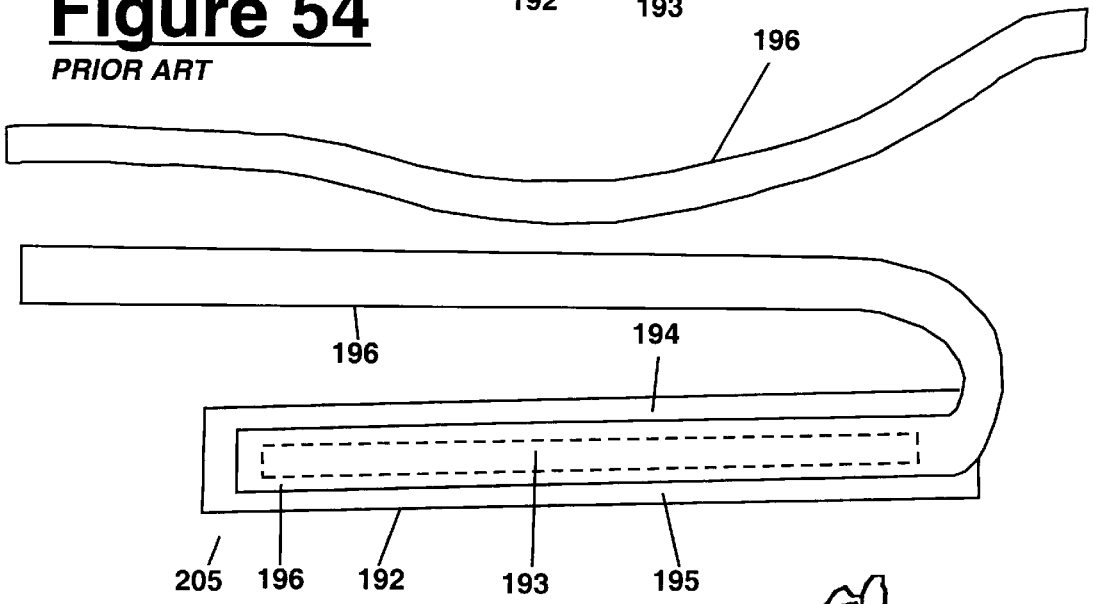
Figure 55A
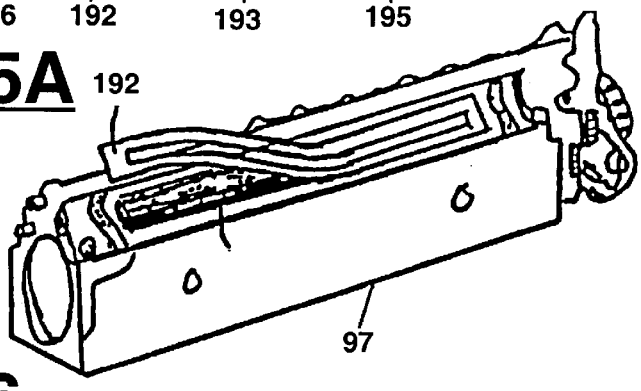
Figure 56
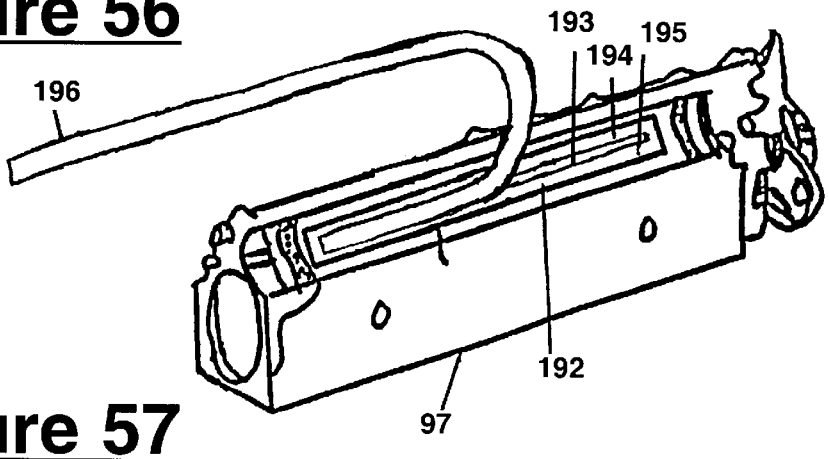
Figure 57

Figure 58
PRIOR ART
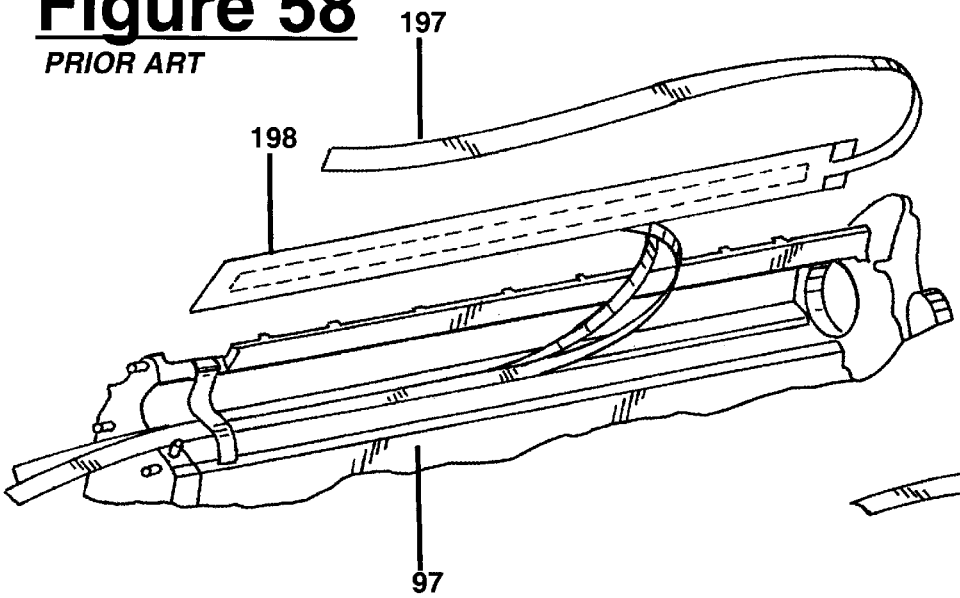
Figure 59
PRIOR ART
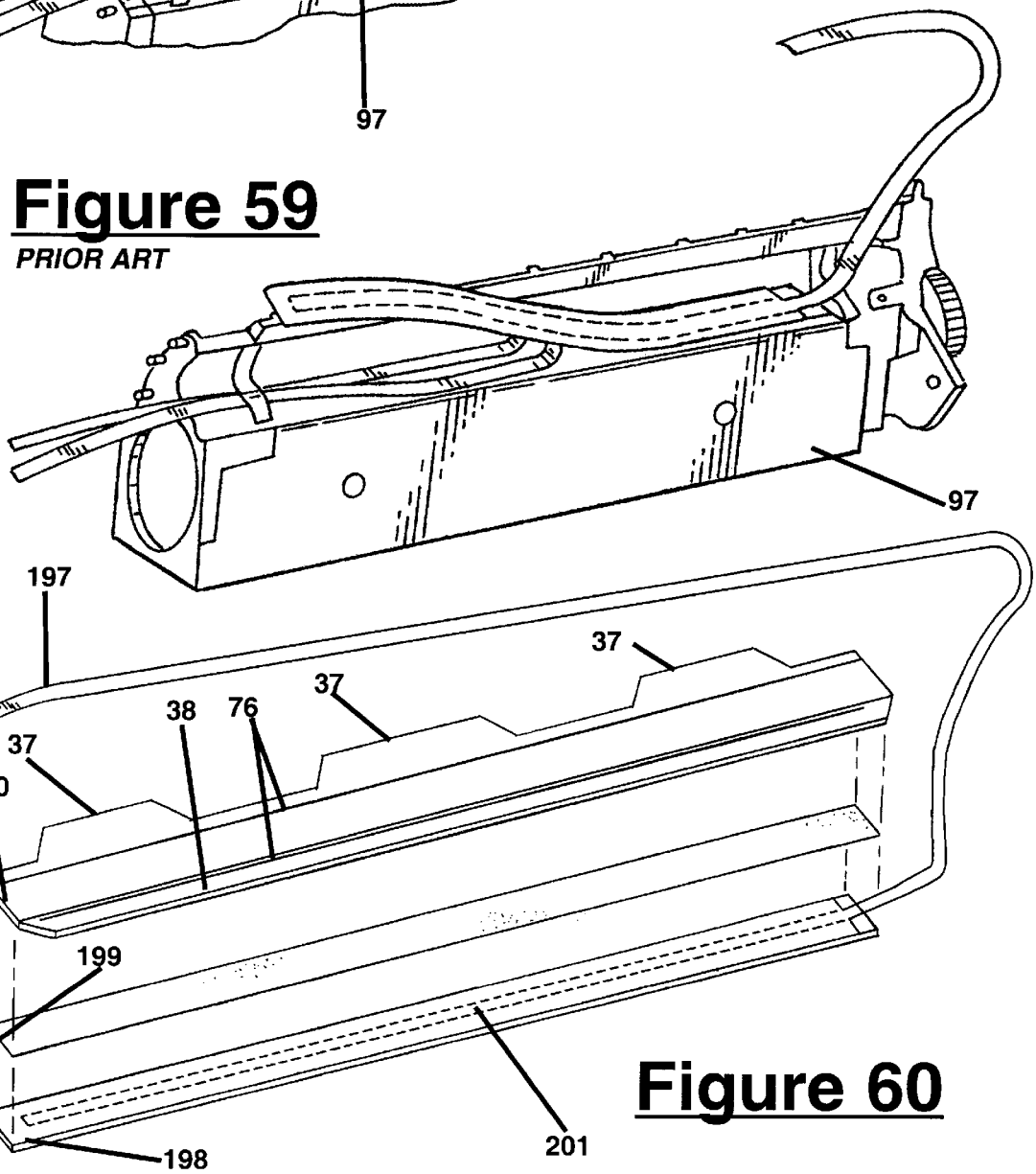
Figure 60

DISPOSABLE STRIP HOLDER INSTALLATION DEVICE AND METHOD USED IN THE IMAGING AND OTHER INDUSTRIES

BACKGROUND OF THE INVENTION

This invention relates to solving problems in imaging machines as well as toner cartridges used in Xerography and more specifically in the toner cartridge remanufacturing industry. This includes copiers, laser printers, facsimile machines, or any other imaging machine. However, this invention may also relate to these copiers, laser printers, facsimile, or other imaging machines as well as the toner cartridges used in these imaging machines. The users of this invention will typically be toner cartridge remanufacturers as well as service technicians.

CANON has designed an all-in-one cartridge as in U.S. Pat. No. 4,975,744, issued Dec. 4, 1990 and assigned to CANON. Several companies have used these cartridges in laser printers, copy machines and facsimile machines, each with the varying printer engines and a different nameplate. Originally, these cartridges were designed to be "disposable". However, after the first all-in-one toner cartridge was introduced, it did not take long before laser cartridge remanufacturers such as myself began remanufacturing cartridges. These "disposable" cartridges were designed to function for only one cartridge cycle without remanufacturing. The remanufacturers had found certain components that needed replacement on a regular basis. In 1990, the first aftermarket photoreceptor drum became available for use in remanufacturing the all-in-one cartridge of the "SX" engine variety, the most popular printer cartridge from around 1987 through 1996. When the long-life photoreceptor drum became available, the entire remanufacturing industry turned around and gained credibility and began a huge growth surge that still continues. In October 1993, HEWLETT-PACKARD, the largest seller of this printer engine using the all-in-one cartridge, entered the cartridge remanufacturing industry with the "Optiva" cartridge, further increasing the size as well as credibility of this relatively new industry. However, this relatively new industry grew from the all-in-one cartridge shortly after its debut. Before the introduction of the long-life drum, sometimes called the "superdrum" or "duradrum", the SX cartridge would last for around three cartridge remanufacturing cycles at best, since the maximum useful life of the OEM drum was three cycles. However, the long-life drums got their names from the fact that they were designed to last for many remanufacturing cycles or recharges as they are sometimes called. Typically, the long life drum can last for ten or more such cycles, unlike the typical OEM (Original Equipment Manufacturer) drum. With the additional developments of drum coatings, originally designed for OEM drums, the long-life drum may last for many additional cycles. Some coatings, in theory, were designed to be dissolved and removed from over the drum surface every 1–3 cycles, so the drum life of the long-life drum almost seems limitless.

However, with photoreceptor drums lasting for many cycles and replacement drums available, other components of the cartridge have a tendency to require greater durability, and longevity. Also, as the success of these cartridges has skyrocketed, the demand is for cartridges with longer cycles, so component improvements are significant. Therefore, avoiding natural problems with prevention means must also be implemented for cartridges of longer life both in longer cycle times and greater number of cycles.

This is true of all the various flexible components that need to be replaced or added to these devices, (toner cartridges, laser printers, copiers and facsimile machines), particularly plastic flexible components as well as flexible elastomeric components. Inventor will receive patent number RE35529 that will be issued on Jun. 10, 1997 that uses a setting or positioning device of this kind to install a shipping seal assembly, so, a concept has been developed by inventor that may be used in other applications. However, inventor has realized that the concept may also be used on elastomeric blades, plastic blades and thin metal blades that go into the machines and toner cartridges. Some of these blades include but are not limited to the recovery blades otherwise known in the art as catcher blades, sweeper blades, keeper blades, keepers, MYLAR blades, recovery blades on the waste hopper, recovery blades in the toner hopper, strips, doctor blades, metering blades, spreader blades, strips, doctor blades, plastic strips, urethane rubber strips, wiper blades, scraper blades, toner scrapers, drum cleaning blades, cleaning blades, urethane blades, and blades. In the remanufacturing industry and in the service technician industry, various strips get kinked, wavy, bowed, warped just from performing the service or remanufacturing. Sometimes the blades need replacement just from age-wear problems. For example, in the typical case for most any toner cartridge, just from vacuuming a waste toner hopper, the recovery blades and cleaning blades may get kinks caused by suction of the vacuum cleaner. As remanufacturers desire speed in the remanufacturing process., vacuuming the hoppers can cause these problems with the desire for greater suction to achieve greater speed. Cost is money. Even without the high suction, these problems can occur. Inventor has U.S. Pat. Nos. 5,237,375, 5,500,128 and 5,479,250 that deal with placing a permanent stiffener on the blades to reinforce them, both wiper blades (drum cleaning blades), spreader blades, and recovery blades as well as conductive coatings that aid in many ways. These conductive coatings may also be used in conjunction with this invention as well as making any of the mentioned blades of conductive plastic and/or rubber.

In the IBM-4019/4029/4039 series of cartridges, there are various plastic blades in the toner hopper that easily kink or otherwise get deformed and need replacement in the remanufacturing process. Consequently, these blades also need replacement. Not replacing these blades fairly regularly means cartridge failure because just the remanufacturing process itself can cause the blades to fail, kink, wave, flip, bend backwards, flare, warp, curl, loosen, stretch, or otherwise deform. There are blades on the toner hopper section that need replacement as well as on the waste toner hopper section.

In most imaging machines and toner cartridges there is a urethane rubber spreader blade that spreads the toner on the developer roller and charges the toner in the process. These blades often need replacement. Inventor also has U.S. Pat. No. 5,546,162 that deals with method, device and kit for addition or replacement of spreader blades that can be improved further with this invention or even replaced with this invention. This invention may be also applied as well to wiper blades otherwise known as drum cleaning blades, to replace the urethane blade on a metal frame or even to the toner cartridge frame in some designs of the future.

Most recovery blades use the pressure-sensitive type self-adhesive type with a release liner and are very thin, made of MYLAR or other thin plastic approximately five thousandths of an inch thick and therefore (generally ranging but not limited to around two to 50 thousandths of an inch thick), are very flimsy and difficult and tedious to install. Some people sell a install tool that must be installed separately for each recovery blade. This device consists basically of a plastic V-strip spring-clamp similar to a cheap plastic temporary removable bookbinder which has a spring pressure and squeezes the strip tight to grip it. To use this tool, the installer squeezes the plastic strip install tool to spread the clamp like opening to open it up. Then he places the recovery blade strip inside the spring-clamp install tool. Then he lets go from squeezing the tool whereby the tool exerts a squeezing pressure on the recovery blade and thereby grips the recovery blade. Then, the bookbinder tool is used as a firm handle to place or position the recovery blade in place and after the recovery blade is installed, the tool is again squeezed to remove it easily from the recovery blade. One disadvantage of this system is that the installer must individually go through the full lengthy procedure of installing and uninstalling the spring-clamp install tool for each individual recovery blade to be installed.

This invention may also be used for installing replacement blades in hoppers and waste hoppers, retaining blades, and also, of course, for paddlestrip blades. Paddlestrip blades are blades usually of plastic or urethane that are attached to a rotating metal frame known as the "paddle" that helps wipe the waste toner off the photoreceptor and then scoop this toner into the waste toner hopper. It can also be called the sweeper blade, scooper blade, the sweeper, the scooper, or the trash collector blade among other names.

With this invention, a flat removably adhered install device comes pre-installed on each individual strip and after each strip is installed, the device is merely peeled or otherwise removed very simply. Device removal after strip installation is simpler than peeling a banana peel because only one strip is peeled, whereas a banana peel requires several strips to be removed. Similarly, this device is easier to remove than having to remove the spring-clamp install tool because firstly, the device is pre-installed on every strip in the manufacturing process and secondly, the strip peels off easily like a banana peel. Also, the throwaway install device can in some manufacturing processes improve the manufacturability of the blade-product, depending on how sophisticated one gets. Read the rest of the patent to find out how this works.

SUMMARY OF THE INVENTION

Accordingly, it is an object of this invention to make an install tool stiffener positioning device manufactured as a component of a recovery blade for easy install that is removably adhered to the recovery blade and after the recovery blade is installed, the install tool stiffener is peeled off of the recovery blade.

It is a further object of this invention to make an install tool stiffener positioning device manufactured as a component of a drum cleaning blade for easy install that is removably adhered to the drum cleaning blade and after the drum cleaning blade is installed, the install tool stiffener is peeled off of the drum cleaning blade.

It is a further object of this invention to make an install tool stiffener positioning device manufactured as a component of a spreader blade for easy install that is removably adhered to the spreader blade and after the spreader blade is installed, the install tool stiffener is peeled off of the spreader blade.

It is a further object of this invention to make an install tool stiffener positioning device manufactured as a component of a doctor blade for easy install that is removably adhered to the doctor blade and after the doctor blade is installed, the install tool stiffener is peeled off of the doctor blade.

It is a further object of this invention to make an install tool stiffener positioning device manufactured as a component of any blade for easy install that is removably adhered to a blade of any type, plastic or elastomeric, and after the blade is installed, the install tool stiffener is peeled off of the blade.

In carrying out this invention in the illustrative embodiment thereof, the flat removably adhered install tool comes installed on the strips and after the strips are installed, the tool is merely peeled or otherwise removed very simply. Tool removal after strip installation is simpler than peeling a banana peel because only one strip is peeled, whereas a banana peel requires several strips to be removed. Also, the install tool can in many manufacturing processes improve the manufacturability of the product, depending on how fancy one goes because it is easier to adhesively coat or laminate and die-cut stiff material than it is to do with flexible material.

BRIEF DESCRIPTION OF THE DRAWINGS

This invention, together with other objects, features, aspects, and advantages thereof, will be more clearly understood from the following description, considered in conjunction with the accompanying drawings.

FIG. 3C shows a shipping seal as used in a toner hopper.

FIG. 3D shows a shipping seal with a stiffener as used in a toner hopper.

FIG. 3E shows an installed shipping seal in a toner hopper.

FIG. 4 shows the mechanics of an imaging machine.

FIG. 5 shows a prior art side view cutaway of a toner hopper.

FIG. 6A shows an isometric view of a prior art recovery blade.

FIG. 6B shows a side view of a prior art recovery blade.

FIG. 6C shows an improved recovery blade in isometric view.

FIG. 8 shows an isometric cutaway view of the technician removing the adhesive protective liner the improved recovery blade assembly.

FIG. 9 shows an isometric view of the technician preparing to install a recovery blade assembly.

FIG. 11B shows a cutaway view of a waste toner hopper with an improved recovery blade assembly partially installed.

FIG. 12 shows an isometric cutaway view of a further step in the installation of the recovery blade assembly, the removal of the disposable stiffener device.

FIG. 13 shows a pickup magnet sheet assembly in isometric view.

FIG. 13A shows a side view cutaway of a section of the pickup magnet sheet assembly.

FIG. 14 is a cutaway isometric view of a waste toner hopper showing the relationship between the pickup magnet and the recovery blade.

FIG. 18 shows a prior art LX spreader blade.

FIG. 19 shows a prior art NX spreader blade.

FIG. 20 shows a prior art converted doctor blade into a spreader blade.

FIG. 21A shows a new and improved assembly jig in isometric view used for installation of a doctor blade into a spreader blade conversion.

FIG. 24 shows a cutaway isometric view of a spreader blade conversion process further along.

FIG. 25 shows an isometric view of the conversion process further yet along.

FIG. 26 shows a cutaway isometric view of a further step in the doctor blade to spreader blade conversion process.

FIG. 27 shows the doctor blade converted into a spreader blade.

FIG. 28A shows another device and process for converting a doctor blade into a spreader blade.

FIG. 29A shows a cutaway isometric of a spreader blade shape for improved adhering to frame.

FIG. 29B shows a cutaway isometric of a spreader blade shape for improved adhering to frame.

FIG. 29C shows a cutaway isometric of a spreader blade shape for improved adhering to frame.

FIG. 30 shows a cutaway isometric of a spreader blade shape for improved adhering to frame.

FIG. 31 shows a cutaway isometric of a spreader blade shape for improved adhering to frame.

FIG. 32 shows a cutaway isometric of a spreader blade shape for improved adhering to frame.

FIG. 39 shows a shipping seal assembly.

FIG. 40 shows a new and improved shipping seal assembly.

FIG. 41 shows a toner hopper with an installed sidewall seal.

FIG. 42 shows an isometric view of an improved sidewall seal assembly over a cutout portion of a toner hopper where the seal is to be installed.

FIG. 43 shows a new and improved sidewall seal with the liner being peeled.

FIG. 44 shows part of the installation process of a prior art sidewall seal into a cutaway isometric of a toner hopper.

FIG. 45 shows part of the installation process of a sidewall seal into an isometric cutaway toner hopper.

FIG. 46 shows an isometric of a further improved sidewall seal.

FIG. 47 shows a side view cutaway of a toner hopper with an installed sidewall seal.

FIG. 51 shows a prior art shipping seal.

FIG. 52 shows an improved version of the prior art shipping seal of FIG. 51.

FIG. 53 shows a prior art seal-insert, top view.

FIG. 54 shows a prior art seal device.

FIG. 55A shows the prior art shipping seal installed on the modular seal-insert.

FIG. 56 shows where the seal-insert fits into the toner hopper.

FIG. 57 shows an isometric view of the partially pulled shipping seal after it is installed into the toner hopper.

FIG. 58 shows a prior art shipping seal and part of the process of installing it into a toner hopper.

FIG. 59 shows a prior art shipping seal and part of the process of installing it into a toner hopper.

FIG. 60 shows an improved device and process for installing the shipping seal of FIGS. 58 and 59.

FIG. 61 shows an improved device and process for installing the shipping seal of.

COMPLETE DESCRIPTION OF THE PREFERRED EMBODIMENT

Figure 1:
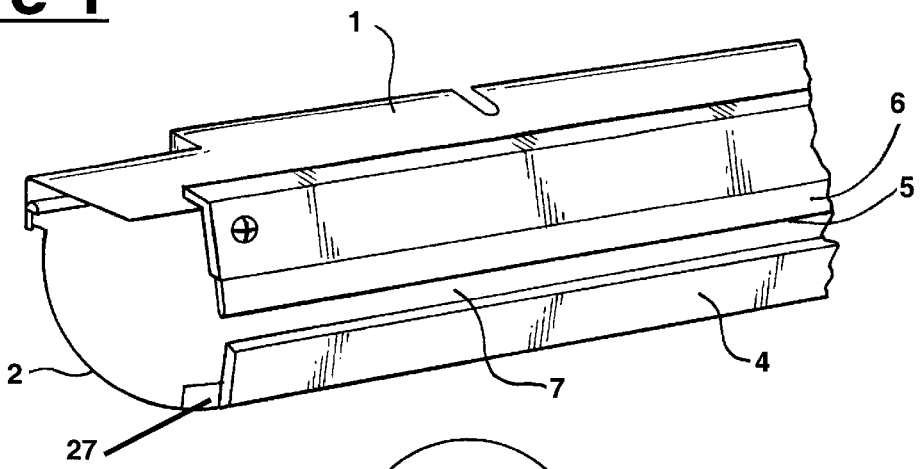
Figure 1 PRIOR ART
FIG. 1 is an isometric cutaway view of a prior art waste toner hopper assembly.

FIG. 1 shows a section 1 of a conventional waste toner hopper 2, a component of a toner cartridge as used in laser printers, copiers, facsimile machines, or any other imaging or Xerographic machine. A waste toner hopper 2 is located adjacent the photoreceptor drum 3 as illustrated broadly in FIG. 2. After transferring the dry toner image from the drum 3 to the output paper during the printing process, the photoreceptor drum 3 continues its rotation. Residual toner on the drum 3 is in contact with the keeper blade 4 or recovery blade 4, forming a perfect seal so toner will not leak out of the waste toner hopper 2, yet allowing the toner to fall into the waste toner hopper 2, "keeping" the toner in the waste toner hopper 2 so it can't escape or "recovering" the waste toner in the waste toner hopper 2. That is why it is called the "keeper blade" 4 or "recovery blade" 4. As the drum 3 continues to rotate, the cutting edge 5 of the wiper blade 6 scrapes the residual toner from the photoreceptor drum 3. The toner falls through the slot 7 into the waste toner hopper 2. The scraped-off residual toner cannot leak or penetrate into the rest of the cartridge assembly because of the seal-contact maintained between the cutting edge 5 of the wiper blade 6 and the photoreceptor drum 3. Also, toner, in theory, cannot leak from the waste toner hopper 2 to the remainder of the cartridge assembly because of the existence of the seal provided by the keeper blade 4 against the drum 3.

Some waste toner hoppers 2 are designed so the keeper blade 4 is very tightly pressing against the photoreceptor drum 3. The keeper blade 4 may be tightly pressing against the drum 3 that as the drum 3 rotates, the keeper blade 4 may inadvertently scrape residual toner off the drum 3 before it is scraped off by the cutting edge 5 of the wiper blade 6 to fall into the waste toner hopper 2. Residual toner prematurely scraped off the drum 3 can leak into the remainder of the toner cartridge assembly and printer, making a mess of other components and affecting the quality of the print on the output paper. Having the keeper blade 4 too tight to the drum 3 may also cause excess friction or heat, in turn causing premature wear or warpage or other deformation of the keeper blade 4 or wear down the drum 3.

Figure 2:
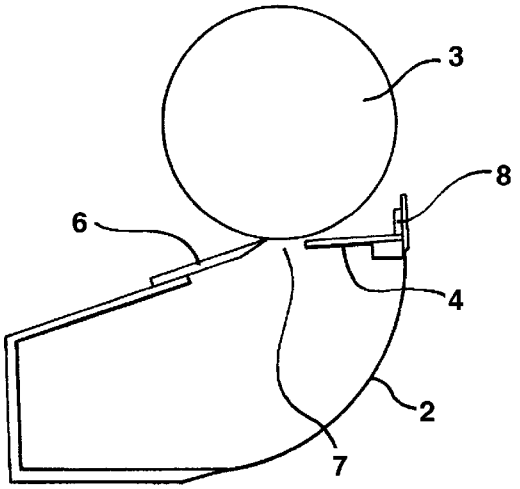
Figure 2 PRIOR ART
FIG. 2 is a side view of a prior art waste hopper and photoreceptor in theory.

A narrow strip of magnet, the pickup magnet 8 of FIGS. 2 and 14, about one thirty-second of an inch in width in the typical case (although it can greatly vary in different style waste toner hoppers 2), used in some waste toner hoppers 2 attracts some toner when the toner cartridge assembly is pulled out of the imaging machine and moved around and also picks up airborne toner that mixes in the air. Note that FIG. 2 shows that the keeper blade 4 touches a thin surface of a pickup magnet 8, and the pickup magnet 8 also may be used to help secure the keeper blade 4 to the attach surface 27 of the waste toner hopper 2 i.e. preventing delamination of the keeper blade 4 in which the photoreceptor 3 is continually exerting a force upon the keeper blade 4, in a direction whereby if adhesive is not strong enough, it would cause delaminating or peeling off of the keeper blade 4, the keeper blade 4 itself acting as a lever, is helped to prevent from levering off because of the existence and position of the pickup magnet 8. Attempting to vacuum the waste toner hopper 2 and keeper blade 4 can kink or otherwise deform or delaminate the keeper blade 4 causing a leak and/or streak at the enduser's location. Furthermore, the very installation process of the keeper blade 4 can cause a kink and cause a leak or streak at the user's location. With a better device and process of installation of the keeper blades 4 as will be shown in this invention, this problem will be decreased if not totally eliminated. Furthermore, with the improved device of this invention, the manufacturing process of any style blades 4 themselves can be manufactured easier because a removably adhered installation stiffener positioning device is removably adhered to the keeper blade 4. By giving the keeper blade 4 stiffness, it is easier from a point of view of material handling in the manufacturing process. This includes cutting, slitting, diecutting, flat diecutting, rotary diecutting, flat-rotary die cutting, stamping, or other operation, particularly of the continuous feed variety. Some urethane and plastic keeper blades are so thin that they are very difficult to manufacture without the process and device of this invention because thin urethane can stretch, fold, crease, pinch, wrinkle, tear or otherwise deform.

Figure 3A:
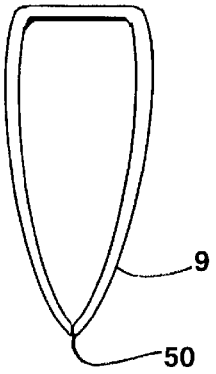
Figure 3A PRIOR ART
FIG. 3A shows a side view of a prior art spring clip from the bookbinding industry.
Figure 3B:
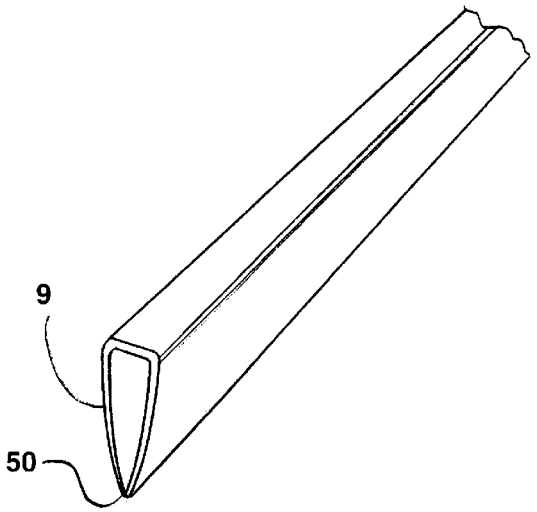
Figure 3B PRIOR ART
FIG. 3B shows an isometric view of a prior art bookbinding clip.

FIG. 3A shows a side view of a plastic bookbinder spring-clip 9 used in prior art to hold the keeper blade 4 when it is being installed. FIG. 3B shows an isometric cutaway view of the same prior art spring-clip 9. This spring clip 9 comes from the bookbinder industry and is used in many a school project to hold together reports and other school projects. The spring force of this spring-clip 9 holds the keeper blade 4 for use in the installation process. The problem with the bookbinder spring-clip 9 is that it requires two extra steps in the installation process. First it requires that the keeper blade 4 is placed or installed into the bookbinder clip 9 which is very tedious. Then, the keeper blade 4 is installed into the waste toner hopper 2. Then, the spring-clip 9 is released from the keeper blade 4 and the waste toner hopper 2. The bookbinder spring-clip 9 has been used for quite some time, and after this invention is released, there will be a reduced need if any of the bookbinder type clip 9 for installing keeper blades or other blades. The spring-clip 9 has an opening 50 where the recovery blade 4 is inserted which exerts a spring pressure to hold the recovery blade 4 in the spring-clip 9 prior to installation. Even though the bookbinder clip 9 could become obsolete from this invention, some people may want to use the clip 9 with this invention. Pony clamp adaptations of the spring clip 9 have been around too in order to facilitate spreading open the clamp for installation of the recovery blade 4.

FIG. 3C is prior art in this patent application because it was co-invented in the parent patent of this continuation-in-part. FIG. 3C–3D shows a shipping seal assembly 109 which is patent pending by inventor, the parent Ser. No. 08/370,968 of this continuation-in-part. The tear guide 89 provides a pull device for the enduser to pull from the user's location to release the dry toner powder after the tear guide 89 tears the tear material 93. It starts at the slits 91 and completes the tear at the slits 91 where the tail 90 remains. FIG. 3D shows a seal assembly 110 from parent Ser. No. 08/370,968 that consists of the same shipping seal assembly 109 but also containing a positioning stiffener 94 for easier installation of the shipping seal assembly 110. The edge remove handle 95 and end remove handles are subcomponents of the positioning stiffener 94 for the purpose of making it easier to remove the positioning stiffener 94 after the shipping seal assembly 110 is installed. FIG. 3E shows a prior art from the CIP parent patent toner hopper 97 with an installed shipping seal assembly 10 covering the opening in toner hopper 99, shown after the positioning stiffener 94 was removed. Also shown in FIG. 3E is the tear-guide 89 pulled partially which has caused the opening in the seal torn area 98 so that toner powder, previously trapped inside the toner hopper 97, may now fall through the opening 99.

FIG. 4 shows the typical imaging system which includes, in theory not only the inner workings of the toner cartridge assembly, but also what goes on in the imaging or Xerographic device as well. Typically, most of the moving parts that can wear or need replacement are kept in the disposable toner cartridge which can be recycled, thus rather than requiring a service technician's round-the-clock availability, a simple replacement of a new toner cartridge replaces the need for a service technician. However, a remanufactured cartridge made from the toner cartridge that was designed to be thrown away may replace the new toner cartridge. Thus, the toner cartridge remanufacturer, rather than a brand new toner cartridge replaces the need for the round-the-clock service of the imaging device. This way, the servicing is done off-site.

Everything is centered around the photoreceptor 3, which in this diagram is a drum or cylinder. Some photoreceptors are of the belt style and this invention applies to these imaging machines with belt photoreceptors as well, even though it is not shown in the figures. The photoreceptor 3 is initially charged by the primary charge roller or PCR 43. This PCR 43 rotates and supplies a voltage charge to the photoreceptor 3 and in so doing also charges over any residual image charge that may be left over on the photoreceptor 3 from a previous image, and thus, an erase lamp is not required. After the PCR 43 charges the photoreceptor 3, the laser beam scanner assembly 49 hits the drum 3 with an image in the form of pixel dots. Wherever the laser light shines on the photoreceptor 3, discharge of the charge provided by the PCR 43 takes place, forming an image on the photoreceptor 3, of what will be printed or copied. Wherever the light discharges will print black on the output page and wherever the charge is not hit with laser light becomes white. In some machines, the opposite takes place, but the theory would then be the same in reverse with light hitting where there is no image but I will continue only with discussion where light makes black image on the output page. As the photoreceptor 3 continues to rotate, it next comes almost in contact with the developer roller 44 with a very precise space between them which supplies toner to the photoreceptor 3 in the form of the image. Toner jumps back and forth between the developer roller 44 and the photoreceptor 3 many times per second forming a "toner cloud" and the photoreceptor 3 takes what toner it needs and then the developer roller 44 takes back what the photoreceptor 3 cannot use. This process continues in "continuous flow" mode and the toner supply is replenished to the developer roller 44 from the toner hopper (not shown). In early versions of imaging machines, the toner on the developer roller 44 was metered with a doctor blade (not shown) that scrapes toner and leaves the desired thickness of toner remaining on the developer roller 44 as this toner comes near the photoreceptor 3. Using this technology proved inefficient because, a lot of waste toner or background clung to the surface of the photoreceptor 3 and either wound up as gray background or got scraped off the photoreceptor later in the process to get trashed into the waste toner hopper 2. However, eventually the industry standard changed from doctoring or metering blades to the spreader blade 45, a urethane blade on a frame usually made of metal. The advantage of the spreader blade 45 is that the toner when using the spreader blade 45, as it gets spread, also gets "rubbed" and thereby gets charged. The pressure between the spreader blade 45 and developer roller 44 is very important and also affects darkness of print, toner efficiency and quality. For example, in real life, this would be analogous to taking a balloon, rubbing the balloon on a wool sweater, then placing the balloon on a wall or ceiling surface. In the case of the balloon, the electrostatic charge of attraction between the balloon and the wall or ceiling exceeds the gravitational force on the balloon and, the balloon is suspended on the wall or ceiling. To carry this balloon analogy to imaging and the spreader blade 45, the spreader blade 45 nibs the toner against the developer roller 44, and thereby charges the toner, and is said to increase the triboelectric charge of the toner. Charged toner behaves better than uncharged toner in the imaging process. This is, among other reasons, because the AC component of the bias voltage on the developer roller 44 attracts the toner from the photoreceptor 3 and alternates between attraction and repulsion many cycles per second. When the developer roller 44 repels the toner as it alternates its bias charge polarity, the photoreceptor 3 takes whatever toner it needs. As soon as the developer roller 44 attracts toner again, the charged toner is attracted back to the developer roller 44. The translation of this theory into real life is that the charged toner behaves as if it is lighter like the balloon. The charged toner is more controlled by the rapidly alternating attractions and repulsions of the developer roller 44 and by the charge an attraction of the photoreceptor 3 than by gravity. Thus, the toner, defying gravity, instead is controlled by electrostatic forces greater than gravity, is less likely to become waste toner that winds up in the waste toner hopper 2. The result of charging toner is that the drum 3 does not keep as much undesirable background toner which would have become background on the output page or waste toner in the waste toner hopper 2. Thus the darkness of the print on the output page is increased while at the same time the toner efficiency is also increased. This seems contradictory for both the toner efficiency and the darkness of the output page each to increase, however, if you think about the theory, it makes sense. Greater detail of this theory has been presented by the inventor in U.S. Pat. No. 5,546,162.

As the photoreceptor 3 continues to rotate, after it has passed the developer roller 44, the page-image is now visible on the photoreceptor 3. If one were to turn off the laser printer or copier in the middle of a job, at this position of the photoreceptor, you would see black toner powder on the photoreceptor 3, identical to the image that is to be printed on the page. Furthermore, although I do not recommend doing so, you can wipe this toner off the photoreceptor 3 as it, by attraction, clings to the photoreceptor 3 by attraction of charge where there is image and repulsion where there is no image, similar to the way a charged balloon on the wall is suspended on the wall where the charge of attraction of the balloon lo the wall exceeds the gravitational force pulling the balloon toward the earth as discussed. The attraction of all toner particles to the photoreceptor 3 is greater than the gravitational force trying to pull the toner to the ground. So, although the laser light discharges the photoreceptor 3 charge, there is a charge remaining in these "discharged" pixels that is compatible with attracting the toner to the photoreceptor 3. Note that the dashed lines on the spreader blade 45 are a conductive coating 116 as shown in inventor's Pat. No. 5,400,128 which is an option. Also, optionally, the material such as urethane may be loaded or heavily loaded with conductive material. One typical way to load a blade with conductive material is to use conductive carbon black.

As the photoreceptor 3 continues to rotate even further, it passes simultaneously by the output paper and the transfer charge roller assembly 46. The transfer charge roller assembly 46 charges right through the output page and attracts the toner, imaged on the photoreceptor, which then sticks by attractive charge to the output page. It is because of the fact that the charge placed on and through the paper is the force that attracts the toner, that thick paper and envelopes sometimes have problems. There is a limit on how thick the output paper can be and still receive a quality charge throughout from top to bottom. Similarly, at this point in the process, the toner is attracted to the paper like the balloon stuck to the surface of the wall. Again, if one was to turn off the laser printer or copier in the middle of a job, if you look at the output paper in the region just after the paper went through the transfer charge roller assembly 46, the printed image is on the page in dry powdered toner that can be wiped off the page, in the form of the messy black (or other color of the toner) that can get all over your clothes. The output page then goes through the fuser roller assembly (not shown in diagram), a heat and pressure roller assembly that actually melts or fuses the toner to the output page and literally "glues" the toner to the page in the form of the desired image. This glue is the toner itself when it attains a temperature greater than the melting point of the toner. Toner contains mostly styrene and, thus, behaves similar to a hot melt glue.

As the photoreceptor 3 continues to rotate, there is residual toner that never left the photoreceptor 3 due to inefficiency when it transferred to the paper from the charge of the transfer charge roller assembly. Some of this residual toner is in the form of the page-image, a faint ghost of the previous image and the rest of the residual toner still on the photoreceptor 3 is mostly background. In the older toner cartridges such as the SX and CX, a doctor blade was used instead of a spreader blade, and thus, there was a large amount of background toner on the photoreceptor 3 that got scraped into the waste toner hopper 2. Some of this toner, because it was so much toner all the time, wound up getting past the scraping wiper blade 6 that the charging corona assembly and wire attracted this toner when charging, and wound up on the wire, eventually insulating the wire, causing a streak known as the right side streak, or RSS, a messy streak or vertical band on the right side of the output page. For this reason, blade embodiments involving spreader blades 45 are very important, especially for converting the SX doctor blade 52 into a spreader blade 45. This residual toner is then scraped off the drum using the cutting edge 5 of the wiper blade 6 and toner is then sealed in the waste toner hopper 2 with the recovery blade 4 (shown in FIGS. 1 and 2). Note that in FIG. 4, this wiper blade 6 is optionally coated with a conductive coating 117 as in inventor's U.S. Pat. No. 5,400,128, or may be loaded with a conductive material, any conductive material, including conductive carbon black, for improved performance.

Then as the photoreceptor 3 continues to rotate, it goes back to the PCR 43 where charging is done and the cycle repeats itself. It should be pointed out that when the PCR 43 charges the photoreceptor 3, it is not only charging the photoreceptor 3, but is also charging over an electrostatic ghost charge of the previous image. Sometimes when the humidity is low in northern climates when the heat is turned on and the air can be very dry, this electrostatic ghost of the previous image is not completely charged over, and a portion of the previous image is faintly printed on the output page. This phenomenon is called ghosting.

FIG. 5 shows a toner hopper assembly 47. On this assembly, one can see in greater detail the developer roller 44, the spreader blade 45, and the frame 48 that holds the spreader blade 45. Also on the toner hopper assembly 47 is the reservoir 51 which is literally the tank that holds the fresh toner to provide a continuous supply of toner to the developer roller 44. Typically the spreader blade 45 is urethane rubber and one can clearly see how this spreader blade 45 rubs the toner for the purpose of charging the toner. Inventor owns U.S. Pat. No. 5,546,162 used to replace worn spreader blades 45 and to put spreader blades 45 on metal doctor blades or other metal blades in a conversion process. In the above patent, that invention can be improved with the installation device of at least 3 embodiments of this invention for easier installation and will be shown.

Each blade in the toner cartridge and imaging machine is important. How a blade functions depends on how many cycles of usage the blade has had. For example, recovery blades 4 can kink either from vacuuming toner from the waste toner hopper 2, from wear, from aging, cycling, or even from the process of installation of a new blade. Typically, in the toner remanufacturing industry and in the service technician industry, these blades are replaced on a regular scheduled basis. Some remanufacturers replace these recovery blades 4 every time they remanufacture the toner cartridge just to be safe. Many remanufacturers replace these blades to keep a certain ISO 9000 or other such quality control status. The same is true of spreader blades 45 and wiper blades 6. Wiper blades 6 are always rubbing against the photoreceptor 3 and scraping it. This is a wearing situation. Sometimes a paper impurity or other particle lodges between the cutting edge 5 of the wiper blade 6 and the photoreceptor 3 and eventually scratches the cutting edge 5 of the wiper blade 6. Sometimes the wiper blade 6 can be under-lubricated or over-lubricated. Sometimes the heat of friction from not properly lubricating the wiper blade 6 can cause wear. Wiper blades 6 have a sharp "cutting edge" 5 that contacts the photoreceptor 3 and literally scrapes off the waste toner. From wear, this sharp cutting edge 5 eventually becomes a rounded edge. A rounded edge is not going to scrape toner from the photoreceptor 3 and will cause failure in the form of smudges, smears, leaks and streaks. Another problem of wiper blades 6 is that they can tend to "bend backwards" or "flip" from friction causing heat cycling which causes material weakness in time. These various wiper blade defects are described in greater detail in inventor's U.S. Pat. No. 5,308,515 for a "METHUSELAH" brand drum padding powder which is intended for use on photoreceptors 3, wiper blades 6, spreader blades 45, recovery blades 4 and any other blade involved in the imaging process. Spreader blades 45 tend to wear from repeated use. Because a spreader blade 45 is continually rubbing the toner and generating friction which generates heat, they can sometimes wear quicker than desired.

So, replacement of all blades in the imaging process which includes all imaging machines is critical in obtaining perfection in the imaging industry whether it be remanufacturing toner cartridges or servicing an imaging machine. For service technicians, the CPC (cost per copy) or CPP (cost per page) is critical when obtaining and keeping service contracts. Thus, this invention can be used to keep up the good quality and reduce the CPC and maintain ISO 9000 type standards. If you look at the bend of the spreader blade in FIGS. 4 and 5, you can see a spring force exerted onto the spreader blade 45 by on the photoreceptor 3.

FIGS. 6A and 6B shows a prior art recovery blade 4. This recovery blade 4 has a top surface 13 and a bottom surface 10. It has tape or adhesive 11 and a release liner 12 that is peeled away to expose the pressure-sensitive adhesive. FIG.

6C shows the first embodiment of this invention, a recovery blade 120 with an extra portion of adhesive liner 118 that sticks out at the easypull tab 119 for ease of removal of the release liner 118. This portion of release liner 118 that protrudes has no adhesive on it. This easypull recovery blade 120 has a bottom surface 121.

Figure 7A:
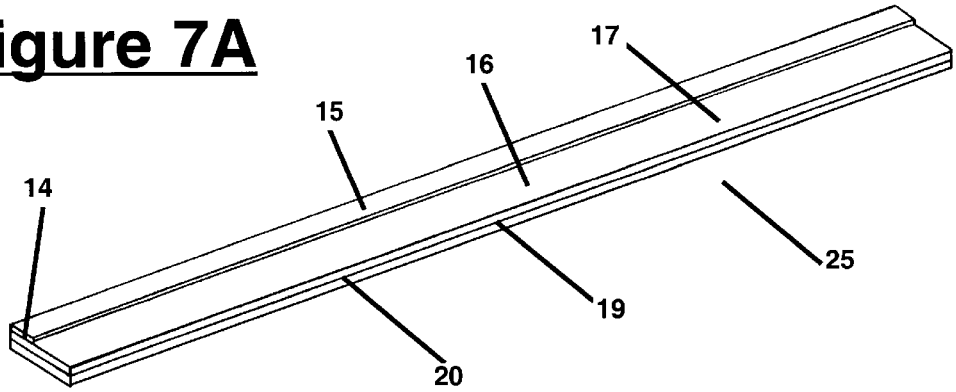
FIG. 7A shows an improved recovery blade assembly in isometric view.
Figure 7B:
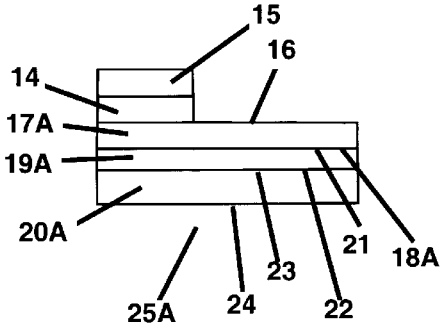
FIG. 7B shows a side view of an improved recovery blade assembly.
Figure 7C:
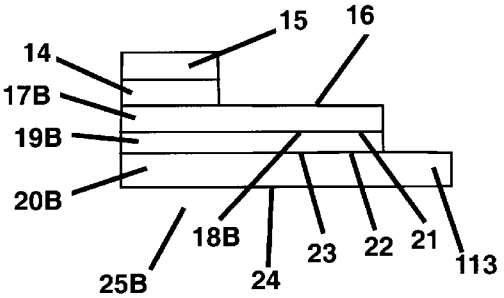
FIG. 7C shows a further improved recovery blade assembly.
Figure 7D:
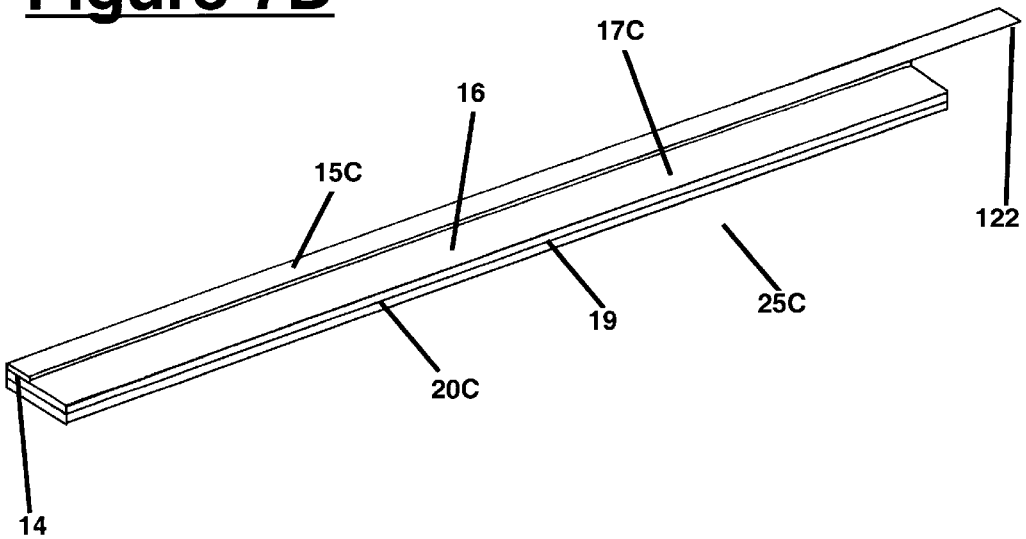
FIG. 7D shows an even further improved recovery blade assembly.

FIGS. 7A through 7D show another embodiment of this invention, the recovery blade assembly 25, 25A, 25B and 25C. These recovery blade assemblies 25A and 25B have a recovery blade 17A and 17B with a top surface 18A and 18B and a bottom surface 16. They have a pressure-sensitive adhesive/tape 14 with a peelably removable release liner 15. These recovery blade assemblies 25A and 25B also have a stiffener or positioning device 20A and 20B that is removably adhered with adhesive or tape 19. The positioning device or stiffener 20A, 20B and 20C is used to hold the blade rigid so it will not wrinkle, will not adhere where not desired, will adhere where desired and so that the blade will be kept rigid, to set the installation position, to prevent pinching of the blade 25A to 25C, to make the blade easier to grab so an installation tool is not required, to support the blade 25A to 25C, to brace the blade 25A to 25C, to reinforce the blade, to maintain blade width, to act as a blade stabilizer, to act as a blade splint, a support means, installation device, positioning device, and a device to join the blade to its waste toner hopper 2. These positioning device stiffeners 20A and 20B have bottom surface 23 and a top surface 24. The adhesive/tape 19 of the stiffener 20A and 20B has a top surface 22 and a bottom surface 21. The top surface 22 of the adhesive/tape 19 is in surface to surface contact with the bottom surface 23 of the stiffener 20A and 20B with the intention of permanent adhesion. The bottom surface 21 of the adhesive/tape 19A and 19B joins the recovery blade 17A and 17B at its top surface 18A and 18B whereby this surface to surface adhesion is intended to be removable. There exist tapes and adhesives that are permanent-removable whereby one surface is to be permanently adhered and the other surface of the adhesive is intended to be removable. One good example of such an adhesive that is seen commonly in everyday life is the POST-IT note whereby the adhesive is permanently adhered to the POST-IT note and removably adhered to whatever the enduser posts it to. This is similar to a type of adhesive 19 that is preferred for adhering the stiffener positioning device 20A through 20C to the recovery blade 17A, 17B and 17, respectively, whereby the adhesive sticks permanently to the bottom surface 23 of the disposable stiffener 20A, 20B or 20C and removably adhered to the top surface 18A and 18B of the recovery blade 17, 17A, 17B, or 17C of this first embodiment. FIG. 7B and 7C differ in that FIG. 7B has a disposable stiffener 20A that is the same width as the recovery blade 25A while FIG. 7C has a disposable stiffener 20B that is wider than the recovery blade 25B for more userfriendly use in certain applications. The disposable stiffener 20B that sticks out and is easier to install and does not require a knife or similar tool to separate the stiffener 25A and the adhesive 19A from the recovery blade 17A. To be even more userfriendly, FIG. 7D shows a recovery blade assembly 25C where the adhesive protective release liner 15C has a protrusion with no adhesive for easier removal of the adhesive/2-sided-tape/glue line 15C.

Figure 10:
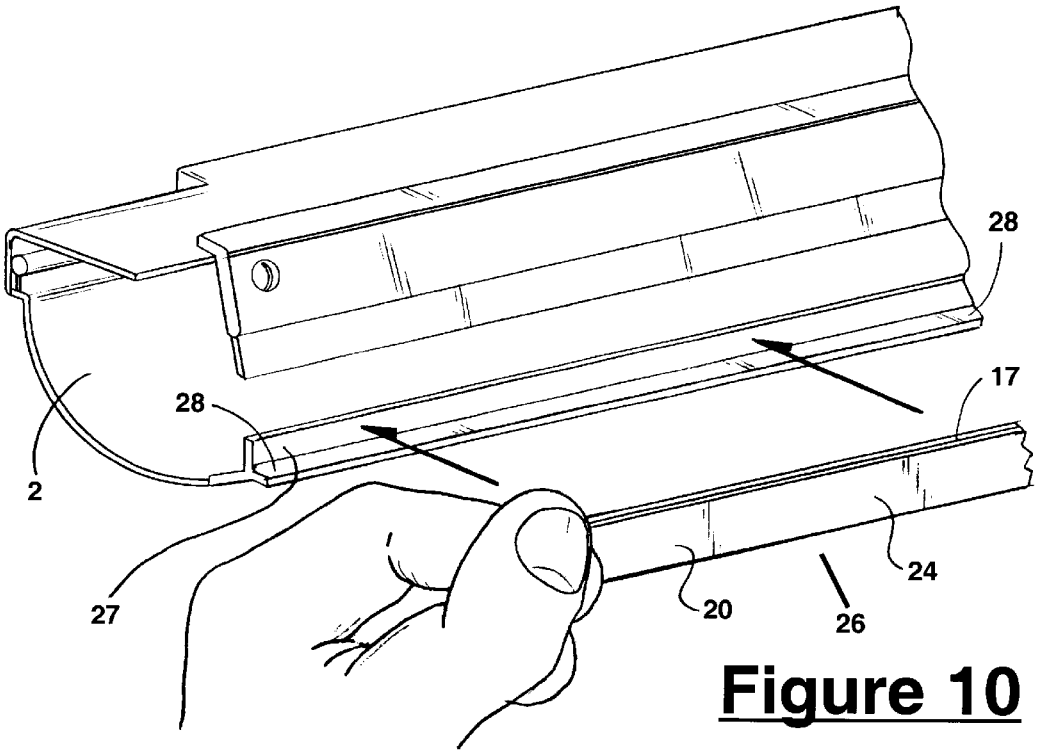
FIG. 10 shows an isometric cutaway view of the technician furthering the procedure of installing the recovery blade assembly onto a waste toner hopper.
Figure 11A:
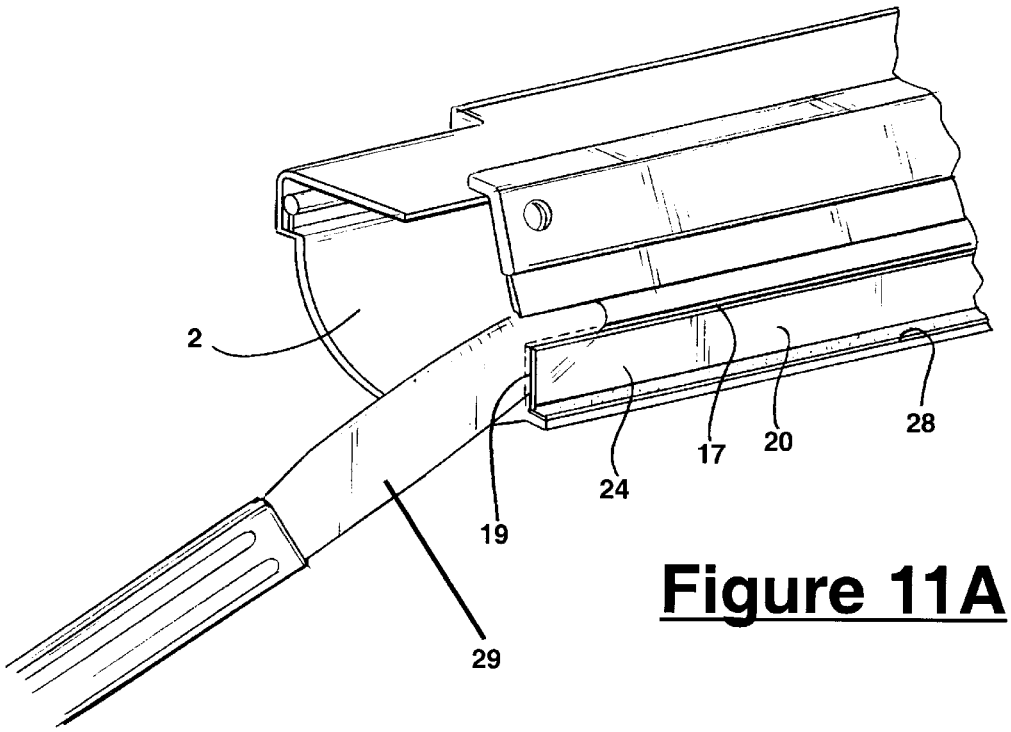
FIG. 11A shows an isometric cutaway view of the removal of the stiffener positioning tool from a waste toner hopper.

This embodiment of the recovery blade assembly 25 is very easy to install. First peel away the release liner 15 thus exposing the pressure sensitive adhesive 14 that is joining the bottom surface 16 of the recovery blade 17 as in FIG. 8. Once the release liner 15 is removed, the remainder of the assembly 25 is shown as 26 in FIG. 9. After peeling off the release liner 15 as in the FIG. 8, then hold the recovery blade assembly 26 with two hands as in FIG. 9. Then place the recovery blade assembly 26 on the waste toner hopper attach surface 27 on the waste toner hopper 2 as shown in FIG. 10. The bottom surface 21 of the adhesive/tape 14 is to attach to join to the attach surface 27 of the waste toner hopper 2. Then this recovery blade assembly 26 is to be pressed on the waste toner hopper 2 and is, to be rubbed, pressed on or burnished. A burnishing tool may be optionally used. I usually just use my fingertips, but for full scale production, a burnishing tool is preferred, a small flat tool with a handle, where the pressure width matches that of the adhesive width on the stiffener 20 or the recovery blade 17. In FIG. 11A, the recovery blade assembly 26, already is installed and pressed on and then the positioning device stiffener 20 and the permanent-removable tape/adhesive 19 are started in separation/delamination from the recovery blade 17 using a sharp edge such as a blade, knife blade, razor blade, fingernail, thumbnail, piece of metal or other edge. Of course at a greater manufacturing cost this assembly 25 could have been made with stiffener edges that protrude for easy peeling such as that of FIG. 7C. FIG. 11B shows an easypull recovery blade 17D whereby the removable disposable stiffener 20D has an easypull protrusion 123 for easy ergonomic removal of the disposable stiffener 20D. FIG. 12 shows the removably adhered stiffener 20 being peeled away like a banana peel exposing the top surface 18 of the fully installed recovery blade 17D.

Please note the difference between the recovery blade assembly 25A and 25B. Recovery blade assembly 25A is easier to manufacture because the stiffener 20A is identical in width to the 2-sided-tape/adhesive/glue 19A and can be slit in one easy step simultaneously. The stiffener 20B of assembly 25B, on the other hand, is wider than the 2-sided-tape/adhesive/glue 19B and thus can not be slit in one easy simultaneous step, requires another step and is therefore more expensive to manufacture. However, the recovery blade assembly 25B has a major advantage over the recovery blade assembly 25A. Now, and this is an important feature of this embodiment that because the recovery blade assembly 25B has a wider stiffener 20B which protrudes beyond the 2-sided-tape/adhesive/glue and beyond the recovery blade 17B, it forms an easygrab protrusion 113. Thus, when the installer removes the stiffener 20B and tape 2-sided-tape/adhesive/glue 19B from the recovery blade assembly 25B, the preferable pull layer 113 sticks out for easy grabbing for easy removal. As stated, the 2-sided-tape/adhesive/glue 19 prefers to stick permanently to the stiffener 20B and prefers to delaminate from the recovery blade 17B after a pulling force is exerted upon the stiffener 20B for easy delamination removal of the disposable stiffener 20B. The disposable stiffener 20A is removed similarly, but there is not an easygrab protrusion 113 and thus the recovery blade assembly 25A requires a knife as in FIG. 11A and, is not as userfriendly as the recovery blade assembly 25B, but costs less to manufacture.

Please note that in the embodiment of the recovery blade assembly of 25B, although the geometry of the easy grab protrusion 113 sticks out on one particular side, there is no limit to the possibilities of this easy grab protrusion 113. Another easy grab protrusion 123 can stick out of one side as shown in FIG. 11B, the other side(not shown), both sides(not shown), more to one side than the other side, or any physically possible configuration or combination.

The keeper blade 4 is made of either a thin, stiff plastic or a thin resilient rubber material from three to twenty thousandths of an inch thick. The plastic may be acetate, MYLAR, polycarbonate, polyester, PETG, vinyl, or other stiff plastic. The rubber material may be urethane rubber, neoprene rubber, or other variety of either a rubber or other elastomeric material. Note that there can be any number of no-adhesive/no-tape regions and/or grab protrusions anywhere on the stiffeners 20A and 20B. The possibilities are limitless and this is an important part of this invention. Note that inventor owns U.S. Pat No. 5,479,250 where the keeper blade 4 is conductive. According to that patent, the keeper blade may either be made of conductive material or otherwise coated with a conductive coating.

Figure 11C:
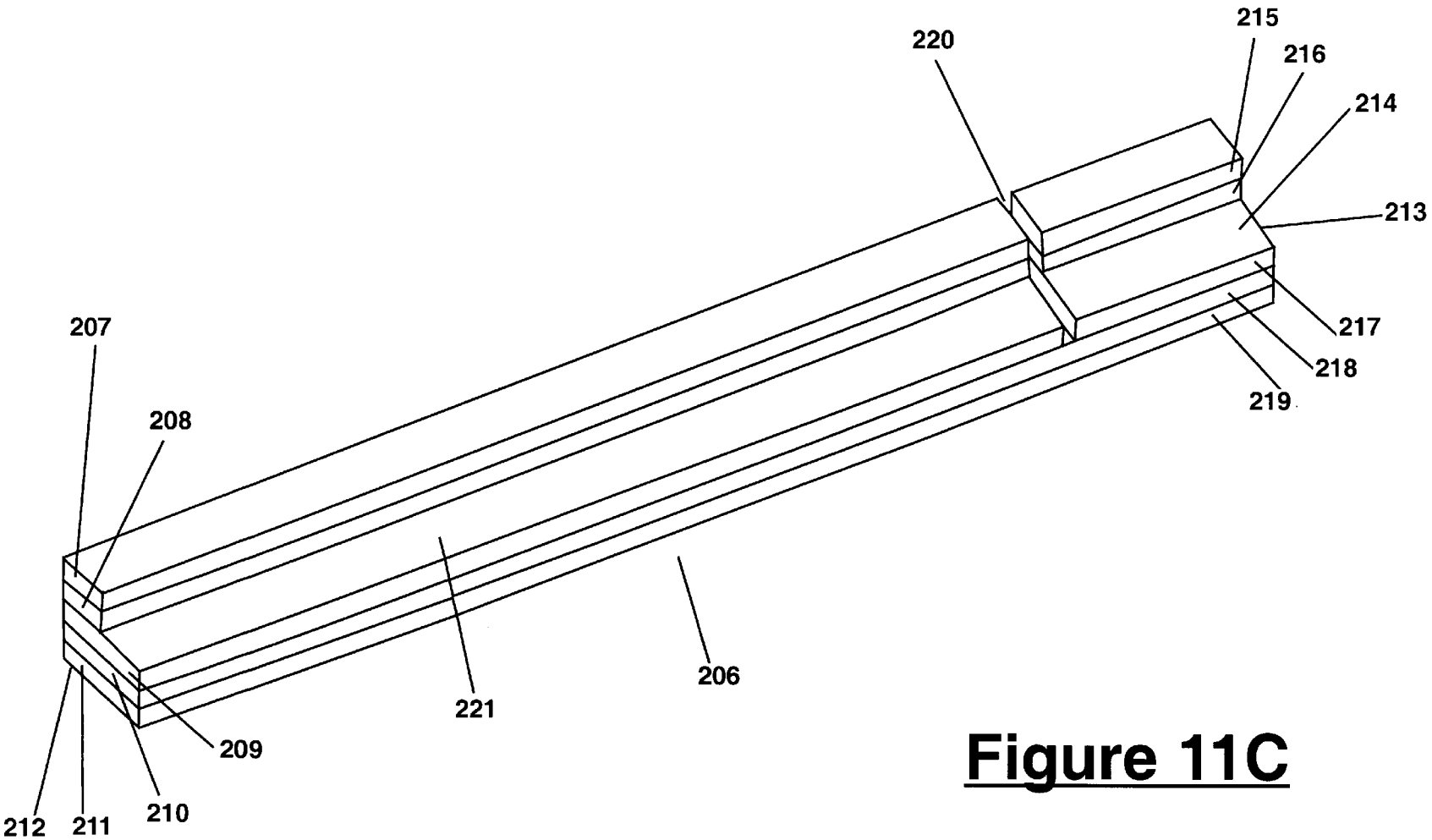
FIG. 11C shows an isometric view of an ergonomic recovery blade with a userfriendly handle

FIG. 11C is an embodiment of a recovery blade assembly 206 that is one of the best embodiments of this patent application. This important improvement is not only very userfriendly, but is also preferred because it is easy to manufacture in mass production. This ergonomic recovery blade assembly 206 has a left side 212 and a right side 213. This recovery blade assembly 206 has many layers consisting of an adhesive release liner 207, a pressure-sensitive adhesive/2-sided tape/glue 208, the recovery blade 209, an adhesive/2-sided-tape/glue 210 that is intended to stick permanently to the stiffener/support 211 and removably adhered to the recovery blade 209, and a removably adhered support, stiffener, positioning device 211, which may be removably adhered with its glue 210 from the recovery blade 209. An interesting point about this recovery blade assembly 206 is that it is easy to manufacture and very ergonomically easy to install both at the same time. The base materials can be normally laminated adhesive 208, liner 207, recovery blade 209, preferential adhesive 210 and the stiffener/support 211. This lamination and slitting can be performed very simply with substeps. The first step would involve lamination of the stiffener/support 211 to the preferential adhesive/2-sided-tape 210 to the recovery blade 209 material. These materials can be triple laminated in wider than the used width for example 10 inch rolls, with the tape 210 in the middle and the stiffener 211 materials on one surface and the recovery blade 209 material on the other surface. Then in the second step, this material can be simply slit to the correct width. Then in the third step, the adhesive/2-sided-tape 208 with liner 207 can be laminated on to the result from step two, each in proper width. This resultant material may be stored in rolls or may be stored in cartons ready to be cut. In the cutting step, two operations are performed. The length cut is made where the left end 212 of one assembly 206 joins the right end 213 of an adjacent piece to cut to precise length. Also, in the cutting operation, a kiss-cut or double-kisscut 220 or other multiple kiss-cuts through the tape 208, liner 207, and recovery blade 209 at location 220 as seen in FIG. 11C. Optionally, a fold or crease can be made at location 220 to bend the recovery blade assembly 206 for userfriendly use after or before the kiss-cut at location 220. This forms a handle 214 on the recovery blade assembly 206 where the handle is the region located between the kiss-cut 220 and the right side 213 which may have a crease or fold or the user may fold it before assembly. This handle can be bent or folded on the kiss-cut 220 to form an easygrip handle that is not only easy to use, but after installation of the recovery blade assembly 206, the installer simply pulls the recovery blade handle 214 and peel off the entire stiffener/support 211 and preferential tape 210 by simply grabbing and pulling the handle 214 and peeling the stiffener 211 and preferential tape 210 like peeling a banana peel. This device totally obsoletes the recovery blade holder tools 9, for example, and eliminates the extra steps involved in using the tool 9. When peeling off the 2 layers 210 and 211, the recovery blade 209 stays attached to the waste toner hopper 2 while the two layers are removed. As the handle 214 is pulled to remove the 2 layers 210 and 211, from the recovery blade assembly 206, the handle 214 stays attached to the disposable remains of the recovery blade assembly 206, in all its layers 215, 216, 217, 218 and 219. This is not only the recovery blade of the future, but is also the blade of the future, because it is so easy to make any blade this way, from a manufacturing point of view. It would have made sense to use the versions of FIG. 7B or 7C, however, the embodiment of FIG. 11C is not only easier to use, but it is also easier to manufacture in mass production. The fold or crease at 220 is optional because the installer can be instructed to fold the assembly 206 at the kiss-cut 220 as a part of the installation instructions. Creasing or folding at 220 can be done as a separate step to make the process easier, but there is also another optional way to simplify the crease or fold. If the kiss cut goes deeper than shown in FIG. 11C, through the adhesive 210 and partway through the stiffener support 211, then this kiss cut into the stiffener support 211 and will form a natural bend line for folding. Thus, the crease or fold step in the handle 214 at the kiss-cut 220 can be optionally eliminated. This can be important because the folding/creasing operation would require a step additional to the kiss-cut 220 in another operation. It should be pointed out that this inevitable ergonomic, userfriendly embodiment shown in FIG. 11C may be used not only for recovery blades and other strip blades, but may also be used to install spreader blades and wiper blades. One important feature of this most ergonomic recovery blade 206 is that the recovery blade 209 may be made of any material, preferably a plastic or rubber, urethane rubber, MYLAR, acetate, PETG, polycarbonate, vinyl or any other material. However, one difficulty exists in the typical case in cutting, slitting and placing adhesive on ultra thin urethanes below 0.010 inches. The material wants to stretch and deform. Now, and this is an important point that the thin urethane or other elastomer may be simply laminated, slit and otherwise worked with in this embodiment easily, because the stiffener support 211 provides a support to the ultra thin elastomer 209 so that the elastomer can be easily slit in a sandwich of 209, 210, and 211 without concern about stretching the ultra thin elastomer 209 while working with it. Without the stiffener support 211, it would be very difficult to cut narrow strips of very thin elastomeric materials without stretching or otherwise deforming these materials, which would make a wavy recovery blade 209 which would cause a defective waste toner hopper 2 of a toner cartridge causing the "sprinkle dot streak", a vertical band of dots on an output page caused by a kinked, wavy, or otherwise defective recovery blade 209. Also, this idea, good for installing strips of any kind, may be used in other industries and is a first of a kind, a pioneer patent. This idea may be used for stiffening and supporting any flexible or thin material for any purpose of any industry for easy installation. It could be used in the automotive industry, electronics, construction, camping, carpet industry, or any other industry or use. Of course, the liner 207 and adhesive 208 could be any width whatsoever, including being as wide as the blade 209. There may be applications in some industries where a strip needs to be installed in a precise way or quickly and this device and method could be used to prevent the tape on the strip from crinkling and wrinkling and to give the tape or strip a longitudinal supportive rigidity as tape, whether on the tape likes to stick to itself and everything else, and this can provide a simple way to install the tape or strip with greater speed, accuracy, efficiency, reliability, wrinkle-free, with greater ease. This embodiment could be used for installing gaskets, flexible foam material, flexible foam rubber material, die-cut materials and can be designed to fit the contour of any shape to install anything that uses adhesive, 2-sided tape or glue. This device could become another way of packaging strips of any kind for special use requiring greater positioning control.

FIG. 13 shows another embodiment of this invention. This is a packaging method, manufacturing method and device for ergonomic re-assembly of a new replacement pickup magnet 8 as a sheet 33 of strips 8. FIG. 14 shows the installation of the pickup magnet 8 after installation of the recovery blade 17 is completed. This pickup magnet 8 helps prevent messes from occurring when moving toner cartridges around after the shipping seal is opened. This pickup magnet 8 shown being installed in FIG. 14 also helps keep the recovery blade 17 from delaminating from the attach surface 27. Inventor has manufactured magnetic strips in single strips, each with its own release liner for over 5 years and manufacturing this has been very tedious, difficult and required great patience. Then, inventor came up with the idea of the pickup magnet sheet assembly 33 shown in FIG. 13 where the pickup magnets 8, rather than each magnet 8 individually cut are instead kiss-cut on sheets, each pickup strip 8 on a sheet sharing the same release liner 34. When the die-cutting is performed, the die cuts through the flexible magnetic material 31 and also cuts through the tape/adhesive 30 but does not cut through or cuts through very little of the release liner 34 shared by the entire sheet of pickup magnets. With this innovation 33, manufacturing of the pickup magnets 8 is much less costly and also the pickup magnet sheet assembly 33 is ergonomically more easy for a production person to use. It is easily peelable, easy to grab, does not require the difficult task of pulling a very narrow and thin release liner for each pickup magnet 8, saves lots of time in installation to the pickup magnet attach surface 28 on the waste toner hopper 2. With this innovation of the pickup magnet sheet assembly, packaging of pickup magnets 8 is much easier and also less costly to manufacture. This pickup magnet is simpler to manufacture than anything in prior art. The sheet of flexmagnet material with laminated adhesive/2-sided tape 30 is die-cut as a kiss cut so as to cut through everything but the release liner 34. After the die cut, since the magnetic strips are very narrow in width, around 1/32 inch as well as thin, the flex magnet material deforms and develops a longitudinal bow for its entire length. The ratio of die blade to material cut (in thickness) is high, and that is what causes the longitudinal bow. The inventor's solution to this longitudinal bow is to run the die cut sheet 33 through a roller, or a pressure-roller, optionally/preferably with heat and the longitudinal bow is gone. After testing and research, it was found that this heat-pressure flattening process is not detrimental to the material and also is not detrimental to the magnetic field strength. From such a heat-press deformation, in the worst case, magnetic strength could be decreased by around five percent of the original magnetic strength. For this reason, the deformities generated when diecutting the pickup magnet sheet assembly can be corrected with heat-pressure rolling, flattening out the magnetic material beautifully.

Figure 15A:
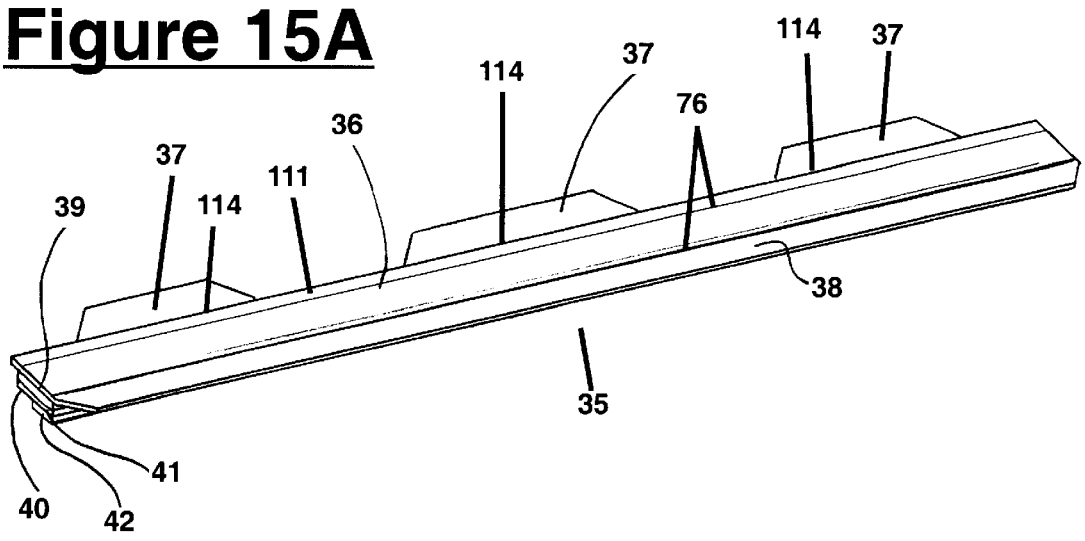
FIG. 15A shows a new and improved recovery blade assembly.
Figure 15B:
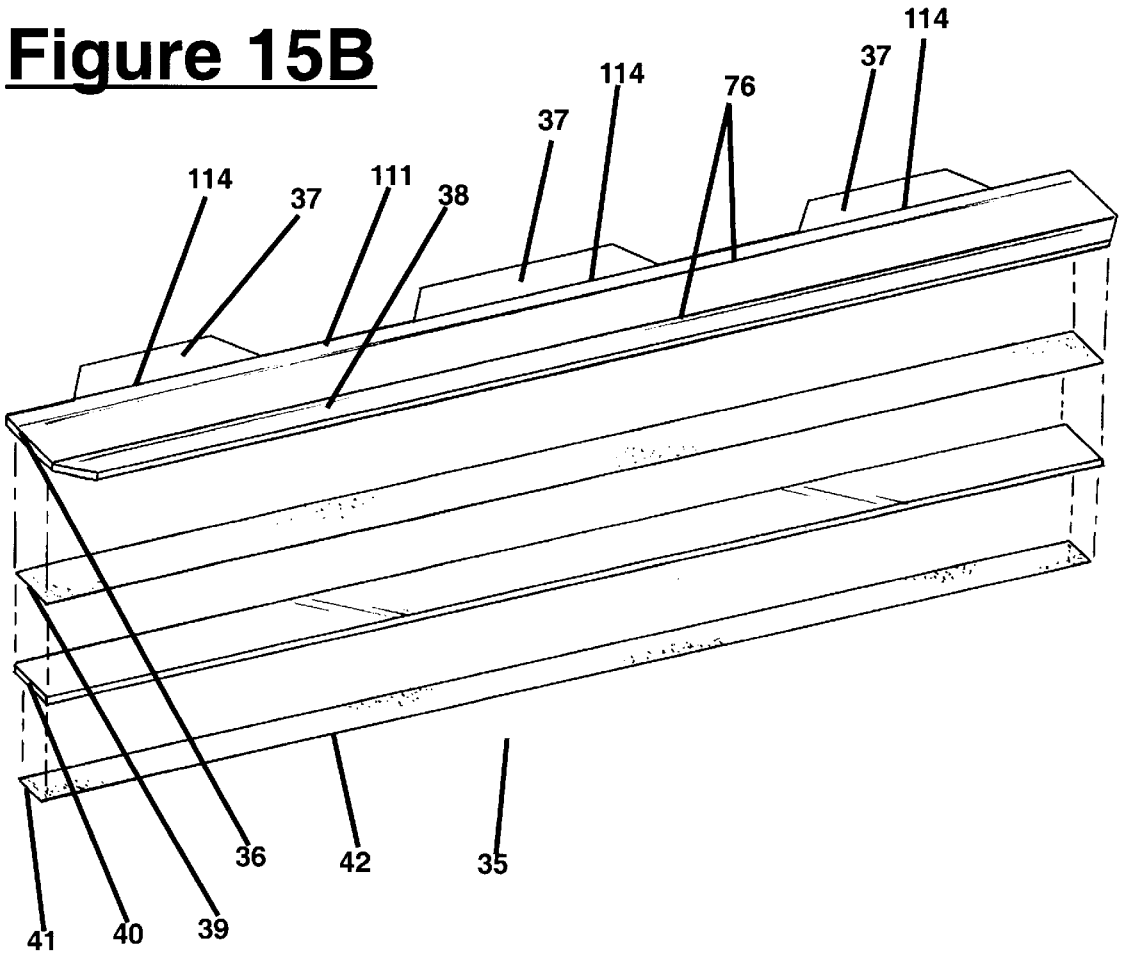
FIG. 15B shows a new and improved recovery blade assembly.

Another embodiment of this invention is another very ergonomic recovery blade assembly 35, shown in FIG. 15A and 15B. This blade assembly 35 has infinite possibilities on how it can be made. The diagram in FIG. 15A and 15B is just one mere example of this embodiment, although the possibilities are limitless. The recovery blade 40 has an attachment tape/adhesive 41 for attachment to the attach surface 27 and a protective release liner 42 that protects the tape/adhesive 41 prior to use. In a similar way as the procedure of FIGS. 7A through 7D and FIG. 11C, a permanent-removable tape 39 attaches on the removable side to the recovery blade 40 and on the permanent side to the positioning stiffener device 36. The positioning stiffener support device 36 can optionally have flaps of regions with no adhesive for easy and quick removal after installation is done. For example, any number of partial length removal flaps 37 may be installed on either sides as in the figures, or may be installed on the ends (not shown). The partial length remove flap 37 is not required to be in the center, may have any number of flaps 37 located anywhere on the support 36, nor is it required to be symmetrical nor is it required to be as long as 37 in FIG. 15B. There is the long remove flap 38 that may even optionally be full length. This long remove flap 38 also has no adhesive at the grab area just like the partial length remove flap 37. Thus after the recovery blade is positioned and installed, the installer may pull on either remove flap 37 or 38 or a similar one in any location to remove the positioning device ergonomically and not requiring using a knife or razor blade as in FIG. 11A. It obviously costs more to manufacture the ergonomic recovery blade 35 than it does to manufacture the recovery blade of FIGS. 7A through 7C and FIG. 11C, and these costs will determine the worthwhileness of this embodiment of this invention. Please note that any positioning stiffener device of this invention whether the simple one 20A through 20D, the easygrab one 211 or the ergonomic one 36, or any other versions later mentioned in this invention or others similar with the same general idea may be made of any material. However, preferred materials are plastic, metal, cardboard or rubber. Stiff or rigid material is preferred. Of the plastic and rubber materials are, just to name a few, polycarbonate, LEXAN, PETG, polyester, MYLAR, acetate, vinyl, hard rubber, fiberglass, plexiglass, or any other plastic. It should also be pointed out that use of clear material such as clear or semiclear plastic for the positioning stiffener 36 allows the installer to visibly see and inspect the glue/adhesive line when necessary for more precise positioning by the installer. Also, a glue type containing pigment, die or other coloring may be used for enhanced view through plastic of the glue line. In some applications this may be important and in others it is not. For such a see-through stiffener, a transparent or semitransparent semipermanent glue/tape/adhesive is desired and such materials are available. Visibility of the glue line is important when converting an SX doctor blade 59 of FIG. 16 into a spreader blade 107 shown in FIG. 17.

Figures 16, 17:
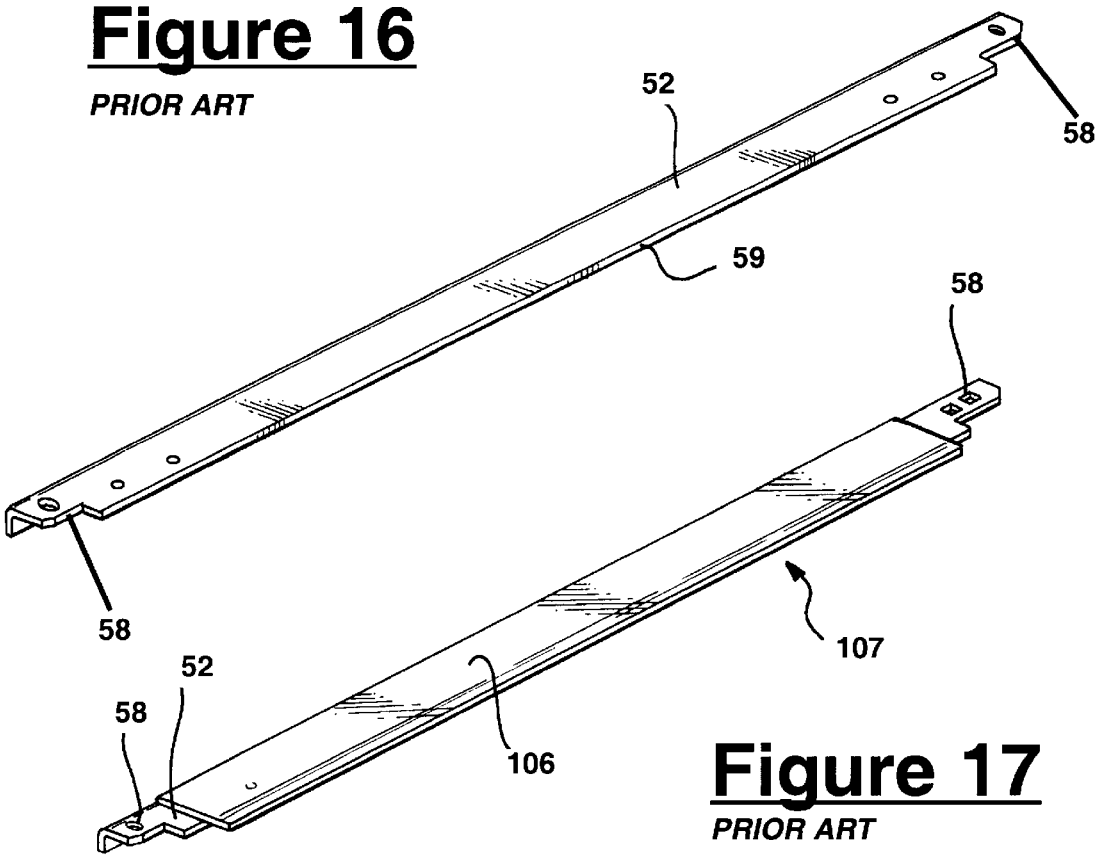
Figure 16 PRIOR ART
Figure 17 PRIOR ART
FIG. 16 shows a prior art frame of a doctor blade assembly from an SX toner cartridge.
FIG. 17 shows an isometric view of a converted SX doctor blade into a spreader blade.

FIG. 16 shows a prior art doctor blade 52 of the SX toner hopper 47 (FIG. 5). This metal framed electrically charged doctor blade 52 was designed to literally scrape or doctor the toner from over the developer roller 44's surface to control the thickness of the toner on the developer roller 44 and thereby control both the amount of toner used and the relative page darkness. FIG. 17 shows this same doctor blade 52 with a urethane spreader blade 106, thus converting the doctor blade 52 into a spreader blade assembly 107. A method of doing this conversion is shown in inventor's U.S. Pat. No. 5,546,162. FIG. 20 shows the spacer 108 located on the bare metal portion of the doctor blade 107 from the patent. The spreader blade 106 is also shown cutaway. The purpose of the spacer 108 was to prevent the metal doctor blade 52 from bowing, warping or curving when tightened down with holding screws (not shown) that go through the holes and the spacer's 108 hole. Although this is all described in inventor's U.S. Pat No. 5,546,162, inventor has found a better way to do the job of inventor's patent without requiring the use of the spacer 108. Before showing the next embodiment that does not require the use of the spacer 108, it should also be pointed out that FIG. 18 shows a prior art spreader blade assembly 102 for the LX toner hopper 97. The metal assembly frame 101 is used to structurally support the urethane spreader blade 102. FIG. 19 shows the NX spreader assembly 103 with the metal frame 104, and the urethane spreader blade 105.

Figure 21B:
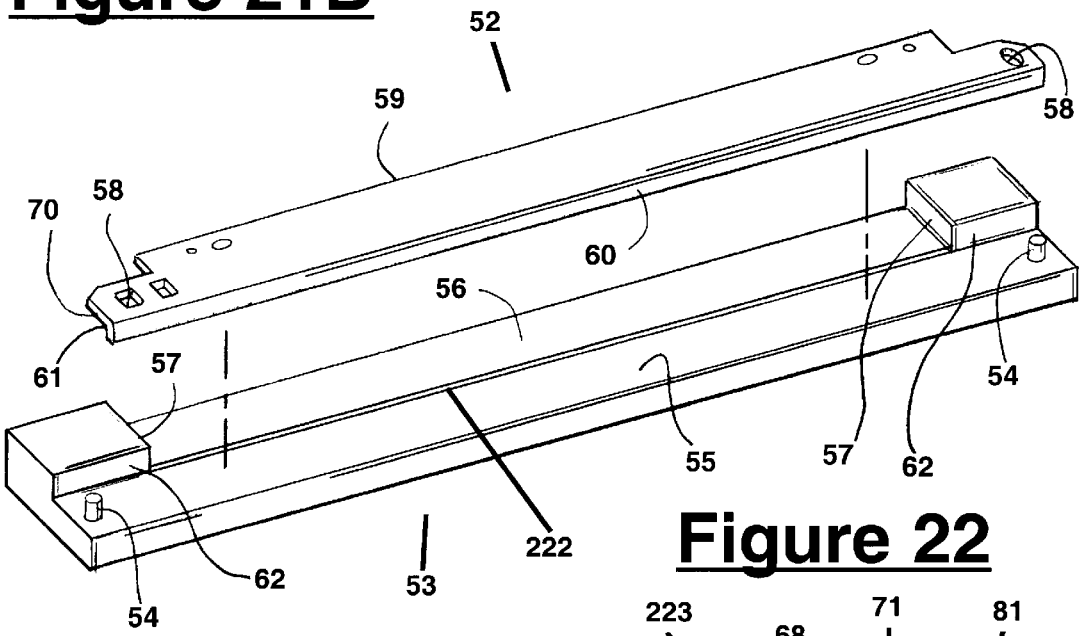
FIG. 21B shows an SX doctor blade as it is placed into the assembly jig for a conversion process into a spreader blade.
Figure 22:
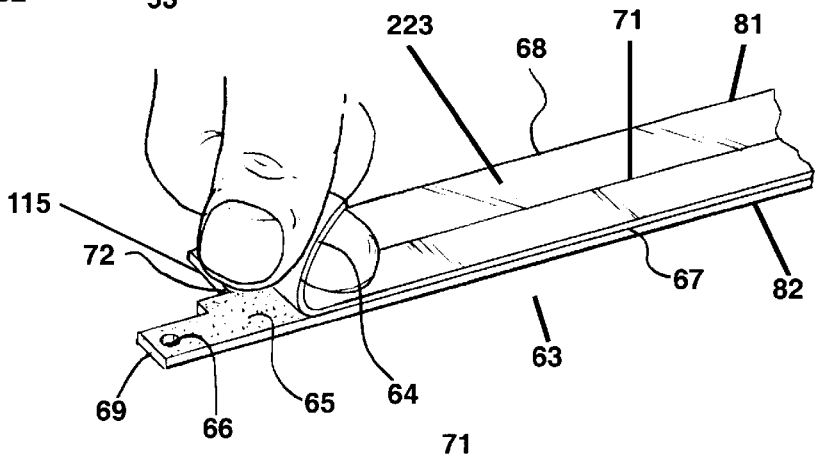
FIG. 22 shows the new and improved spreader blade in cutaway view.
Figure 23:
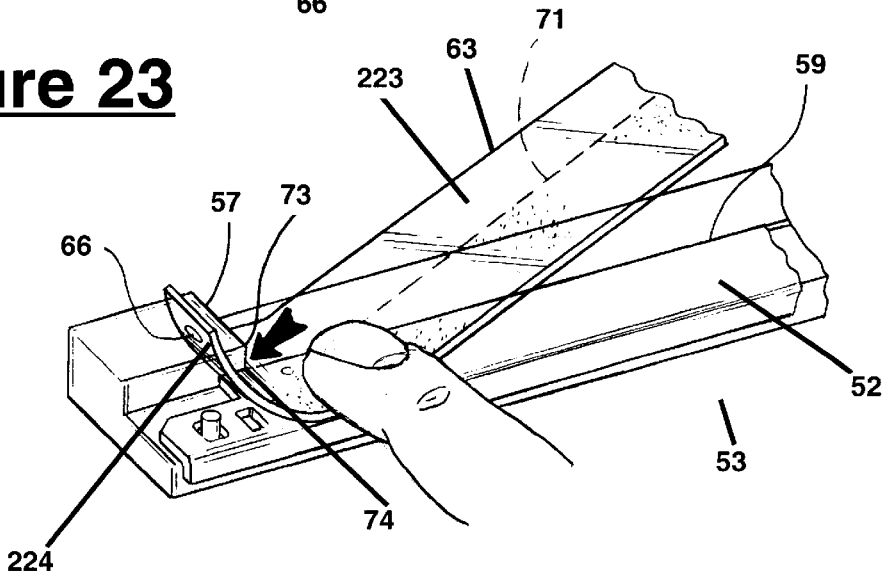
FIG. 23 shows the beginning process of installation of the spreader blade onto a doctor blade to make a spreader blade assembly.

FIG. 21A shows the new and improved installation jig 53 for use in assembly of the spreader blade embodiments of this invention. The doctor blade frame 52 is first placed in the installation jig 53 as depicted in FIG. 21B in exploded form. The end holes 58 of the doctor blade 52 are lined up with the jig pins 54 to properly place the doctor blade 52 in the jig 53 for installation of the spreader blade 63 shown cutaway in FIG. 22. FIG. 23 shows that the jig 53 has end stops 57 for accurate placement of the spreader blade 63 onto the doctor blade 52. The jig also has a step 222 from the jig 53 lower ledge 55 to the jig upper edge 56, so that the surface of the jig upper ledge 56 will be contiguous with the spreader blade bottom surface 224. After the invention that was out in the U.S. Pat No. 5,546,162, it has been found that three things are important in proper installation of the spreader blade 63 onto the doctor blade 52. First, FIG. 23 shows the accurate placement of the left corner mark 74 of the spreader blade 53 into the left corner mark 73 of the jig 53. Thus the side edge stop 57 of the jig 53 must line up with the edge 115 of the spreader blade 63. Second, it has been also found that the glue line 71 of the spreader blade 63 must also align with the back edge 59 of the doctor blade 52. Third, the right side must similarly align which will be shown in the procedure described for accurate positioning of the spreader blade 63 onto the doctor blade 52. The step by step procedure of this embodiment will be described. Once the doctor blade 52 is placed in the jig 53, as in FIG. 21B, then peel the release liner 64 of the spreader blade 63 as shown in FIG. 22. Then align the left corner mark 73 of the jig 53 with the left corner mark 74 of the spreader blade 63 and press in one spot only as shown in FIG. 23. Press so that the adhesive is only stuck in a small region near the jig left edge stop 57 so that the rest of the spreader blade 63 can be properly positioned using the rest of the procedure being outlined. Next, pull the end of the spreader blade 63 as shown in FIG. 24 and stretch if necessary until the hole of the spreader blade 66 fits into the jig pin 54. Then press down on this positioned subsection. Next, without stretching the urethane rubber spreader blade 63, lay down the spreader blade 63 as shown in FIG. 25 for about 75 to 80% of the length of the spreader blade 63 as shown in FIG. 25. It is important that the glue line 71 of the spreader blade 63 aligns along the back edge 59 of the doctor blade 52. Otherwise, toner powder can migrate under the spreader blade 63 and delaminate the adhesive/glue/tape 65 under the spreader blade 63. Glue with die, coloration, or pigment may be used for easier view of the glue line 71. After smoothing down the amount layed down of the spreader blade 63 so far as in FIG. 25, it is now important to position the right corner mark 72 of the spreader blade 63 with the right corner mark 75 of the jig 53. Then press this portion down up to the right edge 57. Then, FIG. 26 shows the pulling; of the right end of the spreader blade, and stretching if necessary, until the hole 66 of the spreader blade 63 fits over and into the jig pin 54. It is important that everything be smoothed down at this point so that the glue/adhesive/tape 65 of the spreader 63 can take hold. After completed, the new modified doctor blade 77 with spreader blade 63 should be pulled out of the jig 53 and is shown 77 in FIG. 27. The glue line 67 is along the metal blade back edge 59 as well as is possible for best results. In a spreader blade assembly 77, the glue line 67 position is more important than the position of the spreader blade back edge 81 which is opposite from inventor's U.S. Pat. No. 5,546,162. The spreader blade front edge 82 position is not critical as is the glue line 67 position. Also, while U.S. Pat. No. 5,546,162 used washers 108 to prevent warpage from tightening down converted spreader blade assembly 107, this spreader blade 63 has longer ends to prevent glue delamination with holes 66 in the spreader blade 63 to accommodate the holes 58 in the SX doctor blade 52 so that tightening down the screws to tighten the completed spreader blade assembly 77 will not warp the metal doctor blade 52 which would cause problems.

Figure 28B:
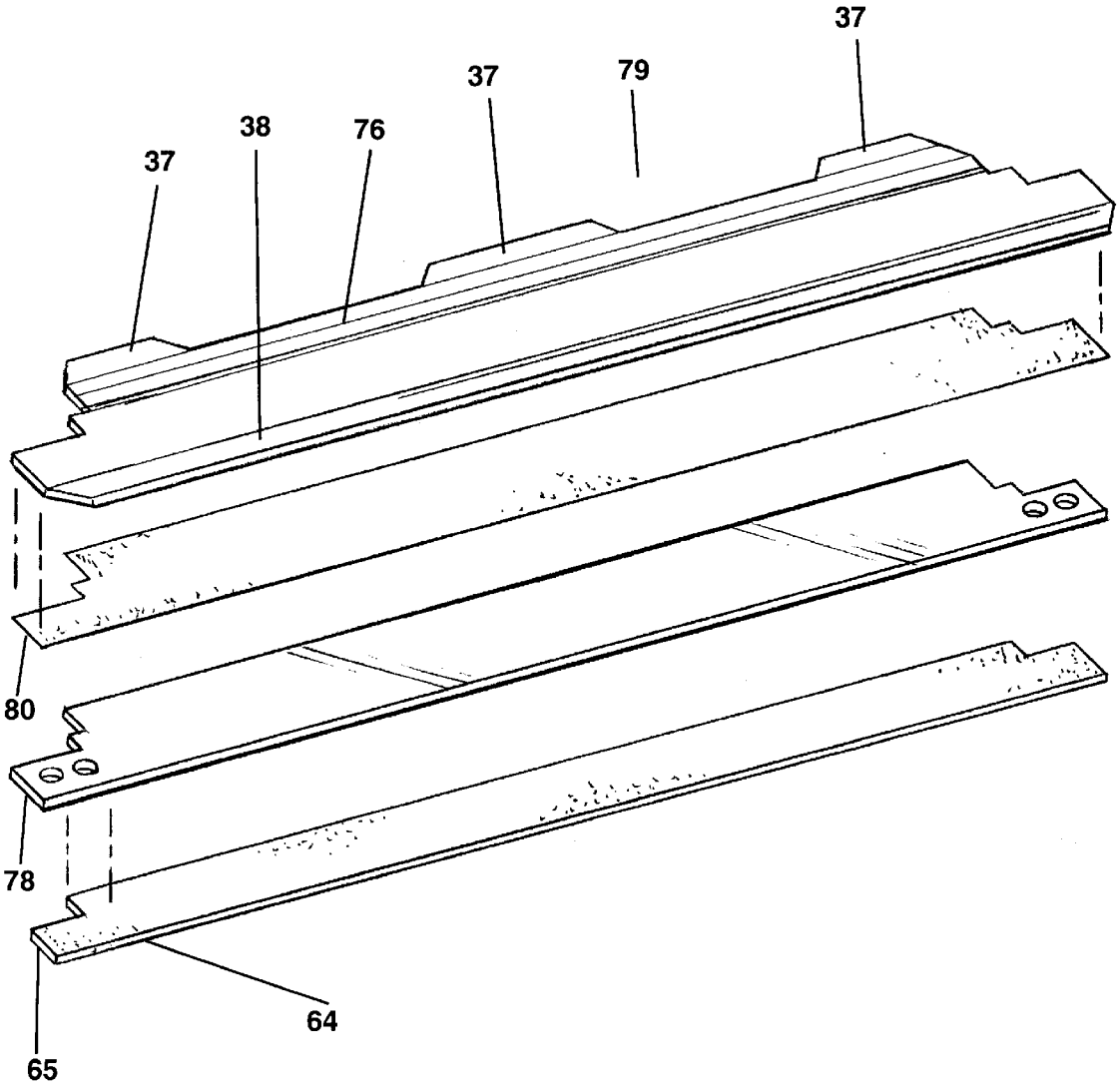
FIG. 28B shows another view of a new and improved device for placing a spreader blade on a frame.

Another embodiment of how to install the spreader blade 78 using this jig is shown in FIG. 28A and 28B. This embodiment involves a simplification of the steps involved in FIGS. 21B through 26 and achieves the same end result shown in FIG. 27, a doctor blade 52 with a spreader blade 63 installed to form a completed spreader blade assembly 77. This embodiment is similar to the recovery blade embodiment shown in FIGS. 15A through 15D. FIGS. 15A through 15D, 28A and 28B use the same concept for a different result. One is for installation of a recovery blade 40 while the other is for installation of a spreader blade 78. FIGS. 28A and 28B show a good example of where a removably adhered preferably nonopaque stiffener/positioning support device 79 can help the installer see that the glue line 67 is properly in position. Glue/adhesive/2-sided-tape 65 with color helps the glue line 67 stand out to make installation easier. To install this version, place the doctor blade 52 in the jig 53 as before. Then remove the release liner 64 of the spreader blade adhesive/glue/2-sided-tape 65. Then grab the removably adhered positioning device 79, optionally using the remove-flap 38 and/or any of the partial length remove flaps 37 to accurately position the spreader blade 78 onto the doctor blade 52. After everything is properly positioned and if the positioning device 79 is either transparent or semitransparent with the adhesive/glue/2-sided-tape 80, then firmly press everything down and burnish, rub, or press it on so that the glue/adhesive/2-sided-tape 65 will hold the spreader blade 78 to the doctor blade 52. When installation is complete, the stiffener/positioning-device 79 may be peeled away like a banana peel with its removable tape 80. The adhesive/glue/2-sided-tape 80 is an adhesive similar to a POST-IT note which is to stick permanently to the stiffener/positioning device 79 and removably adhered to the spreader blade 78. Thus the adhesive/glue/2-sided-tape 80 has properties where it is removable from the spreader blade 78 and will stay stuck onto the stiffener/positioning-device 79. Thus, the installer, who does not need to be an expert at adhesives simply pulls the positioning device/stiffener 79, and both the stiffening device 79 and adhesive/glue/2-sided-tape 80 peel off with the disposable stiffener/positioning-device 79.

Note that a version of a spreader blade assembly similar to the recovery blade assembly 206 of FIG. 11C could be made. Please note that the new and improved shape of the spreader blade 63 of this invention differs from that used in the previous U.S. Pat. No. 5,546,162 of inventor. By increasing the length of the blade 78, as opposed to that of FIGS. 17 and 20, a one-piece installation was achieved not requiring washers 108 (FIG. 20). However, it has also been learned by hard knocks by inventor that the same result of preventing delamination on the ends could have also been achieved by cutting either notches or holes in the spreader blade 63 or 78. FIGS. 29A-32 show some of the examples on how to prevent delamination of the spreader blade 63 or 78 from the doctor blade 52 using notches, zigzags, holes, protruded area, or other shape. One idea is to increase the edge-length of the blade. Optionally, glue may be applied to better hold down the end of the spreader blade 63 or 78. The quickest way to glue is to use a hot melt glue gun.

Figure 28C:
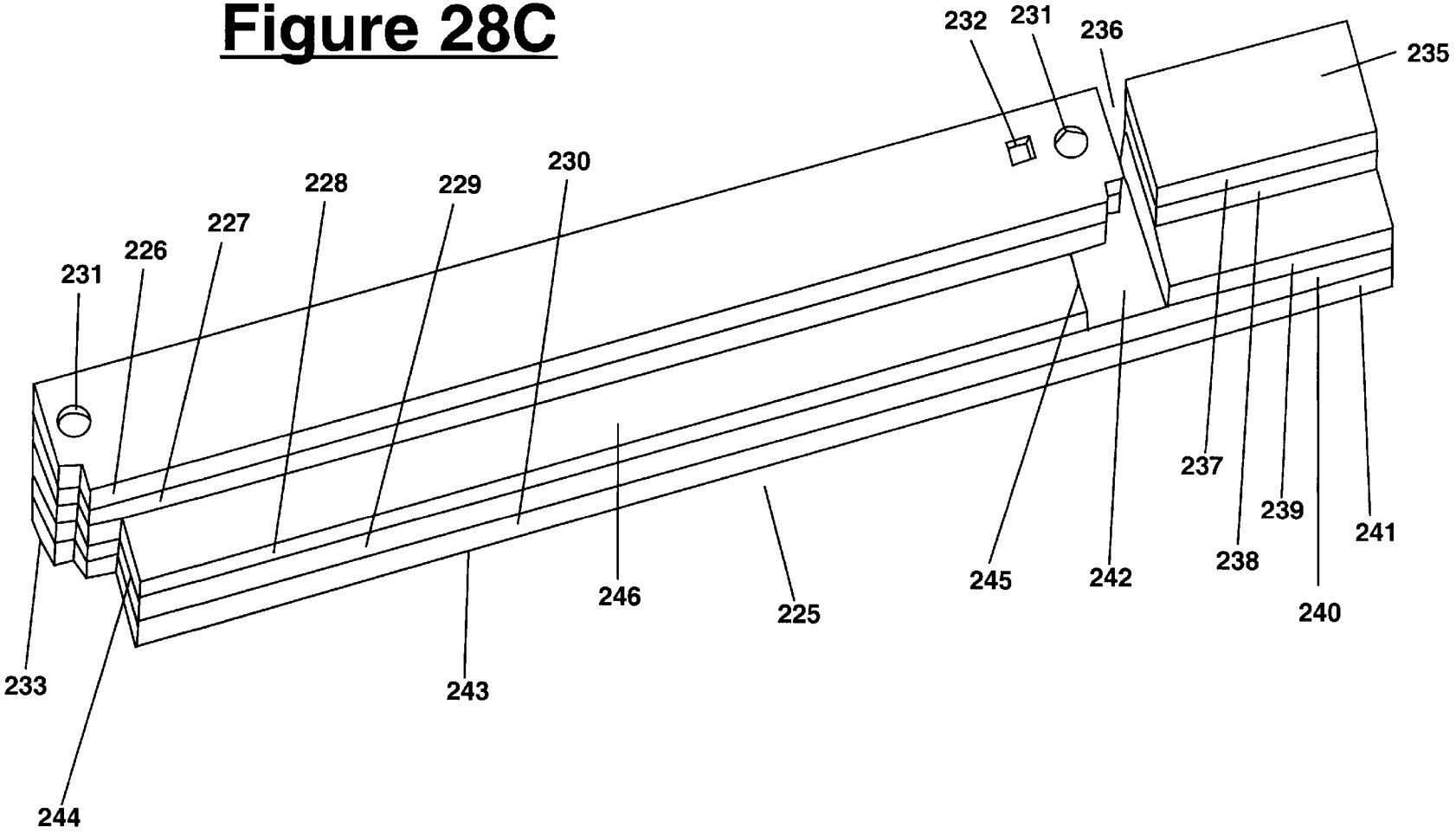
FIG. 28C shows another new and improved device for placing a spreader blade on a frame.
Figure 28D:
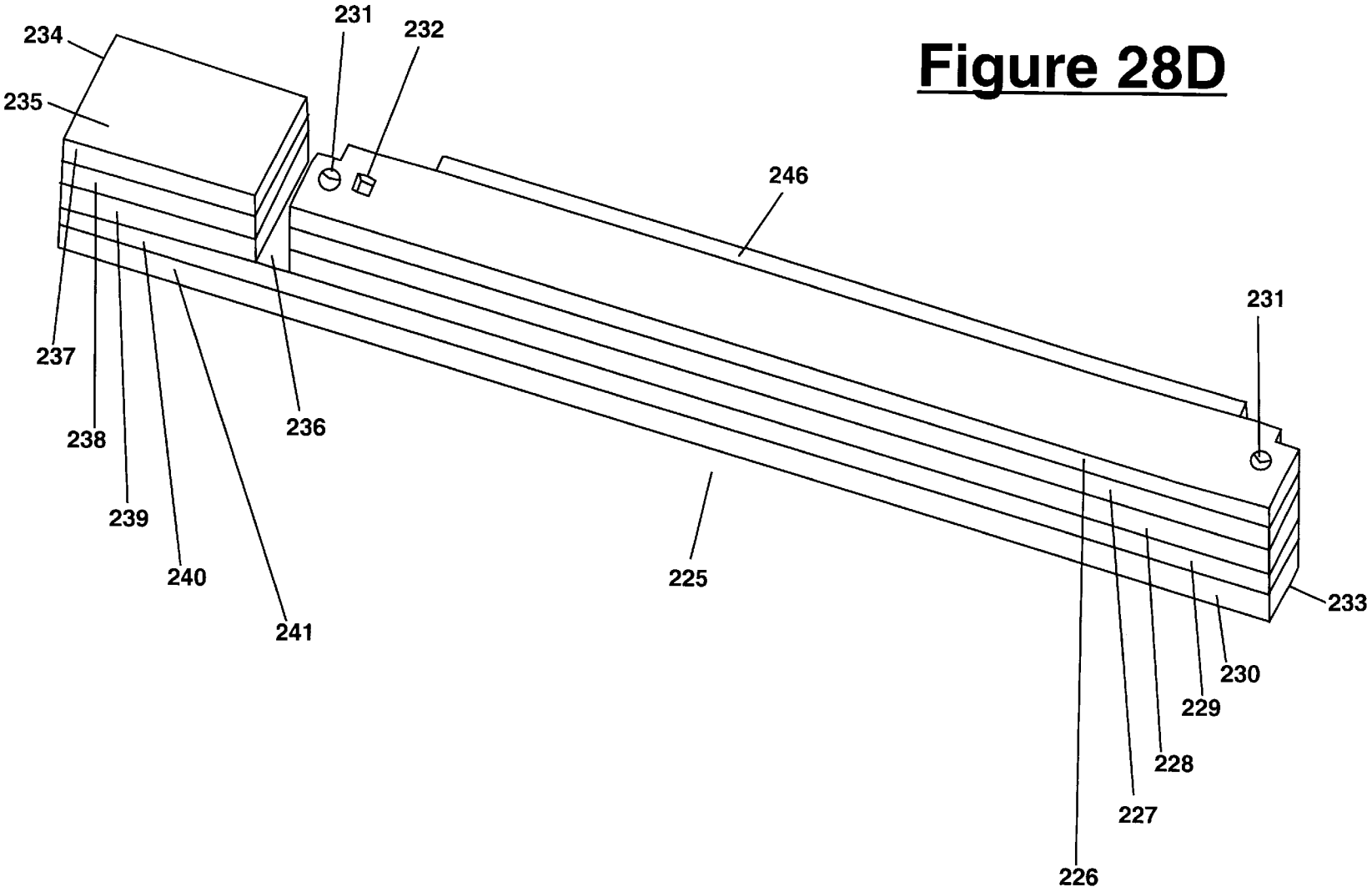
FIG. 28D shows another view of a new and improved device for placing a spreader blade on a frame.

FIGS. 28C and 28D show another preferred spreader blade assembly 225, an ergonomic spreader blade assembly. This spreader blade assembly 225 is very easy to install, because there is a positioning support stiffener 230 that keeps the assembly rigid when installing onto a doctor blade frame 52 or other frame. The positioning stiffener support 230 also makes this embodiment easier to install, because instead of the elastomeric spreader blade 63 being plyable, stretchable and exhibiting other properties typical of elastomeric materials, the elastomeric version of the spreader blade 228 is kept supported and rigid and workable (slittable, cuttable, laminatable, managable) when being manufactured (and when installing) resulting in higher product yield, making it easier to manufacture, quicker to manufacture, may be easily slit, may be easily laminated, may be easily produced, all using techniques of continuous flow automation or semi-automation manufacturing processes. This is similar to the recovery blade assembly 206 (FIG. 11C), but instead is a spreader blade, not a recovery blade. This device is not required to be elastomeric, even though most spreader blades are elastomeric, it may be made of any material mentioned anywhere in this patent, for example, MYLAR, polyester, polycarbonate, or any other material whatsoever, although elastomeric blades seem to work best.

The spreader blade assembly 225 consists of a layer of positioning support stiffener device 230, preferential adhesive 229 that adheres better to the positioning support stiffener 230 than to the spreader blade 228, 2-sided-tape/adhesive/glue/transfer-tape 227, a release liner 226 (optional), and also has an easy-grip handle 235 located on the right side 234 of the spreader blade assembly 225. There is a left side 233, two holes 231, and a hole not unlike a square in shape 232, a back kiss-cut region 236 and a front kiss-cut region 242. To the left of the kiss-cut regions 236 and 242 is the spreader blade region 243 of assembly 225. To the right of the kiss-cut regions 236 and 242 is the easy-grip handle 235 on the right side 234 of the assembly 225. The easy-grip handle 235 has an adhesive liner 237, an adhesive layer 238, a spreader blade layer 239, a preferential adhesive layer 240 and a positioning support stiffener layer 241. Note that the stiffener layers 241 and 230 are contiguous and connected in most versions of this embodiment as is the preferential adhesive 240 and 229. This allows for easy peeling of these two layers 229 and 230 when installing the assembly 235. Optionally, the installer can bend the assembly at 236 and 242 area for easy installing the assembly 225 can be installed by having the installer bend the assembly 225 at the kiss-cut region 236 and 242, or the assembly 225 optionally does not need to be bent at all. When manufacturing, a bend or crease can be placed in the kiss-cut region 236, 242. Another option is to kiss-cut in the kiss-cut region 236 and 242, a little deeper, possibly cutting through either the preferential adhesive 229 and 240 and/or the positioning support stiffener 230 and 241, cutting through either/or both either partway or all the way. By cutting part way through the support stiffener 230 and 241, a natural place for an easy fold is generated for easy installation. To install, first remove the adhesive liner 226, thus exposing the adhesive 227. Place the doctor blade 52 onto the jig 53 as in FIG. 21B. Then attach the remainder of the assembly 225 on the doctor blade 52, preferably when the doctor blade 52 is located in the assembly jig 53, similar to the embodiments described using the jig 53. When installing, make certain that the left edge blade 244 and right edge blade 245 of the spreader blade assembly 225 are perfectly flush against the stops 57 of the jig 53. With the stiffener support 230 providing structure to the spreader blade 228, the glue line 71 will be appropriately in place, as will be the left side blade 244 and the right edge blade 245, whereby it should install properly no matter who installs it. The only concern with doing the installation this way is that if the glue 227 is not manufactured straight and proper on the spreader blade 228, then it will be difficult to get the glue line 71 in proper place when installing. By using clear or semiclear glue/2-sided-tape 229 and clear or semi-clear plastic for support stiffener 230 and optionally a colored adhesive 227, it is easier to verify visually that installation is going right, that the glue line is properly positioned. Then press down the recovery blade assembly 225 or burnish it so that the adhesive/tape/glue/2-sided tape will adhere well. Then grab the handle 235, and peel off the support stiffener 230 and 241 as well as its adhesive 229 and 240. When so doing, all layers 237, 238, 239, 240 and 241 of the handle 235 may stay together without delaminating them. That is why this embodiment 225 is so simple to manufacture, because it can all stay laminated, but simply kiss-cut. Optionally, the handle can be bent prior to installing. When manufacturing the assembly 225, it may be cut in continuous flow processes because of the simple design.

The FIGS. 29A through 32 show alternate ways of adhering the spreader blade 63 to the metal frame to be attached. Problems to be overcome are toner migration under the glue causing delamination of the spreader blade 63 and other causes of glue delamination. Once the glue delaminates, the spreader blade 63 is destined for failure. A spreader blade 63 of FIG. 22 may work for a metal frame 52 designed without a spreader blade 63 such as the SX toner cartridge, on the verge of becoming obsolete. Other cartridges such as the LX spreader blade assembly 100 of FIG. 18 and the NX spreader blade assembly 103 of FIG. 19 may not be so forgiving as well as the most popular in 1997 EX spreader blade (not shown). The blade has a limited amount of room to expand beyond the OEM dimensions of FIGS. 18–19 because there is a felt endseal that blocks the use of the spreader blade enlengthening as the one represented as 63 in FIG. 22. The endfelt position physically limits the position of the spreader blade in many types of toner cartridges. Without using the style as the spreader blade 63 of FIG. 22, some compromise had to be made over the preferred choice 63. Consequently, an alternate design and method had to be developed and is shown in FIGS. 29A through 32. These spreader blades 63A through 63F may optionally be enhanced with glue, adhesive hot melt glue added after installation, SuperGlue, conductive SuperGlue, or other enhancement. The styles of FIGS. 29B and 29C, spreader blades 63B and 63C do not need any enhancement, and so, are more userfriendly to install when enough room is available in the toner hopper.

FIG. 29A uses a simple notch 124 cut into the glue area 130 of the spreader blade 63A. FIG. 29B shows a simple partial protrusion 125 of the glue area 130 to prevent delamination and toner migration under the glue/tape 130 of the spreader blade 63B. This is a preferred embodiment of the FIGS. 29A through 32. FIG. 29C uses a full width protrusion 126 that matches the width of the glue 130 width on the spreader blade 63C. FIG. 30 shows a spreader blade 63D that has multiple slots or notches 127 on the ends of the spreader blade 63D. FIG. 31 shows a spreader blade incorporating multiple triangular notches 128 at the ends of the spreader blade 63E over the glue area 130. FIG. 32 shows endholes 129 located near the ends of the spreader blade 63F that can be filled with glue or adhesive such as a glue gun or hot melt glue after installation for further support. Thus, a method and device has been developed that is alternate to the spreader blade 63 of FIG. 22 that can operate in an environment where there is limited length in which to place the end portions of the blades where additional adhesion can be achieved to avoid delamination and toner migration under the spreader blades 63A through 63F.

Figures 33A, 33B:
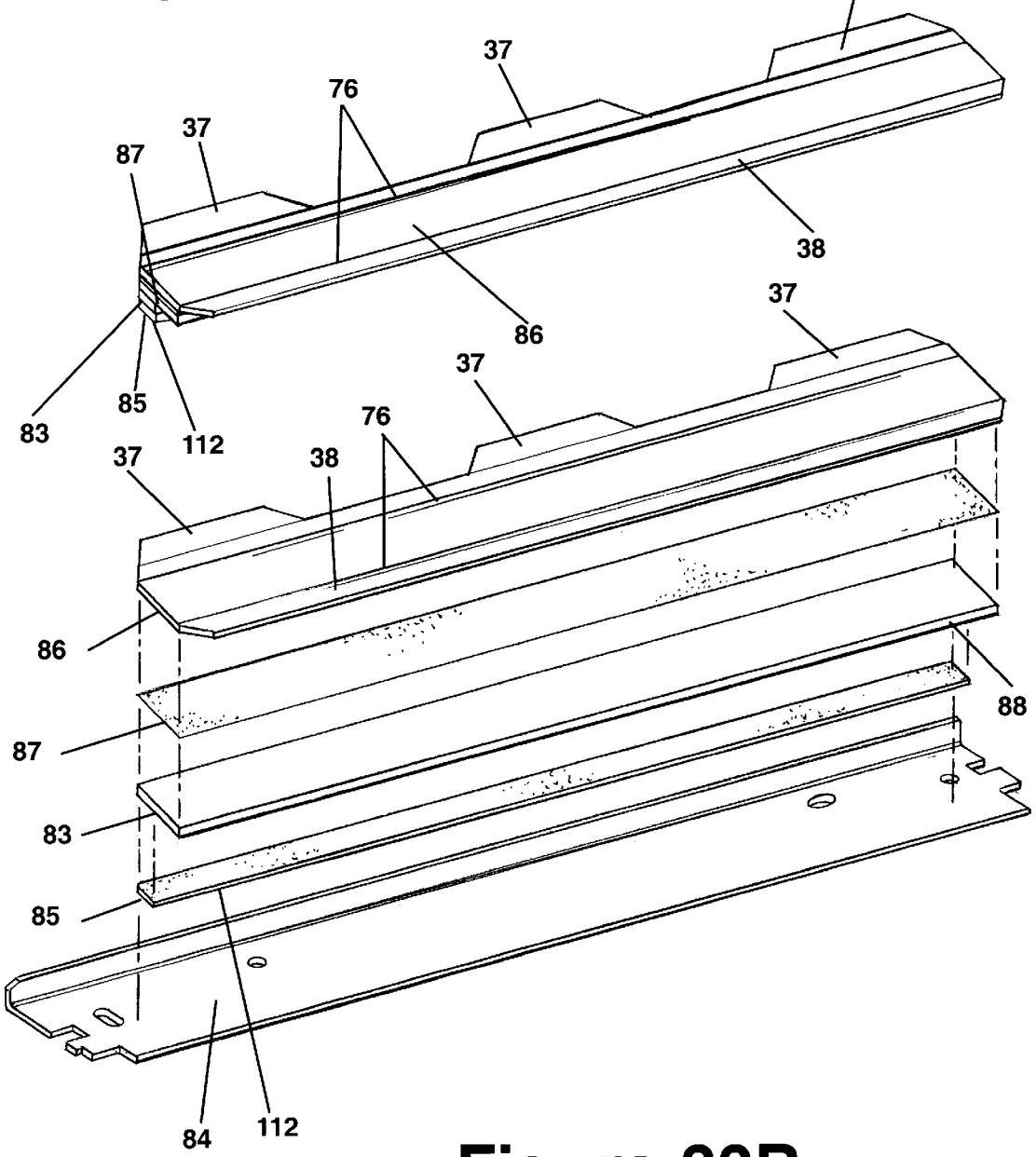
FIG. 33A shows an isometric view of an improved wiper blade assembly device and method.
FIG. 33B shows an isometric breakdown view of an improved wiper blade assembly device and method.

FIGS. 33A and 33B show the same concept of the stiffener 86 removably adhered to a wiper blade 83 for positioning the wiper blade 83 to the metal frame structure 84. The principle is the same as that of FIGS. 28A, 28B, 15A and 15B only this time, the wiper blade 83 is being installed rather than a recovery blade 40 or a spreader blade 78. The FIGS. 33A and 33B show a disposable stiffener device that is removably adhered to the wiper blade 83 using an adhesive 87 that sticks permanently to the stiffener device 86 and removably adhered to the wiper blade 83. The wiper blade 83, in turn, has a permanent or semipermanent adhesive/tape/2-sided-tape/glue 85 that adheres it to the metal frame structure 84 that holds the wiper blade 83 when in use. This positioning stiffener removable device 86 has optional holders 37 and 38 for easy removal and creases and/or folds for easy removal.

Figure 34:
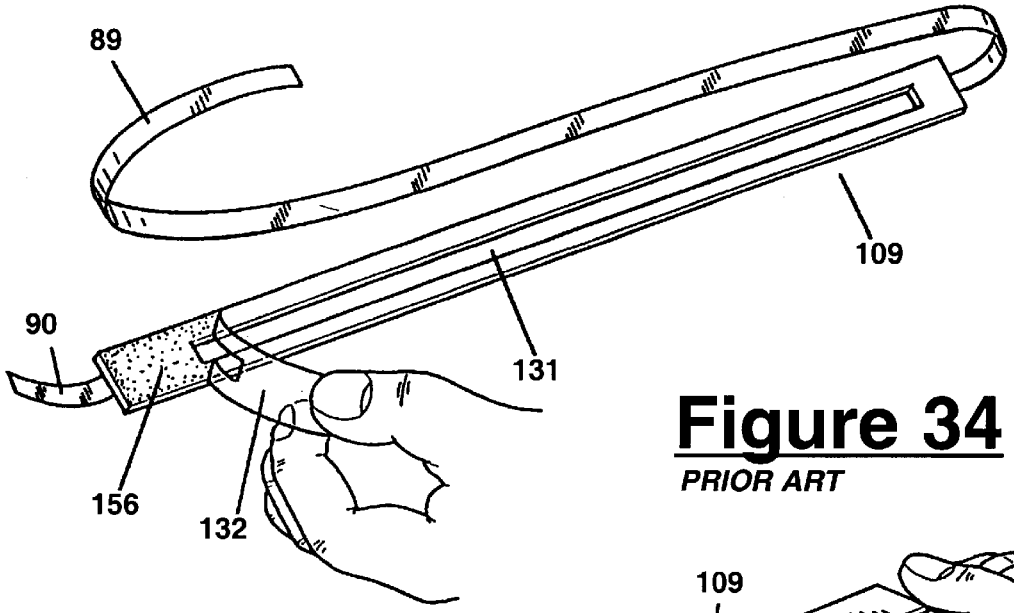
Figure 34 PRIOR ART
FIG. 34 shows a shipping seal assembly.
Figure 35:
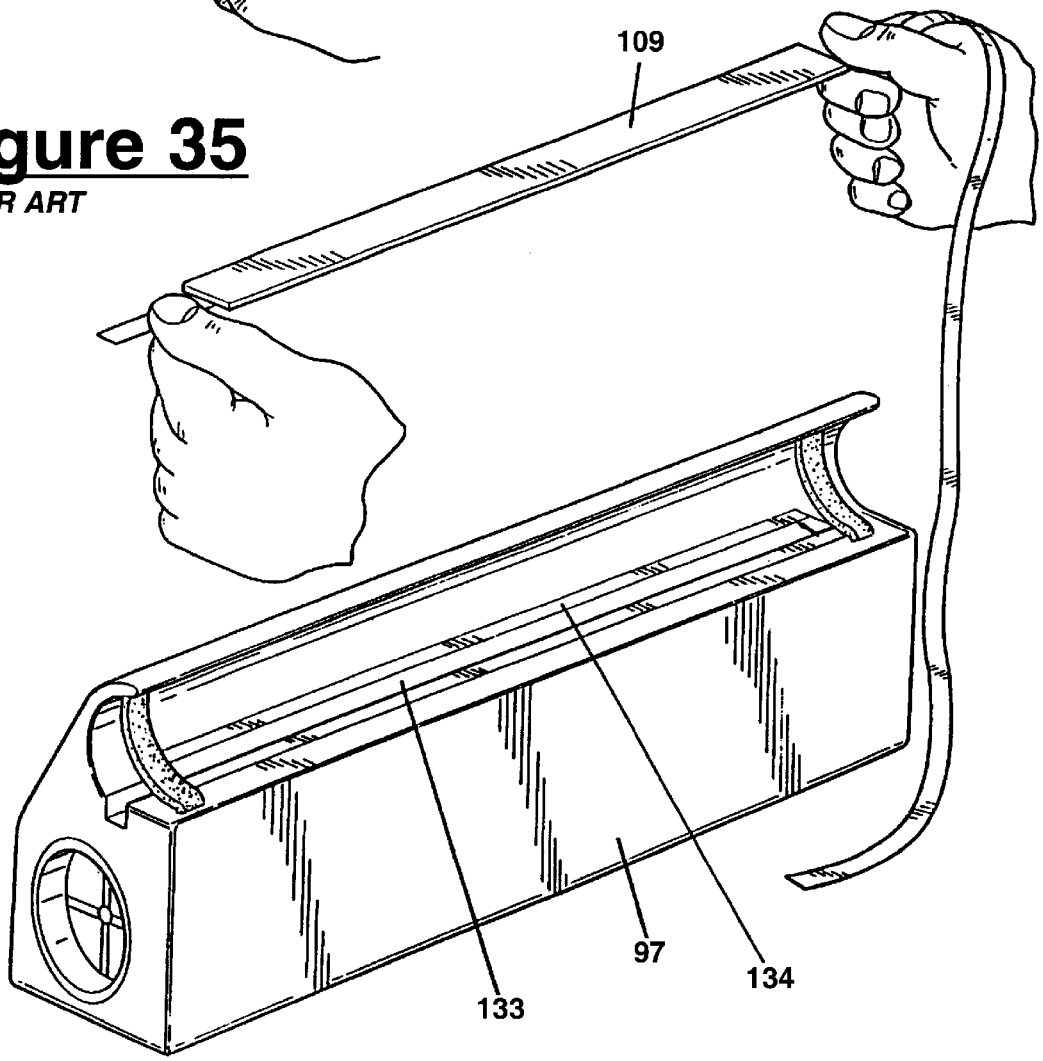
Figure 35 PRIOR ART
FIG. 35 shows the process of assembling a shipping seal on a toner hopper in isometric view.

FIG. 34 shows the seal assembly 109 of FIGS. 3C in greater detail. The protective liner 132 of the seal assembly 109 is being removed for installation. A slot 131 or a non-adhesive center 131 is shown where toner will fall through after the tear-guide 89 tears the tear material in a controlled width as shown in FIG. 3E. FIG. 35 shows one way the seal assembly 109 is installed into the toner hopper 97. Different construction varieties will now be presented.

Figure 36:
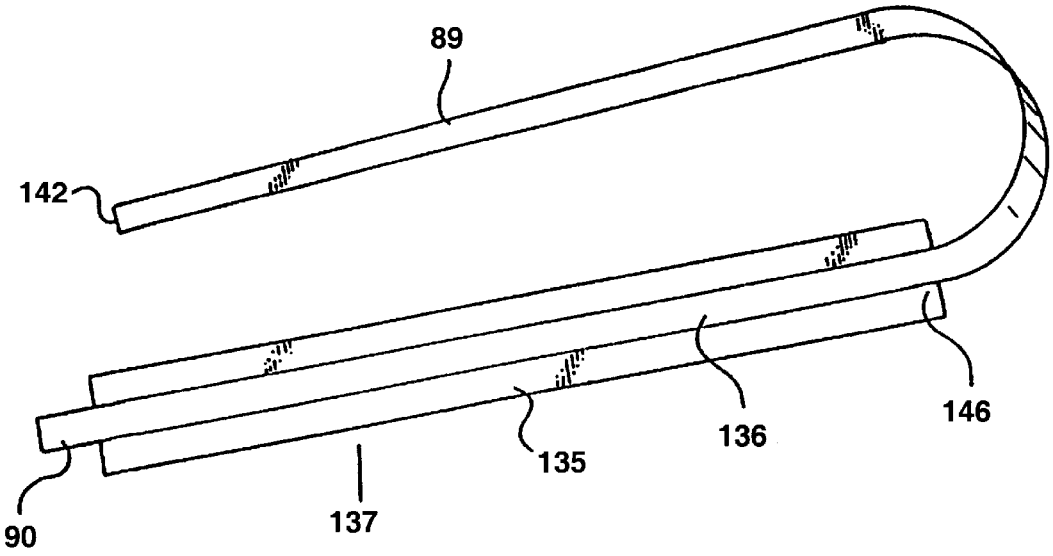
Figure 36 PRIOR ART
FIG. 36 shows a component of a shipping seal, the tear subassembly.
Figure 38A:
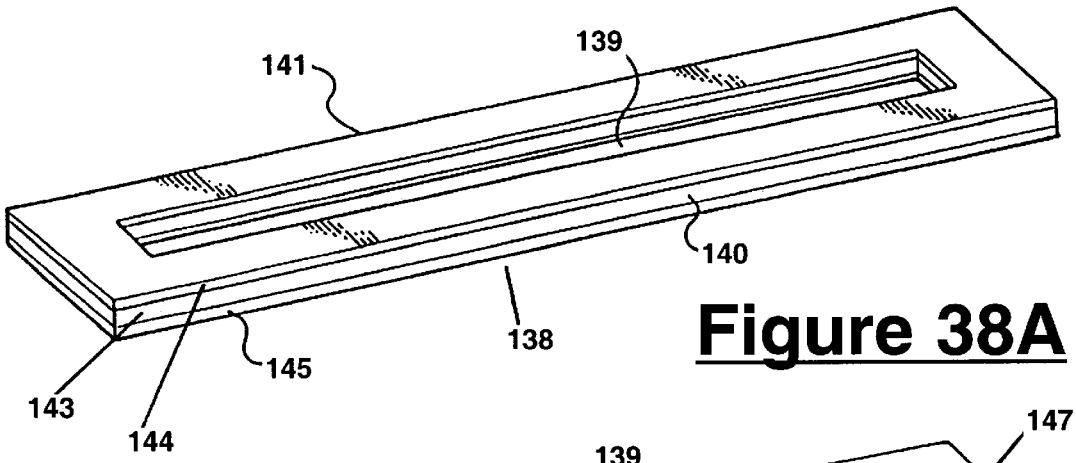
FIG. 38A shows a seal-insert subassembly of a shipping seal in isometric view.
Figure 38B:
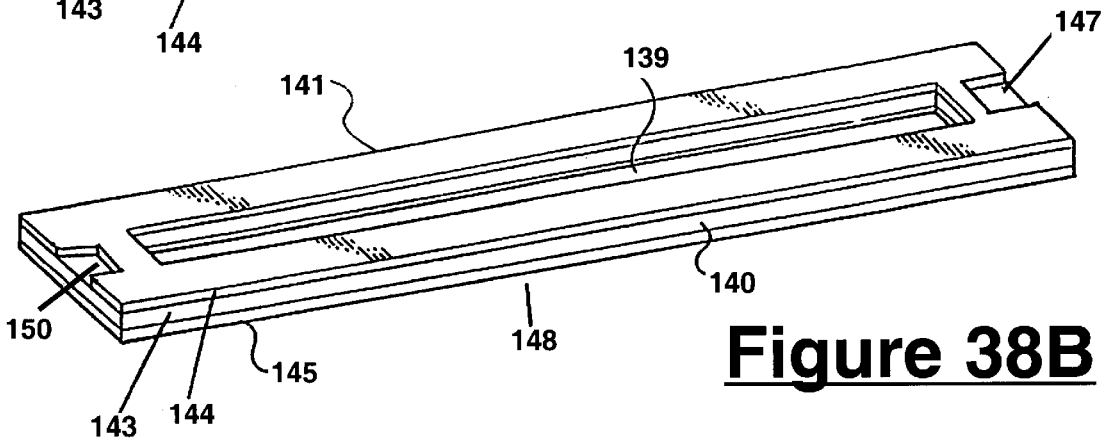
FIG. 38B shows an improved seal-insert subassembly of a shipping seal in isometric view.
Figure 38C:
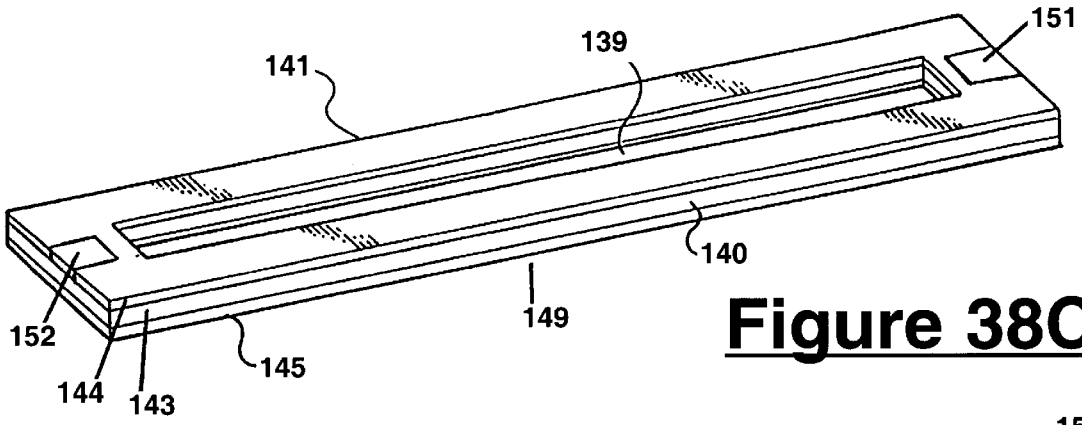
FIG. 38C shows an improved seal-insert subassembly of a shipping seal in isometric view.
Figure 38D:
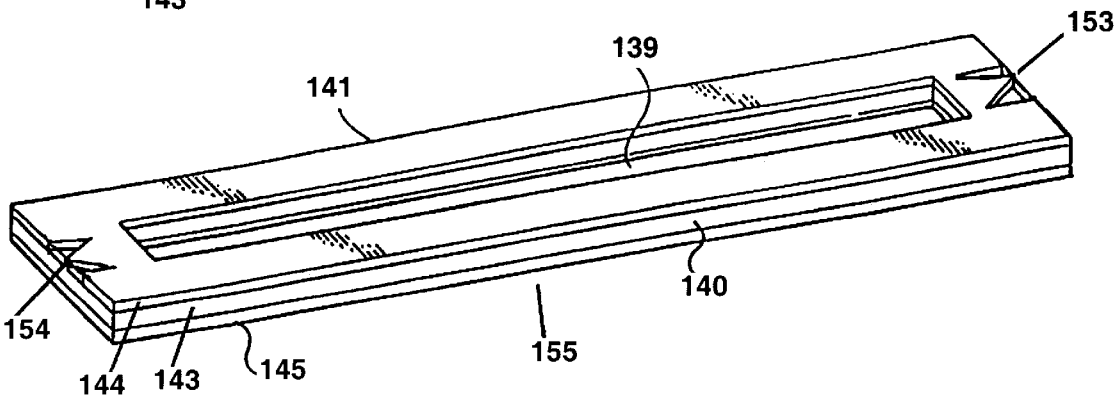
FIG. 38D shows an improved seal-insert subassembly of a shipping seal in isometric view.

FIG. 36 can be depicted either of two ways in one Figure. In the first approach of FIG. 36, there is a tear material 135 with a tear guide 89 which is adhered to its centerline strip 136 which is a subassembly 137 of a shipping seal 109 of FIG. 34. When the tear-subassembly 137 is attached to a seal insert 138 from FIG. 38A by removing the adhesive top protective liner 144, thus exposing the top adhesive, the tear guide 89's centerline strip 136 is placed over the slot 139 of the seal insert subassembly 138. The tear-guide 89 guides the tear of the tear material 135 to assure that the tear width will not be narrower than the width of the tear guide 89 at the centerline strip 136 when the tear guide 89 is pulled from its end 142. The tear guide 89 might be a little difficult to tear at the beginning of tear 146 because there is the force of top glue/adhesive/2-sided tape layer 144A below liner 144 adhering to the tear material 135 to the seal insert subassembly 138 trying to delaminate the tear material 135 from the seal insert subassembly 138 when in fact one wants to tear the tear material 135 down its centerline strip 136, rather than inadvertently delaminate the tear material 135 from the seal insert subassembly 138 which would certainly result in an unwanted failure because in that event, a much wider amount than the tear-guide 89 width would try to be pulled through a limited size constriction in the toner hopper 97 resulting in a jam, a tear-guide 89 that can not be pulled all the way through, resulting in a failure. Thus, the preferable result would be to tear the tear material 135 along its centerline 136. This problem can occur where the initial tear is made at location 146. One way is to use slits, but another way is to have no adhesive it the beginning of the tear 147 as shown in FIG. 38B. When diecutting the seal-insert 148, the diecutting process can make a kiss-cut that cuts only through the liner and adhesive 144A and possibly slightly deeper of the shape as shown in region 147 whereby the adhesive can either be removed in these regions 147 and 150 as shown in FIG. 38B or the adhesive 144A of the seal-insert 149 can be masked as shown in FIG. 38C at regions 151 and 152. FIG. 38D shows another way of masking and/or removing the adhesive 144A from a seal-insert 155 by cutting a "V" pattern or "M" pattern in the adhesive and removing the adhesive at regions 153 and 154 or optionally masking over the adhesive in regions 153 and 154. Other patterns are also possible of either adhesive masking, adhesive removal or lack thereof, but to define every possible configuration and pattern would be a big task and this invention incorporates all shapes and configurations of mask area or adhesive removal area at either or both ends, similar to 147, 151 and 153, noting that this can be done and is a part of this invention. Now, and this is a very important part of this invention because it makes it easier to tear the tear-material 135 at the beginning of the tear 146. When a tearing force by the tear-guide 89 is applied to the beginning of tear 146 region, the tear will be controlled by not only the tear-guide, but also it will be controlled by the lack of adhesive holding the tear-guide 89 and tear-material 135 to the seal-inserts 148, 149 and 155 of the beginning of tear 147, 151 and 153 and thus the beginning of the tear 146 will be controlled by this lack of adhesive at the beginning of the tear. There are two conflicting forces at work here. First, when the tear-guide 89 is pulled, there is a force trying to delaminate the tear material subassembly 137 right off of the seal-insert 138, 148, 149, or 155. The second force is the tearing of the tear-material 135 along the centerline 136 of the tear-material 135. A third force is the pull trying to remove the seal-insert 138, 148, 149 and 155 from the toner hopper 97 after installation. So which will occur the tear of the tear-material 135 along the centerline 136 or the delamination of the tear material subassembly 137 from the seal-insert 138, 148, 149 or 155. The applied forces will try to do both operations at the same time when the initial pull is made on the tear-guide 89. In the seal-insert 138 of FIG. 38A, it can tear some and delaminate some and thus a failure will occur sometimes but it usually will work alright but will occasionally fail. This occasional failure is not good enough in an industry that demands perfection. So, by either removing or masking off some of the adhesive/2-sided tape/glue 144A at the beginning of the tear, you have thus, if properly done, favored the tear-material 135 to be torn rather than cause a failure by delaminating the seal tear subassembly 137 or any unwanted portion thereof. You have now control over the initial tear 146 to prevent delamination of the tear material subassembly 137 from the toner hopper slot opening 159 in the toner hopper 97 and can prevent this type of failure.

In the second approach to FIG. 36, the centerline 136 of the tear material subassembly 137 has longitudinal kiss-cuts 136 that control the tear rather than a tear guide. In this view, the tear pull strip 89 is contiguous with the tear material subassembly 137 and not a separate material as in the previous paragraph, and made of the same tear material 135. But all the principles of the above paragraph apply the same way with the only difference being that the tear pull-strip 89, being contiguous with and made of the same material as the tear material subassembly 137, therefore does not have a hump at the longitudinal centerline caused by the thickness of the tear-guide 89 glued to the tear material 135 as in the previous embodiment. This bump can cause leaks at the beginning of the tear region and the end of the tear region. To compensate for this, a thick adhesive with gooey properties that can fill the grooves must be used as in the previous embodiment. With this embodiment, there is no such bump and special glues/adhesives are not required to fill in where the kiss-cut region 147, 151 or 153 is at. If the kiss-cut touches the adhesive 144A, then it may require special glue or adhesive, but if the smooth surface touches the adhesive layer 144A, then there is no place for the toner to leak and the kiss-cuts of the centerline 136 control the tear and also help control the initial tear to tear rather than delaminate the tear material subassembly 137. Please note that when I refer to a kiss-cut, I am referring to a precision cut that cuts part way through the tear material 135 in the tear material subassembly 137 whereby the tear-guide 89 is contiguous with the tear-material 135 and the tear-subassembly 137, is all one piece. There exist some materials that tear straight and tear nearly straight anyway. But the kiss-cut can help aid these materials or many other materials as well to tear straight without requiring the use of a tear-guide 89 that is not contiguous with the tear material 135.

Figure 37:
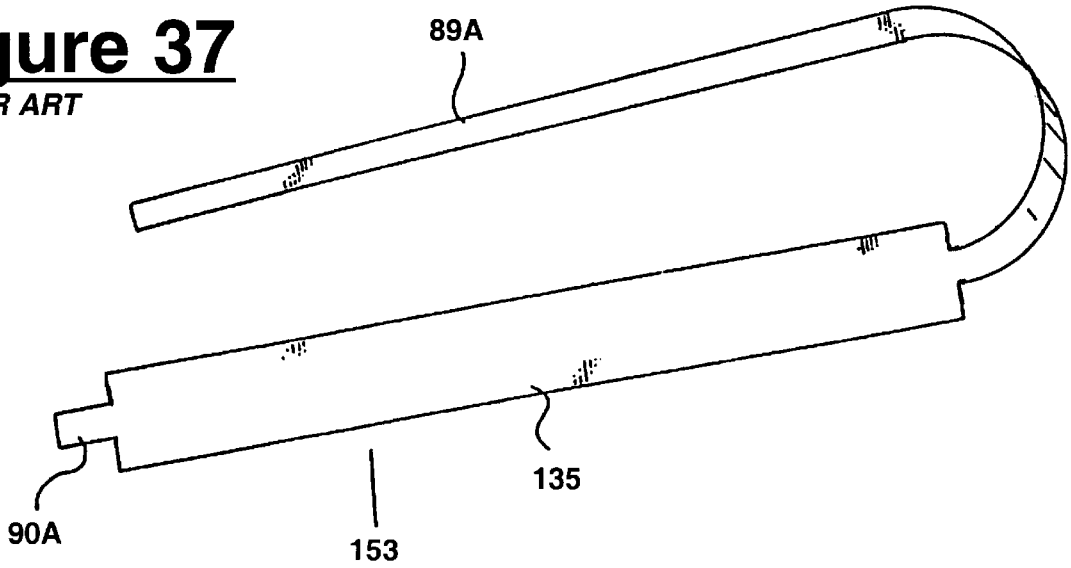
Figure 37 PRIOR ART
FIG. 37 shows a component of a shipping seal, another tear subassembly.

FIG. 37 shows yet a third approach to do the same as in the last two paragraphs but this time the tear material subassembly 153 has no tear guide and has no kiss cut. The tear material 135 here is made of a material that tears straight or nearly straight such as a polypropylene, not excluding other materials, with a linear stretch to it that causes the material to tear straight or nearly straight. Thus, the tear-guide 89 is not required and cost is reduced. Use of such polypropylenes has been done before and is admitted prior art from the Honda U.S. Pat. No. 5,177,540. But what is unique here is using the device and methods of FIGS. 38B through 38D in conjunction with FIG. 37 to control the initial tear to be a tear rather than to be a delamination of the entire tear subassembly 153. FIG. 37 consists of a tear subassembly 153 that uses a contiguous tear-pull-strip 89A to pull on material identical to that of the tear subassembly 153. Note that this initial tear-control method and device also makes the initial tear easier to do requiring less force to pull. The concept of reduced tearing force has been discussed in the U.S. Pat. No. 5,523,828 reference using little cuts at the beginning of the tear, an aperture of the seal-insert 138 at the tear region, but did not disclose adhesive masking, a lack of adhesive, or kiss cut at initial tear regions such as 147, 151 and 153. My invention optionally uses a masked area or lack of adhesive area also at the end of the tear regions 150, 152 and 154 as well. The nice thing about masked areas 151 and 153 is that by kiss-cutting, or not cutting all the way through all layers, when assembling, the liner 144 will peel off leaving liner 151, 153, 152 and 154 on the seal-inserts 149 and 155, and thus, one labor step is reduced with this improvement. Inventor used to have material masked on a production line requiring an assembler to hand-place a piece of the tear-guide 89 in a region similar to 151 to mask it. It varied in dimension too much, and consistency was desired since location of masked material varied so often, only by machine-made markings such as 151 and machine made kiss-cuts 151 can consistency be achieved. With a diecut controlling the dimensions of the mask 151 and 152 of the invention, every masked area is identical and optionally, the adhesive liner may be used as the mask, reducing the labor required, because this way, the laborer leaves the little piece of adhesive liner 151 and 152, 153 and 154 on the seal-insert 149 and 155 without guessing where to place the tiny piece of adhesive masking material. Also, it should be pointed out that hand-masking by guessing or "eyeballing" has been done in production by inventor since 1994, it should be disclosed, but controlled or precision-masking is a recent invention, not yet shown to the public.

It should be pointed out that in FIGS. 38A through 38D, in all embodiments contained herein, the layers 143, 144 and 145 can be depicted differently. This patent has plenty of drawings, and in order to minimize the number of drawings, these versions will be depicted by FIGS. 38A through 38D, rather than repeating these drawings twice or more times. This applies to all embodiments that use FIGS. 38A through 38D contained herein. In one view of these figures, 143 is plastic or cardboard while 144 and 145A can be either glue, adhesive or two-sided tape. In another outlook, all 3 layers can represent a two sided tape or a transfer tape where 143 represents the center portion of the tape or carrier while 144 and 145B are the adhesive. In another view, 143 can be the glue/adhesive/2-sided tape while 144 and 145 can be the protective liner of the adhesive. All possibilities of the above are to be incorporated in this description throughout as possible configurations of seal inserts 138, 148, 149 and 155. There are infinite possibilities.

In U.S. Pat. No. 5,523,828, a seal assembly is discussed that reduces the tearing force required to pull a tear subassembly such as that described as 153 combined with perimeter adhesive. This patent uses slits(cuttings), foam, an aperture, rows of holes, an opening, two cuts at the beginning of the tear, a support under the pretear, which may be at either or both ends. In this present patent application, not only is the tearing force lowered as described by U.S. Pat. No. 5,523,828, but also, the tear is controlled and delamination of the tearing subassemblies 137 and 153 is prevented by using the device and methods described above. It should also be pointed out that this inventor's patent number Re. 35,529 shows the first positioning stiffener device and dates back to January 1993 while U.S. Pat. No. 5,523,828 disclosed a stiffener in September 1994, around one year and eight months later.

It should be pointed out that the embodiments of FIGS. 38A to 38D may be expanded for use in the seal of U.S. Pat. No. 5,523,828. A seal assembly has been made that has a stiffener device similar to that of U.S. Pat. No. 5,523,828 that uses the embodiments of FIGS. 38A to 38D to control the initial tear of the tear-material. Although this invention has been described, one embodiment is to make the seal assembly of that other patent but instead use the removal of adhesive at the tear opening 147 and 153 to control the initial seal tear, and also can use the kiss cut of the adhesive liner 151 or otherwise mask an entry portion of the adhesive in order to control the seal's initial tear. This may be done with a 2-sided tape, transfer tape, glue, adhesive, foam tape, plastic gasket with either 2-sided tape or glue on any or all surfaces, cloth tape, paper tape, foam tape, plastic tape, polyester tape, acrylic tape, rubber cement, rubber based adhesive, hot melt adhesive, hot melt pressure-sensitive adhesive, pressure sensitive adhesive, wood glue, TIGHT-BOND CEMENT, plastic wood, caulk, latex based adhesive, silicone based adhesive, resin glue, SUPERGLUE, LIQUID STEEL, army surplus glue, or any other adhesive or tape material in existence and by default any tape or adhesive material that did not yet exist at the time of this writing.

Please note that seals as in many of the figures have an inherent problem that might not seem obvious at first glance. For example, going back to FIG. 3C, where the tears are shown, particularly the tear labeled 92, it can occur that when pulling on the tear-guide 89, when the both tears labeled 92 are supposed to continue tearing after pulling, there can be occasions when, rather than both tears 92 tearing, either 92A and/or 92B may instead delaminate, peel off of the seal-insert of the seal assembly 109. When this occurs, a failure of the entire toner cartridge takes place which is very costly to the enduser who needs a toner cartridge, is costly to the retailer who sold the toner cartridge, and even more costly to the toner cartridge remanufacturer who has to pay all costs incurred and for the cost of the shipping of a failed toner cartridge as well as a replacement "no cost" toner cartridge to make up for the failed toner cartridge. Not mentioning an unhappy if not lost customer, his type of failure can be very costly. Inventor has a solution. First the solutions mentioned in embodiments of FIGS. 38A through 38D show a solution to this type of problem. However, that described solution would not be complete if not for a process that can be done on the seal-assembly 109, which is also applicable to other seal assemblies. It consists of using a press, a hydraulic press, motorized press, flywheel press, punch press, clicker press, clamshell press, arbor press, hammer press, hammer, or any other device that exerts a pressure. For example, an arbor press may be used to exert a pressure on the ends 92A and 92B as well as the middle between the slits 92 and 92 shown in FIG. 3C. This may be done with or without the slits. For example, the press may be pressed on all regions, 92, 92, 92A and 92 B all at once, or may press each region individually. Press may be machined on the hammer pressure area to be indented to fit the contour, optionally. The press's hammer or pressure rod may have different smoothness for a different effect. For example, the hammer head may be perfectly smooth for a good pressure to cause adhesive to adhere. Press may be rough with bumps. It may have little pyramidical points or bumps, octahedrons, half octahedrons, spikes, nails, removable nails, removable spikes, knurls, single knurl, double knurl perpendicular to each other, lines, sharp lines, points, or other shape. The purpose of the pointed and other shapes is to stick into the adhesive and plastic of the seal-insert in order that the tear material 93 (FIG. 3C) will not delaminate or peel off of the seal-insert 138 (FIG. 38A). In some applications, pressing on the end of the seal assembly 109 on the ends 92, 92A, 92B, with a coarse or rough material that "digs" into the material will accomplish a more permanent adhesion than otherwise, almost like "crimping" the tear material 93 into the seal-insert 138. The adhesive can ooze into the little pores or scores from the pressing action. This pressing action will essentially "crimp" the tear-material 93 into the seal-insert 138 for long-lasting, if not permanent bonding. It should be pointed out that since 1994, inventor has used the pressing procedure on seal assemblies as in FIG. 3C with seal-inserts as in FIG. 38A, on a regular, commercial production basis for resale seal assemblies 109. The same is tine of neutralizing the adhesive with a small strip under the initial tear. However, inventor has just began using the press and neutralization together without the slit. Recently, inventor was confronted with a patent of a competitor who has a patent on the slit, and inventor had to develop a way of making this seal without the slits 92. Inventor found that using the embodiments of FIGS. 38B, 38C, and 38D, in combination with using the press along the edges and middle of the initial tear, caused a controlled tear, a tear that never fails, a tear that is identical all the time, without requiring an initial tear. Thus, when the enduser pulls the seal assembly similar to 109, or other seal assembly, but any seal assembly that does not have cuts 92, that the initial tear is totally controlled and easier to tear than otherwise, and thus, failure in the field is prevented. Although inventor has used tears with an a press previously and has used adhesive masking underneath the initial tear previously, inventor had not previously used this technique without the tear, a novel and new way of controlling the way the initial tear takes place. Inventor has only recently made this discovery and it was not obvious from prior art. In prior art, the pretears 92 were required, and the press on the ends and the middle were just to insure that the material did not delaminate. The precuts 92 controlled the tear, not the masking and pressing. However, it was recently found that the labor of performing the precut 92 has been eliminated with this innovation and the initial tear is controlled even better than previously with either of these innovations as well as both innovations combined, that is, the pressing and the adhesive masking. To further improve the device and process, inventor also recently developed the die-cutting where the adhesive will be either masked or removed as shown in FIGS. 38B through 38D, already described, and also incorporating the pressing of the ends 92, 92, 92A and 92B without making cuttings shown at 92. It should be pointed out that this press technique, adhesive masking, controlled kisscut diecut adhesive masking or removing may be used on any seal device of this patent, any prior art in this patent, any seal assembly that tears in existence, and for any seal assembly that tears that does not yet exist.

FIG. 39 shows a simple seal assembly 109 with a tear-guide 89 and a slot 139. This seal assembly has been improved in FIG. 40 by having the liner 154 on the seal have an easypull region 155 of liner with no adhesive that is easy to grab.

Figure 48:
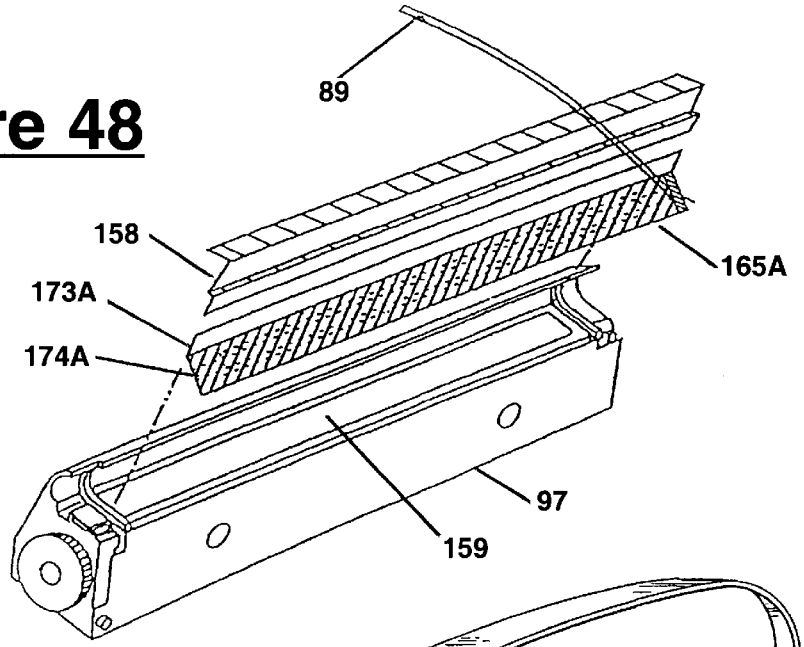
Figure 48 PRIOR ART
FIG. 48 shows a prior art sidewall seal, toner hopper and cutout toner cartridge attach area.
Figure 49:
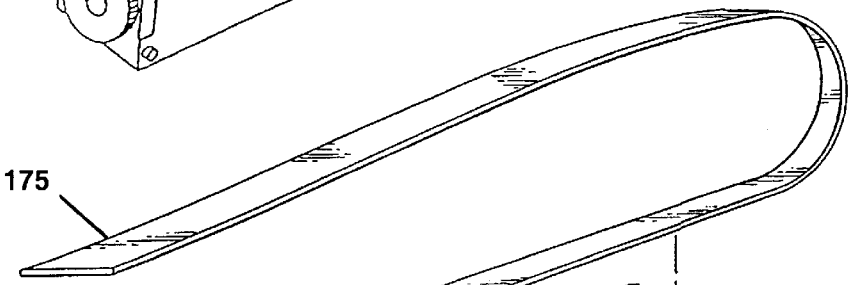
FIG. 49 shows a new and improved sidewall seal in isometric view.
Figure 50:
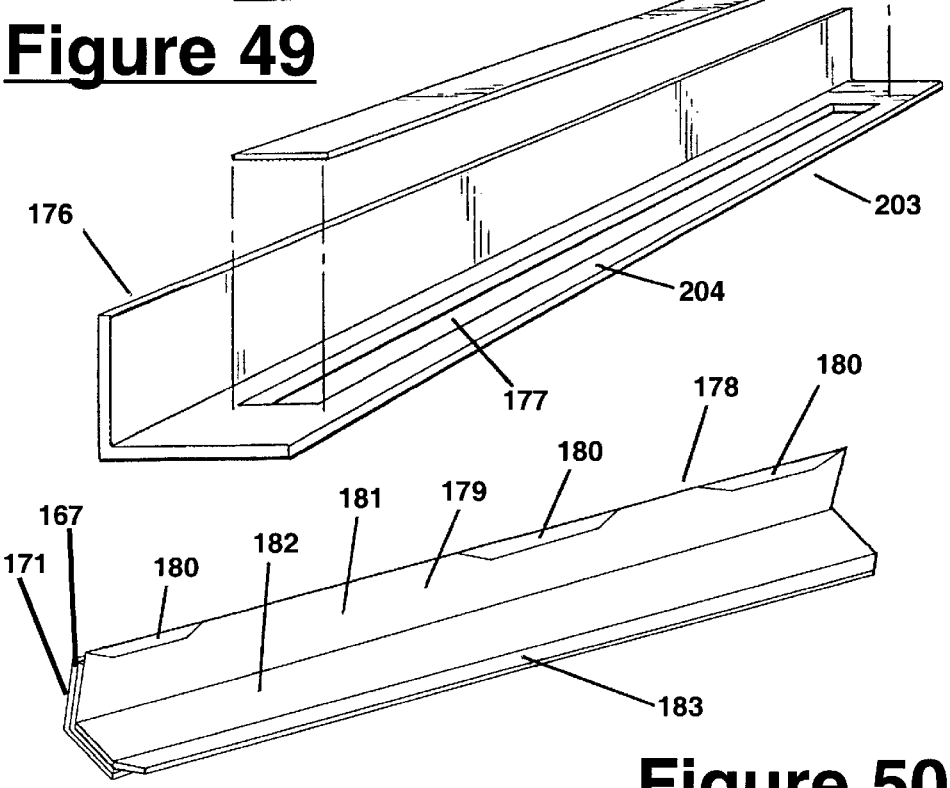
FIG. 50 shows a new and improved brace positioning stiffener device for installing a sidewall seal.
Figure 55B:
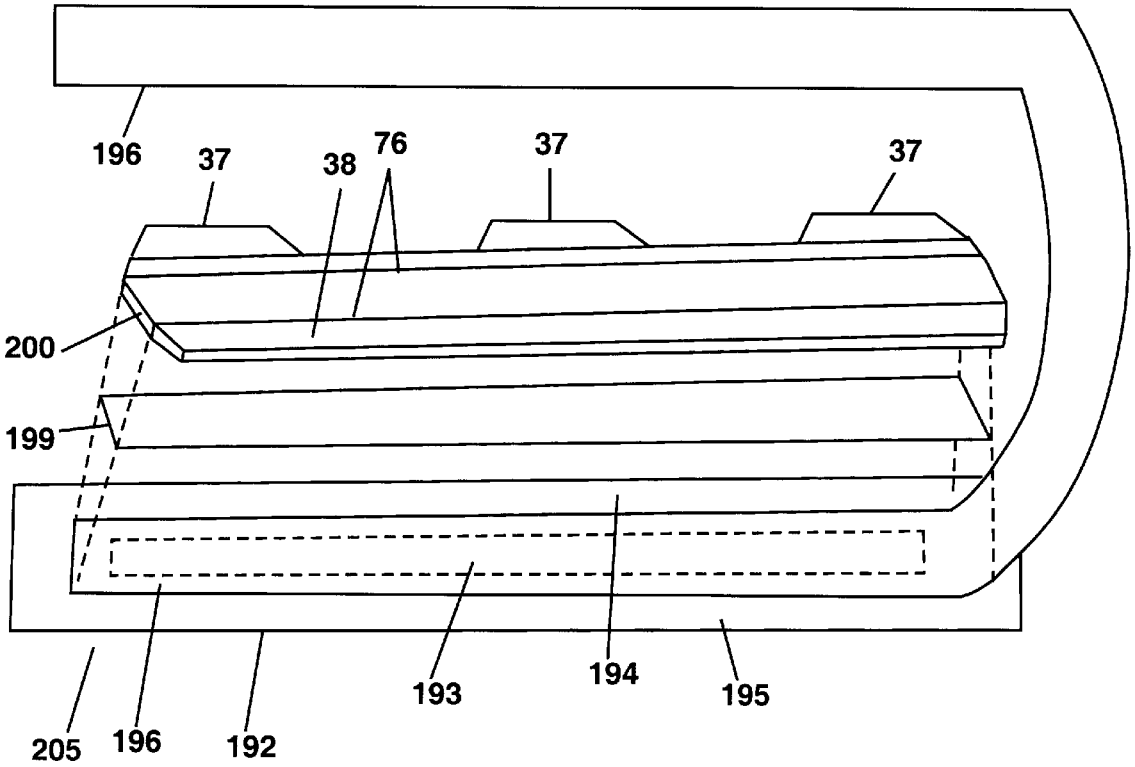
FIG. 55B shows at shipping seal assembly.

FIG. 41 shows a toner hopper assembly with a sidewall seal installed in it. A prior art sidewall seal assembly 165A is shown in FIG. 48 from U.S. Pat. No. 5,621,508. The sidewall seal has a base attach portion 174A and a sidewall attach portion 173A which attaches to the sidewall 158. The sidewall seal assembly 165A attaches to the base of the toner hopper 97 covering the slot opening 159. When the tear-guide 89 is pulled, the tear-guide controls the opening in the seal. FIG. 41 shows a sidewall seal 167 installed in a toner hopper 97. When the tear-guide is torn, the sidewall seal opens up a channel for toner to fall through. FIG. 42 and 43 shows a sidewall seal assembly 165 being prepared for installation. As can be seen, the installer must first remove the protective adhesive liner 171 to expose the adhesive 170 for use. But as can be seen, there is a positioning support device (brace) 166 that stiffens the seal to be manageable while installing in the toner hopper 97. Once the sidewall seal assembly of this invention 165 is installed, the disposable positioning brace 166 is then removed. This provides an easy installable method and device for installing the very difficult sidewall seal 167 in its location. Previously, the sidewall seal 167 was installed as shown in FIGS. 44 and 45 by inventor where the liner is not removed until after the sidewall seal is put in position. This is a very tedious process and therefore, the invention significantly improves upon the old method and device. FIG. 46 shows yet another improvement of the sidewall seal assembly 165. An easypull liner 202 is shown for easy removal of the liner 171 of the sidewall seal assembly 165. FIG. 47 shows the cutaway of a toner hopper 97 with a sidewall seal 167 installed in the toner hopper 97. The backwall portion 173 attaches to the backwall 158 of the toner hopper 97 while the base 174 of the sidewall seal 167 fits over the base of the toner hopper 97 so that the sidewall seal 167 covers the slot or opening 159 of the toner hopper 97. Inventor owns U.S. Pat. No. 5,296,902 that discloses a seal-insert with a tape or heat-tape that removes from the covering of a slot. FIG. 49 shows another embodiment of a sidewall seal. This seal assembly 203 has a sidewall seal-insert 176 with a slot 177 where toner falls through. The seal portion 175 may be either attached with heat tape or regular tape/adhesive/2-sided-tape, fitting nicely over the slot 177. It must be larger than the slot 177 in order to both cover the slot and also to adhere to some of the surface of the base 204 of the seal-insert 176. Thus after this seal insert 176 is installed by the toner cartridge remanufacturer, the enduser who receives the toner cartridge pulls on the seal 175, be it tape/adhesive/2-sided-tape or heat-tape, and the seal 175 delaminates from the seal-insert 176 for an easypull seal. Of course this seal assembly 203 or the seal assembly 165 of FIG. 42 may be installed with a more sophisticated positioning tab brace device 181 as shown in FIG. 50. The brace 179 has a brace base 182, a brace sidewall 181, and all the options already described for removable braces in this patent. Partial length tabs 180 are optional as well as a full length tab 183 for ergonomic removal of the brace/sidewall seal assembly 178 and easy installation of the seal-insert 167. The release liner 171 of the sidewall seal-insert 167 is also shown in FIG. 50.

FIG. 51 shows a prior art perimeter seal 184 of U.S. Pat. No. 5,080,745. The seal 184 consists of a strip of flexible film with a pull end 185 and a perimeter adhesive 186 located typically in a rectangle with no adhesive in the center region 187 of the rectangle. If you look at the patent, it shows a very difficult procedure of installation that involves a little bit of origami, a little bit of skill, and a lot of luck. This process U.S. Pat. No. 5,080,745 shows not only a lot of folding and an insertion tool involved in the installation process, but it also involves a lot of maneuvering to make certain that you are grabbing the correct arm of the strip. This seal, in its prime, was the best seal on the market, as it is credited as being an early OEM lookalike seal in the aftermarket that fits directly over the opening 133 in the toner hopper 89. It is still a good seal. Only now, this seal may be installed even easier using the positioning brace 190 with its removable adhesive 189 adhering it permanently to the brace 190 and removably to the seal assembly 184 of FIG. 52. Also, it has been further improved by adding a protective liner protrusion 188 on the liner 191 whereby the liner has no adhesive over this protrusion. All the same features of a seal assembly using the stiffener positioning device 190 are shown in FIG. 52. The partial length tabs 37 are shown, the full length tab 38 is shown, and these integral tabs can be located on any edge of the positioning device 190. This drawing of this perimeter seal 184 is the most ergonomic way to make this seal at this time. Perhaps the perimeter seal could have a comeback. However, even though this is a perimeter seal 184 in the drawing, it should be noted that the perimeter adhesive could cover the entire attach rectangle of the nonadhesive region 187 inside the perimeter adhesive, for the simplest design to manufacture.

FIGS. 53 through 57 relate to U.S. Pat. No. 5,296,902 by the inventor. This patent involves a seal insert 192 with a slot 193 in the center, a back leg of the seal-insert 192, a front leg 195, and a seal 196. This seal assembly 205 is a simpler version of the seal assembly 203 of FIG. 49, only does not have the sidewall. The seal 196 covers a slot 193 in the seal-insert 192 and is thus, wider than the slot. The seal may be either a tape/adhesive/2-sided-tape seal or a heat-seal whereby heat is applied to attach the seal to the seal-insert 192, which may be conveniently done by the manufacturer at the seal factory. This embodiment may have all the features of FIGS. 15A, 15B, 27, 28A, 28B or 52 for userfriendly installation. The positioning installation brace, just like all the other positioning installation braces may be made out of plastic, metal, cardboard, hard rubber, or any stiff material, but is shown in the FIG. 55B.

FIGS. 58–60 show embodiments improving the Prestel seal of U.S. Pat. No. 5,110,646. FIGS. 58 and 59 were taken out of the Prestel patent to show the cumbersomeness of the installation of this seal.

If you have ever held a 9 inch piece of loose tape, and experienced how it sticks all over the place, you can imagine how difficult it is to use the seal of that patent, as described. After practice, it gets easier, however, by using the invention of FIG. 60, the Prestel seal becomes much easier to install. By merely adding a positioning brace 200 to the seal assembly 198, using a tape that is designed to stick permanently to the brace 200 but adhere removably to the seal 198, installation of a rigid Prestel seal becomes easy and simple. The stiffener device 200 may optionally have partial length tabs 37, full length tabs 38, folds or creases 76 and may be positioned in any configuration imaginable on the seal 198.

Figure 61:
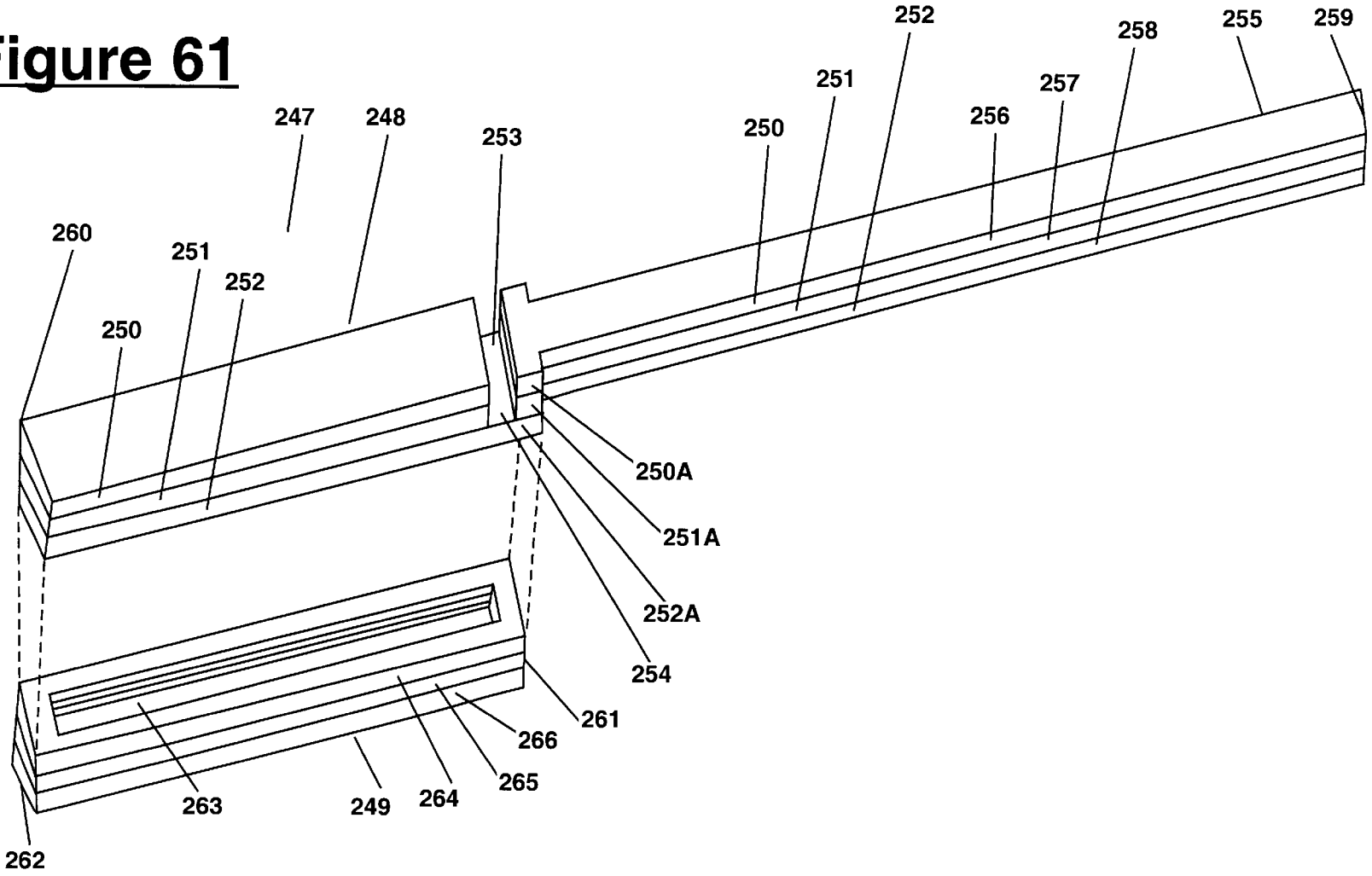

FIG. 61 shows an ergonomic seal-assembly 247 similar to the recovery blade assembly 206 of FIG. 11C. It consists of a tear subassembly 248 and a seal-insert 249. In one embodiment the seal-insert 249 may consist of a 2-sided-tape/glue/adhesive/(plastic with tape or glue on each side) 265 with a release liner 264 on top and a release liner 266 on the bottom. Optionally, for easy handassembly/manufacturing of the assembly 247, the bottom release liner 266 is made of a rigid material such as a cardboard or cardboard like release liner 266. Rigid release liners such as cardboard or plastic may be found in the automotive adhesive supply industry in varying degrees of thickness and rigidity, so multiple choices exist of adhesives with heavy duty release liner. The reason that a rigid release liner 266 could be appropriate here is because it would facilitate hand assembly of the seal-insert 249 to the tear subassembly 248, and this is an important part of the embodiment. Not everyone knows of these heavy duty release liners. Note that although the top release liner 264 is shown on top of the seal-insert 249 in FIG. 61, in a breakdown of the seal assembly 247 embodiment, in practice, this top release liner 264 would be removed from the seal-insert 249 before being assembled with the tear subassembly 248 to make the seal assembly 247. The seal-insert 249 has a slot 263, a left side 262, and a right side 261. The tear subassembly 248 is composed of three basic layers, the positioning support stiffener 250, the preferential adhesive 251, that is designed to stick permanently to the support stiffener 250 and removably adhered to the preferential tear material 252. The tear subassembly has a left side 260 and a right side 259. The narrower right side 259 of the tear subassembly 248 is called the tail 255. The tail has three layers, the stiffener layer 256, the preferential adhesive layer 257 and the tear material layer 258. The tear subassembly 248 has a back kiss-cut region 253 and a front kiss-cut region 254, where the positioning stiffener 250 and preferential adhesive 251 have been cut through. Thus, the preferential tear-material 252, has either not been cut through or has been barely cut through, enabling the removal of the entire tail 255, beginning at 250A and 251A to be removed. Then the seal assembly 247 may be installed by removing the entire release liner 266 to be attached to a toner hopper. Then, the installer may grab the tear material 252 at position 252A and then also grab the installation support stiffener 252 to easily and precisely install the seal assembly 247 into a toner hopper 97. The installer may then if remove the entire positioning stiffener 250 and preferential adhesive 251. In the typical case, a fold, crease, indentation, or slight cut may be made at the region between the back kiss-cut 253 and the Front kiss-cut 254. Thus the user may remove what remains of the positioning stiffener 250 and preferential adhesive 251 after installing the entire seal assembly 247 into a toner hopper. As with the other embodiments of FIG. 28C and 28D, the kiss-cut regions 253 and 254 may be multiple kiss-cuts or may be one kiss-cut, although FIG. 61 shows it as multiple kiss-cuts. The result after installation is flexible material 252 adhered with a gasket-shaped glue/2-sided-tape holding the flexible material 252 onto the toner hopper 97.

Note that any blade improvement contained in this patent application may be a recovery blade, keeper blade, wiper blade, doctor blade, plastic doctoring blade, spreader blade, or any other blade used in a toner cartridge, or other Xerographic imaging machine. Furthermore, any positioning device/brace/support member/splint/stabilizer/installation support/setting device/reinforcing member/spine in any embodiment of this patent application may be made of any material whatsoever, not to exclude plastic, cardboard, paper, metal, rubber, foam, foam-rubber, open-cell, closed-cell material, urethane rubber, plastic with metal plate, plastic with metal coated surface, plastic with aluminum film, antistatic plastic, antistatic material, nonantistatic material, single layer material, double layer material, multiple layer material, composite material, vinyl, polycarbonate, PETG, acetate, MYLAR, fibrous material, fiber reinforced material, stranded material, cloth material, polyethylene, polyester, TEFLON, DELRON, polypropylene, extruded material, rolled material, heat-rolled material, wood, cross-grained material, molded material, any paper product, any paper derivative product, any plastic derivative product, magnetic material, nonmagnetic material, notched material, baked material, heat-treated material, laminate, FORMICA, spring material, spring-steel, spring brass, spring bronze, conductive material, nonconductive material, pressed material, die-cut material, cross-linked material, stressed material, nonstressed material, coated material, conductive coated material, brace material, material with two smooth surfaces, material with one smooth and one rough surface, material with two rough surfaces, material with one or more surface of a matte finish, clear material, opaque material, radioactive material, non-radioactive material, reflective material, nonreflective material, heat or light reflective material, antistatic material, or any material whatsoever.

Please note that any urethane for any blade in this invention may be made of conductive coated urethane, partially conductive coated urethane, loaded with conductive material to be conductive in the manufacturing of the urethane, or may be made conductive using conductive carbon black. One way to add the conductive component to make conductive urethane of varying resistivities/conductivities is to load the urethane in manufacturing with a conductive carbon black filler. It is like pigmenting color only instead of regular black it is conductive carbon black. Compounded in a 50% loading of black in color concentrate. The maximum load is around 10% to 12% conductive carbon black, although the loading varies with material thickness. With a 20 mil urethane, 10–12% loading is maximum load. With thinner material it is less because the thinner the urethane, the more difficult it is to load. Before extruding, the urethane is in the form of conductive pellets. There are many applications of blades in toner cartridges and imaging machines, some not mentioned here, where conductive blades may be desired. There are antistatic reasons, charging reasons, and other reasons, but any conductive or partially conductive blade in a toner cartridge or imaging machine may be incorporated into this invention using any of the embodiments.

Materials that may be installed with stiffener/support/brace/positioning device include any plastic, cardboard, stiff paper, paper, flexible material, film, metal, metallized plastic, paper, paper products, paper derivatives, foamlike material, foam, foam rubber, rubber, hard rubber, open cell material, closed-cell material, urethane, urethane rubber, neoprene rubber, silicone rubber, cloth, or any other material. The embodiments of this invention may be used to install any devices or strips, plastic, cardboard, paper, any material with slots, any material with openings, gaskets, horseshoe shaped material, u-shape material, v-shape material, w-shape material, or any material or device of any shape.

Please note that any embodiment contained in this patent application may be incorporated into any other embodiment and if any such details may be inadvertently left out, it can be thus incorporated into any embodiment. Also, there are many other versions of seals and strips that could use the improvements of this invention that were not mentioned specifically by name or defined specifically, and the inventor wants to reserve his right to incorporate the embodiments of this invention further into any similar device or structure to the uses described in detail in this patent application.

Since minor changes and modifications varied to fit particular operating requirements and environments will be understood by those skilled in the art, the invention is not considered limited to the specific examples chosen for purposes of illustration. The invention includes all changes and modifications which do not constitute a departure from the true spirit and scope of this invention as claimed in the following claims and as represented by reasonable equivalents to the claimed elements.

What is claimed is:

1. A strip assembly used in an imaging machine or a toner cartridge which is used in a laser printer, copy machine, or facsimile machine including:

a flexible strip;

said flexible strip including a front surface adapted to be adhesively installed to a structure of the imaging machine or cartridge and a back surface; and a positioning stiffener support removably adhered to said back surface of said flexible strip.

2. The strip assembly as in claim 1 wherein said front surface of said flexible strip has a pressure-sensitive adhesive; whereby said pressure-sensitive adhesive has a protective liner;

and said protective liner protrudes from an end of said flexible strip for ease removal of said protective liner.

3. The strip assembly as in claim 1 wherein said flexible strip is made conductive or partially conductive either by coating said flexible strip or by manufacturing said flexible strip wherein said flexible strip contains conductive material.

4. The strip assembly as in claim 3 wherein said conductive material in said flexible strip is conductive carbon black.

5. The strip assembly as in claim 1 wherein said flexible strip is made conductive or partially conductive either by coating said flexible string or by manufacturing said flexible string wherein said flexible strip contains conductive material for charging reasons.

6. The strip assembly of claim 1 wherein said positioning stiffener support includes a removal flap adapted to permit said positioning stiffener support to be easily separated from said flexible strip.

7. The strip assembly of claim 6 wherein said removal flap is attached to a main body portion of said positioning stiffener support adjacent a fold line.

8. The strip assembly of claim 1 wherein said flexible strip is a rectangular member adapted to be installed on a toner cartridge.

9. The strip assembly of claim 1 further including a kiss-cut which extends through said flexible strip but not through said positioning stiffener support to divide said flexible strip into an installable portion and a handle portion whereby said handle portion can be pulled after said strip assembly has been installed to facilitate removal of said positioning stiffener support from said flexible strip.

10. A device for sealing a tone passage in a toner hopper of the type used in printer copying machine or facsimile machine toner cartridges said device including:

a positioning stiffener support;

a first adhesive layer-adhered to said positioning stiffener support;

a cut extending through said positioning stiffener support to divide said positioning stiffener support into a main portion and a tail portion whereby said tail portion can be removed prior to installation of said device;

said positioning stiffener support and said first adhesive layer being removably adhered to a flexible material layer;

a second adhesive layer having a first surface adhered to said flexible material layer;

a release liner covering a second surface of said second adhesive layer and which is adapted to be removed to allow installation of said device whereby said main portion of said positioning stiffener support can be removed after said device has been attached to a toner hopper to complete installation of said device.

11. The device of claim 10 wherein said second adhesive layer is rectangular with a slot.

12. The device of claim 11 wherein said flexible material layer includes a tail portion and a main portion, and said second adhesive layer is attached only to said main portion of said flexible material layer.

13. The device of claim 10 wherein said flexible material layer comprises a tearable material.

14. A strip assembly used in an imaging machine or a toner cartridge which is used in a laser printer, copy machine, or facsimile machine including:

a positioning stiffener support;

a first adhesive layer adhered to said positioning stiffener support;

said positioning stiffener support and said first adhesive layer being removably adhered to a flexible strip;

a second adhesive layer including a first surface adhered to said flexible strip; and a release liner covering a second surface of said second adhesive layer and adapted to be removed to allow said strip assembly to be attached to a structure of the imaging machine or cartridge whereby said positioning stiffener support can be removed after said strip assembly has been attached to the structure.

15. The strip assembly of claim 14 further including a kiss-cut extending through said release liner layer, said second adhesive layer, and said flexible strip layer but without fully penetrating said positioning stiffener support to form an installable portion of said strip assembly on one side of said kiss-cut and a handle portion on another side of said kiss-cut.

16. The strip assembly of claim 15 wherein said positioning stiffener support includes a removal flap adapted to permit said positioning stiffener support to be easily separated from said flexible strip.

17. The strip assembly of claim 16 wherein said removal flap is attached to a main body portion of said positioning stiffener support adjacent a fold line.

18. The strip assembly of claim 14 wherein said flexible strip is a rectangular member adapted to be installed on a toner cartridge.

19. The strip assembly of claim 14 wherein said flexible strip is a spreader blade.

20. The strip assembly of claim 14 wherein said flexible strip is a recovery blade.

21. The strip assembly of claim 14 wherein said flexible strip is a wiper blade.

22. The strip assembly of claim 14 wherein said flexible strip is a flexible foam strip.

23. The strip assembly of claim 14 wherein said flexible strip is a plastic strip adapted to be installed on a toner cartridge.

24. The strip assembly of claim 14 wherein said flexible strip is a urethane strip adapted to be installed on a toner cartridge.

25. A device for scaling a toner passage in a toner hopper of the type used in printer, copying machine, or facsimile, machine toner cartridges, said device including:

a sealing assembly including a front surface adapted to be joined to a toner hopper and a back surface;

a positioning stiffener support removably adhered to said back surface of said sealing assembly;

a kiss-cut extending through said sealing assembly without fully penetrating said positioning stiffener to divide said sealing assembly into at least two portions.

26. A gasket assembly used in an imaging machine or a toner cartridge which is used in a laser printer, copy machine or facsimile machine including:

a flexible strip;

said flexible strip including a front surface adapted to be adhesively installed to a structure of the imaging machine or cartridge and a back surface; and a positioning stiffener support removably adhered to said back surface of said flexible strip.

27. The gasket assembly of claim 26 wherein said positioning stiffener support includes a removal flap adapted to permit said positioning stiffener support to be easily separated from said flexible strip.

28. The gasket assembly of claim 27 wherein said removal flap is attached to a main body portion of said positioning stiffener support adjacent a fold line.

29. A gasket assembly used in an imaging machine or a toner cartridge which is used in a laser printer, copy machine, or facsimile machine including:

a positioning stiffener support;

a first adhesive layer adhered to said positioning stiffener support;

said positioning stiffener support and said first adhesive layer being removably adhered to a flexible gasket layer;

a second adhesive layer including a first surface adhered to said flexible gasket layer; and a release liner covering a second surface of said second adhesive layer and adapted to be removed to allow said gasket assembly to be attached to a structure of the imaging machine or cartridge whereby said positioning stiffener can be removed after said gasket assembly has been attached to the structure.

30. The gasket assembly of claim 29 further including a kiss-cut extending through said release liner layer, said second adhesive layer, and said gasket layer but without fully penetrating said positioning stiffener support to form an installable portion of said gasket assembly on one side of said kiss-cut and a handle portion on another side of said kiss-cut.

31. The gasket assembly of claim 30 wherein said removal flap is attached to a main body portion of said positioning stiffener support adjacent a fold line.

32. A gasket assembly including:

a positioning stiffener support;

a first adhesive layer adhered to said positioning stiffener support;

said positioning stiffener support and said first adhesive layer being removably adhered to a flexible gasket layer;

a second adhesive layer including a first surface adhered to said flexible gasket layer; and a release liner covering a second surface of said second adhesive layer and adapted to be removed to allow said gasket assembly to be attached to a structure whereby said positioning stiffener can be removed after said gasket assembly has been attached to the structure and;

further including a kiss-cut extending through said release liner layer, said second adhesive layer, and said gasket layer but without fully penetrating said positioning stiffener support to form an installable portion of said gasket assembly on one side of said kiss-cut and a handle portion on another side of said kiss-cut.

33. A strip assembly used in an imaging machine or a toner cartridge which is used in a laser printer copy machine, or facsimile machine including:

a positioning stiffener support;

a first adhesive layer adhered to said positioning stiffener support;

said positioning stiffener support and said first adhesive layer being removably adhered to a flexible strip;

a second adhesive layer including a first surface adhered to said flexible strip; and a release liner covering a second surface of said second adhesive layer and adapted to be removed to allow said strip assembly to be attached to a structure whereby said positioning stiffener can be removed after said strip assembly has been attached to the structure of the imaging machine or cartridge;

wherein said flexible strip is made conductive or partially conductive either by coating said flexible strip or by manufacturing said flexible strip wherein said flexible strip contains conductive material for charging reasons.

34. A strip assembly including:

a positioning stiffener support;

a first adhesive layer adhered to said positioning stiffener support;

said positioning stiffener support and said first adhesive layer being removably adhered to a flexible strip;

a second adhesive layer including a first surface adhered to said flexible strip;

a release liner removably joined to a second surface of said second adhesive layer and adapted to be removed to allow said strip assembly to be attached to a structure whereby said positioning stiffener can be removed after said strip assembly has been attached to the structure, and a kiss-cut extending through said release liner layer, said second adhesive layer, and said strip layer to form an installable portion or said strip assembly on one side of said kiss-cut and a handle portion on another side of said kiss-cut.

35. The strip assembly of claim 34 wherein said flexible strip is a spreader blade.

36. The strip assembly of claim 34 wherein said flexible strip is a recovery blade.

37. The strip assembly of claim 34 wherein said flexible strip is a wiper blade.

38. The strip assembly of claim 34 wherein said flexible strip is a flexible foam strip.

39. The strip assembly of claim 34 wherein said flexible strip is any plastic strip that is to be installed on a toner cartridge.

40. The strip assembly of claim 34 wherein said flexible strip is any urethane strip that is to be installed on a toner cartridge.

* * * * *